US006544725B2

(12) United States Patent
Morimoto

(10) Patent No.: US 6,544,725 B2
(45) Date of Patent: Apr. 8, 2003

(54) LIGHTSENSITIVE SILVER HALIDE PHOTOGRAPHIC EMULSION, SILVER HALIDE PHOTOGRAPHIC LIGHTSENSITIVE MATERIAL CONTAINING THE SAME, AND METHOD OF ENHANCING SENSITIVITY OF LIGHTSENSITIVE SILVER HALIDE PHOTOGRAPHIC EMULSION

(75) Inventor: Kiyoshi Morimoto, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/923,346

(22) Filed: Aug. 8, 2001

(65) Prior Publication Data

US 2002/0146653 A1 Oct. 10, 2002

(30) Foreign Application Priority Data

Aug. 8, 2000 (JP) ..... 2000-239940
Jul. 5, 2001 (JP) ..... 2001-205040

(51) Int. Cl.[7] ..... G03C 1/005; G03C 1/494

(52) U.S. Cl. ..... 430/567; 430/607; 430/608; 430/613; 430/598; 430/264; 430/267; 430/570

(58) Field of Search ..... 430/567, 607, 430/608, 613, 598, 264, 267, 570

(56) References Cited

U.S. PATENT DOCUMENTS 4,983,508 A * 1/1991 Ishiguro et al. ..... 430/569
5,194,367 A * 3/1993 Yamada et al. ..... 430/567
5,382,496 A 1/1995 Sakai et al.
6,007,977 A * 12/1999 Nishikawa ..... 430/567
6,479,230 B1 * 11/2002 Morimoto ..... 430/567

FOREIGN PATENT DOCUMENTS

JP A6143740 3/1986
JP A1116544 5/1989

* cited by examiner

*Primary Examiner*—Geraldine Letscher
(74) *Attorney, Agent, or Firm*—Birch, Stewart, Kolasch & Birch, LLP

(57) ABSTRACT

A lightsensitive silver halide photographic emulsion comprises silver halide grains, a sensitizing dye having a given maximum absorption wavelength and an organic compound exhibiting no absorption in a visible light region. The addition amount of the organic compound is in the range of 1 to 50 mol % based on the sensitizing dye, and a maximum absorption wavelength of the photographic emulsion exhibited by the sensitizing dye in the presence of the organic compound is at least 2 nm shorter than the maximum absorption wavelength exhibited by the sensitizing dye in the absence of the organic compound.

14 Claims, No Drawings

LIGHTSENSITIVE SILVER HALIDE PHOTOGRAPHIC EMULSION, SILVER HALIDE PHOTOGRAPHIC LIGHTSENSITIVE MATERIAL CONTAINING THE SAME, AND METHOD OF ENHANCING SENSITIVITY OF LIGHTSENSITIVE SILVER HALIDE PHOTOGRAPHIC EMULSION

CROSS-REFERENCE TO RELATED APPLICATIONS

This application is based upon and claims the benefit of priority from the prior Japanese Patent Applications No. 2000-239940, filed Aug. 8, 2000; and No. 2001-205040, filed Jul. 5, 2001, the entire contents of both of which are incorporated herein by reference.

BACKGROUND OF THE INVENTION

1. Field of the Invention

The present invention relates to a lightsensitive silver halide photographic emulsion, a silver halide photographic lightsensitive material containing the same, and a method of enhancing the sensitivity of a lightsensitive silver halide photographic emulsion.

2. Description of the Related Art

With respect to silver bromide or silver iodobromide tabular grains whose main planes are (111) faces, processes for producing the same and technologies for utilizing the same are disclosed in, for example, U.S. Pat. Nos. 4,434,226, 4,439,520, 4,414,310, 4,433,048, 4,414,306 and 4,459,353. Thus, the advantages such as an improvement of sensitivity/graininess relationship and an enhancement of sensitivity, including an enhancement of color sensitizing effect, attained by sensitizing dyes are known. Further, reference can be made to, for example, Jpn. Pat. Appln. KOKAI Publication No. (hereinafter referred to as JP-A-) 58-113926, JP-A's-58-113927, 58-113928, 2-838, 2-28638 and 2-298935. Attempts to improve various photographic properties by intentionally introducing dislocations therein under control are known. JP-A-63-220238 discloses a method of introducing dislocation lines in the periphery of tabular grains. JP-A-1-102547 discloses a method of introducing dislocation lines in the main planes of tabular grains. JP-A-3-237450 discloses tabular grains of 3 or more aspect ratio having dislocation lines, chemically sensitized with the use of, for example, a selenium sensitizer, a gold sensitizer or a sulfur sensitizer. JP-A-6-27564 discloses tabular grains having dislocation lines localized in fringe portions thereof only.

With respect to silver bromide or silver iodobromide tabular grains whose main planes are (100) faces, there are the following various processes.

For example, there can be mentioned the process of JP-A-51-88017 (monodispersed seed grains are ripened in the presence of ammonia, thereby forming silver bromide (100) tabular grains), the process of JP-A-58-95337 (wherein seed grains are ripened in the absence of silver ion complexing agents other than halides, thereby forming silver bromide (100) tabular grains), the process of JP-A-6-308648, EP No. 670515A2, JP-A's-7-234470 and 8-122950 (wherein one or more halide composition gap faces are formed in seed grains or at the time of seed grain formation so as to introduce crystal defects for accelerating anisotropic growth, thereby forming (100) tabular grains), the process of EP No. 0534395A1 (wherein nuclei of high AgCl content are formed in a dispersion medium solution containing $I^-$ ions so as to generate crystal defects, thereby forming (100) tabular grains) and the process of JP-A-8-339044 (wherein grains are formed in the presence of a compound selected from among specific adsorbents capable of accelerating the formation of (100) faces, thereby forming (100) tabular grains).

Grains of high silver chloride content tend to become grains having (100) faces as external surfaces under customary production conditions, and grains having served practical use have been cubic. Examples of hitherto developed tabular (100) grains can be found in, for example, U.S. Pat. Nos. 5,320,938, 5,264,337 and 5,292,632.

Grains of high silver chloride content having (111) faces as external surfaces (hereinafter referred to as (111) grains) have been utilized. Examples thereof are disclosed in JP-A-6-138619.

Special measures are required for producing (111) grains of high silver chloride content. Wey in U.S. Pat. No. 4,399,215 discloses a process for producing tabular grains of high silver chloride content with the use of ammonia. Because of the use of ammonia in the production of grains according to this process, silver chloride grains of high solubility are produced at higher solubility, with the result that it has been difficult to produce practically useful small-size grains. Further, because the pH value at the time of production is as high as 8 to 10, the process has had such a disadvantage that fogging is likely to occur. Maskasky in U.S. Pat. No. 5,061,617 discloses (111) grains of high silver chloride content produced with the use of thiocyanates.

Methods of incorporating additives (crystal habit-controlling agents) at the time of grain formation in order to produce grains of high silver chloride content having (111) faces as external surfaces without causing any solubility increase are known. The methods are described in, for example, U.S. Pat. No. 4,400,463 (azaindenes+thioether peptizers), U.S. Pat. No. 4,783,398 (2-4 -dithiazolidinone), U.S. Pat. No. 4,713,323 (aminopyrazolopyrimidine), U.S. Pat. No. 4,983,508 (bispyridinium salts), U.S. Pat. No. 5,185,239 (triaminopyrimidine), U.S. Pat. No. 5,178,997 (7-azaindole compound), U.S. Pat. No. 5,178,998 (xanthine), JP-A-64-70741 (dyes), JP-A-3-212639 (aminothioethers), JP-A-4-283742 (thiourea derivatives, by Ishiguro), JP-A-4-335632 (triazolium salts), JP-A-2-32 (bispyridinium salts) and JP-A-8-227117 (monopyridinium salts).

Methods of sensitizing tabular grains with the use of epitaxial junction are disclosed in JP-A's-58-108526 and 59-133540. Applications thereof to tabular grains of smaller thickness or larger equivalent circle diameter are disclosed in JP-A's-8-69069, 8-101472, 8-101474, 8-101475, 8-171162, 8-171163, 8-101473, 8-101476, 9-211762 and 9-211763 and U.S. Pat. Nos. 5,612,176, 5,614,359, 5,629,144, 5,631,126, 5,691,127 and 5,726,007.

With respect to the above various emulsions, there is a strong demand for the development of an emulsion of low fogging and high sensitivity.

How to use sensitizing dyes are well known. In particular, combinations of sensitizing dyes are often employed for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,7007, GB Nos. 1,344,281 and 1,507,803, Jpn. Pat. Appln. KOKOKU Publication No. (hereinafter referred to as JP-B-) 43-4936 and JP-B-53-12375, and JP-A's-52-110618, 52-109925 and 52-110618.

On the other hand, an emulsion having undergone a spectral sensitization realizing high red sensitivity effected by a combination of an onium salt and a cyanine dye is known as described in JP-A-61-43740. An advantageous addition amount of this onium salt is described as being in the range of 0.25 to 100 times the weight of cyanine dye. Actually, the onium salt is added in an equimolar or more amount relative to the mole of cyanine dye. When a large amount of sensitizing dye can be effectively functioned, the color sensitization effect by sensitizing dye is enhanced. However, as a result of investigations made in the present invention, it has become apparent that, in a system loaded with a large amount of sensitizing dye, the sensitivity increase effect is slight even if an equimolar or more amount of adsorptive onium salt is used in combination with a cyanine dye in emulsions. Thus, there is a demand for the development of a technology for exerting a high sensitivity increase effect despite small addition amounts.

Although the joint use of onium salts with photographic emulsions is known as apparent from the above, the effect of the combined use with (111) face silver bromide/silver iodobromide tabular grains, (100) face silver bromide/silver iodobromide tabular grains, (100) face grains of high silver chloride content, (111) face grains of high silver chloride content and epitaxial grains is still unknown.

BRIEF SUMMARY OF THE INVENTION

It is an object of the present invention to provide a high-speed silver halide photographic emulsion for photographing which is excellent in sensitivity/fog ratio.

It is another object of the present invention to provide a silver halide photographic lightsensitive material containing the silver halide photographic emulsion mentioned above.

It is yet another object of the present invention to provide a method of enhancing sensitivity of a photographic silver halide emulsion.

The inventor has conducted extensive and intensive studies. As a result, it has been found that means for enhancing a photographic sensitivity can be provided by effecting a short-wave shift of at least 2 nm with respect to the maximum absorption wavelength of sensitizing dye and by using the compound of general formula (1) according to the present invention.

That is, the task of the present invention has successfully been attained by the following silver halide photographic emulsion, silver halide photographic lightsensitive material containing the same and method of enhancing a sensitivity of lightsensitive silver halide emulsion:

(1) A lightsensitive silver halide photographic emulsion comprising silver halide grains; a sensitizing dye having a given maximum absorption wavelength; and an organic compound exhibiting no absorption in a visible light region, wherein the addition amount of the organic compound is in the range of 1 to 50 mol % based on the sensitizing dye, and a maximum absorption wavelength of the photographic emulsion exhibited by the sensitizing dye in the presence of the organic compound is at least 2 nm shorter than the given maximum absorption wavelength exhibited by the sensitizing dye in the absence of the organic compound.

(2) A lightsensitive silver halide photographic emulsion comprising silver halide grains and a sensitizing dye, wherein at least one compound represented by the following general formula (1) is contained in an amount of 1 to 50 mol % based on the sensitizing dye:

(1)

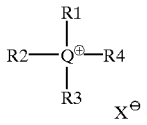

wherein Q represents a N or P atom; each of R1, R2, R3 and R4 represents an alkyl, an aryl or a heterocycle, provided that two of R1, R2, R3 and R4 may be bonded with each other to thereby form a saturated ring, or three of R1, R2, R3 and R4 may cooperate with each other to thereby form an unsaturated ring; and X represents an anion group, provided that X does not exist in the event of an intramolecular salt.

(3) The lightsensitive silver halide photographic emulsion recited in item (1) above, wherein the organic compound exhibiting no absorption in a visible light region is a compound represented by the above general formula (1).

(4) The lightsensitive silver halide photographic emulsion recited in any one of items (1) to (3) above, wherein 50% or more of the total projected area of the silver halide grains are occupied by tabular silver halide grains having (111) faces as parallel main planes, having an aspect ratio of 2 or more, having 10 or more dislocation lines per grain and having a siver halide composition of silver iodobromide or silver chloroiodobromide whose silver chloride content is less than 10 mol %.

(5) The lightsensitive silver halide photographic emulsion recited in any one of items (1) to (3) above, wherein 50% or more of the total projected area of the silver halide grains are occupied by tabular silver halide grains having (100) faces as parallel main planes, having an aspect ratio of 2 or more and having a silver halide composition of silver iodobromide or silver chloroiodobromide whose silver chloride content is less than 10 mol %.

(6) The lightsensitive silver halide photographic emulsion recited in any one of items (1) to (3) above, wherein 50% or more of the total projected area of the silver halide grains are occupied by tabular silver halide grains having (111) faces or (100) faces as parallel main planes, having an aspect ratio of 2 or more and containing silver chloride in an amount of at least 80 mol %.

(7) The lightsensitive silver halide photographic emulsion recited in any one of items (1) to (3) above, wherein 50% or more of the total projected area of the silver halide grains are occupied by tabular silver halide grains of silver iodobromide or silver chloroiodobromide having (111) faces as parallel main planes, being hexagonal grains wherein a ratio of length of maximum-length side to length of minimum-length side is 2 or less, having at least one epitaxial junction portion at an apex portion and/or a side face portion and/or a main plain portion of each hexagonal grain and having a silver halide composition of silver iodobromide or silver chloroiodobromide whose silver chloride content is less than 10 mol %.

(8) The lightsensitive silver halide photographic emulsion recited in any one of items (2) to (7) above, wherein the compound represented by the above general formula (1) is a compound represented by the following general formula (2):

(2)

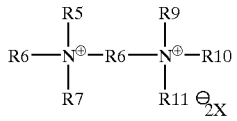

wherein each of R5, R6 and R7 represents an alkyl, an aryl or a heterocycle, provided that two of R5, R6 and R7 may cooperate with each other to thereby form a saturated ring, or three of R5, R6 and R7 may cooperate with each other to thereby form an unsaturated ring; R8 represents a group constituted by each or any combination of an alkylene group, an arylene group, —O—, —S— and —$CO_2$—, provided that each of —O—, —S— and —$CO_2$— is bonded so as to be adjacent to the alkylene group or the arylene group; each of R9, R10 and R11 have the same meaning as R5, R6 and R7; and X has the same meaning as X of the general formula (1).

(9) The lightsensitive silver halide photographic emulsion recited in any one of items (1) to (8) above, wherein the sensitizing dye rendered the silver halide grains red-sensitive.

(10) A silver halide photographic lightsensitive material comprising at least one lightsensitive silver halide emulsion layer on a support, wherein the lightsensitive silver halide emulsion layer comprises the lightsensitive silver halide photographic emulsion recited in any one of items (1) to (9) above.

(11) A method of enhancing a sensitivity of a lightsensitive silver halide emulsion comprising a sensitizing dye having a given maximum absorption wavelength, wherein the method comprises:

adding an organic compound exhibiting no absorption in a visible light region and capable of causing the maximum absorption wavelength of the sensitizing dye to shift toward a shorter wavelength by at least 2 nm.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

The lightsensitive silver halide photographic emulsion of the present invention contains a sensitizing dye and an organic compound exhibiting no absorption in a visible light region. Herein, the visible light region refers to a wavelength region of from 400 to 700 nm. The expression "organic compound exhibiting no absorption in a visible light region" used herein means that, when an absorption spectrum is produced with the use of, preferably, water or methanol as a solvent, there is no absorption maximum in the visible light region.

In the lightsensitive silver halide emulsion of the present invention, the loading of the organic compound exhibiting no absorption in a visible light region in combination with the sensitizing dye causes the maximum absorption wavelength of the sensitizing dye to shift towards a shorter wavelength by at least 2 nm as compared with that exhibited in the absence of the organic compound. A preferable upper limit of the wavelength shift is 20 nm. The wavelength shift is more preferably in the range of 2 to 10 nm.

The measuring of the wavelength shift value of a maximum absorption wavelength of a lightsensitive silver halide photographic emulsion can be effected on either of an absorption spectrum of a sensitizing dye in a liquid emulsion and an absorption spectrum of the sensitizing dye in a coated sample. When the shift value is 2 nm or more irrespective of which spectrum is employed, the requirements of the present invention are satisfied.

The general formula (1) and general formula (2) will now be described in detail. In the formulae, Q represents a N or P atom. Each of R1, R2, R3 and R4 preferably represents a substituted or unsubstituted alkyl having 1 to 20 carbon atoms (for example, methyl, butyl, hexyl, dodecyl, hydroxyethyl or trimethylammonioethyl, or an aryl substituted alkyl having 7 to 20 carbon atoms, such as benzyl, phenethyl or p-chlorobenzyl); a substituted or unsubstituted aryl having 6 to 20 carbon atoms (for example, phenyl or p-chlorophenyl); or a substituted or unsubstituted heterocycle (for example, thienyl, furyl, pyrrolyl, imidazolyl or pyridyl). Provided, however, that two of R1, R2, R3 and R4 may be bonded with each other to thereby form a saturated ring (for example, pyrrolidine ring, piperidine ring, piperazine ring or morpholine ring); or three of R1, R2, R3 and R4 may cooperate with each other to thereby form an unsaturated ring (for example, pyridine ring, imidazole ring, quinoline ring or isoquinoline ring). Examples of substituted alkyls represented by R1, R2, R3 and R4 include those having a quaternary ammonium salt, a quaternary pyridinium salt or a quaternary phosphonium salt as a substituent.

X represents an anion group, provided that X does not exist in the event of an intramolecular salt. X is, for example, a chloride ion, a bromide ion, an iodide ion, a nitrate ion, a sulfate ion, a p-toluenesulfonate ion or an oxalate ion.

Each of R5, R6 and R7 preferably represents a substituted or unsubstituted alkyl having 1 to 20 carbon atoms (for example, methyl, butyl, hexyl, dodecyl or hydroxyethyl, or an aryl substituted alkyl having 7 to 20 carbon atoms, such as benzyl, phenethyl or p-chlorobenzyl); a substituted or unsubstituted aryl having 6 to 20 carbon atoms (for example, phenyl or p-chlorophenyl); or a substituted or unsubstituted heterocycle (for example, thienyl, furyl, pyrrolyl, imidazolyl or pyridyl). Provided, however, that two of R5, R6 and R7 may be bonded with each other to thereby form a saturated ring (for example, pyrrolidine ring, piperidine ring, piperazine ring or morpholine ring); or R5, R6 and R7 may cooperate with each other to thereby form an unsaturated ring (for example, pyridine ring, imidazole ring, quinoline ring or isoquinoline ring).

R8 represents a group constituted by each or any combination of alkylene, arylene, —O—, —S— and —$CO_2$—, provided that each of —O—, —S— and —$CO_2$— is bonded so as to be adjacent to alkylene or arylene. The alkylene may be substituted with, for example, a hydroxyl group as a substituent. The alkylene preferably has 1 to 10 carbon atoms, and can be any of, for example, trimethylene, pentamethylene, heptamethylene, nonamethylene, —$CH_2CH_2OCH_2CH_2$—, —$(CH_2CH_2O)_2$—$CH_2CH_2$—, —$(CH_2CH_2O)_3$—$CH_2CH_2$—, —$(CH_2CH_2S)_3$—$CH_2CH_2$— and —$CH_2CH_2COOCH_2CH_2OCOCH_2CH_2$—.

R9, R10 and R11 have the same meaning as R5, R6 and R7.

The compound of general formula (1) according to the present invention is preferably the compound of general formula (2).

The compound of general formula (1) or general formula (2) according to the present invention is preferably dissolved in a water-soluble solvent such as any of water, methanol and ethanol or a mixed solvent thereof before the addition to the emulsion.

The timing of addition of the compound of general formula (1) or general formula (2) according to the present invention may be before or after the addition of the sensitizing dye. Preferred addition amounts thereof are such that the compound is contained in the silver halide emulsion in an amount of 1 to 50 mol %, more preferably 2 to 25 mol %, based on the sensitizing dye. These addition amounts are preferred from the viewpoint that, when the addition amount of the compound of general formula (1) or general formula (2) for use in the present invention is greater than the above, the amount of sensitizing dye which can be adsorbed on emulsion grains is occasionally unfavorably reduced.

The compound of general formula (1) or general formula (2) according to the present invention can be easily synthesized by the same synthetic process as described in Quart. Rev., 16, 163 (1962).

Representative examples of the compounds of general formula (1) and general formula (2) which can be used in the present invention will be set forth below, to which, however, the present invention is in no way limited.

I-1

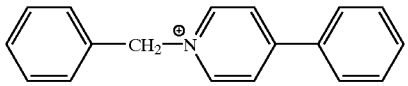

$Br^{\ominus}$

I-2

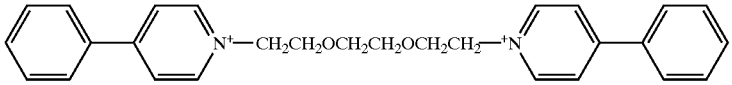

$2Cl^{\ominus}$

I-3

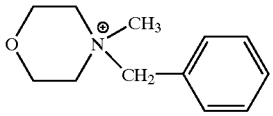

$Br^{\ominus}$

I-4

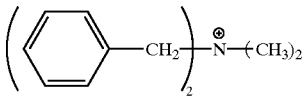

$Cl^{\ominus}$

I-5

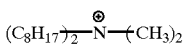

$Cl^{\ominus}$

I-6

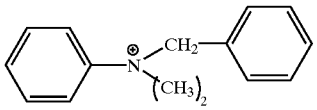

$Cl^{\ominus}$

I-7

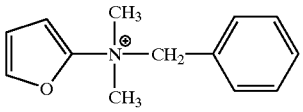

$Br^{\ominus}$

I-8

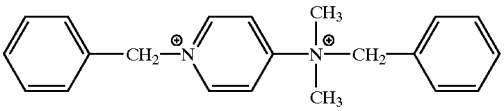

$2Br^{\ominus}$

I-9

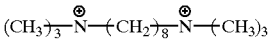

$2Br^{\ominus}$

I-10

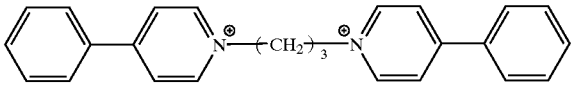

$2Br^{\ominus}$

I-11

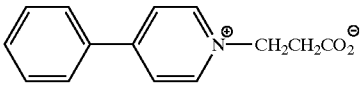

I-12

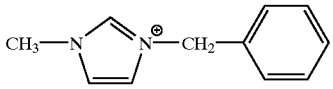

$Cl^{\ominus}$

-continued

I-13

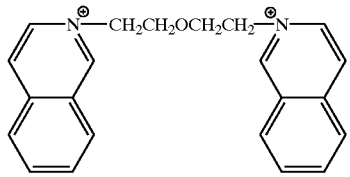

$2Cl^{\ominus}$

I-14

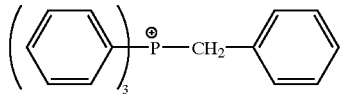

$Br^{\ominus}$

I-15

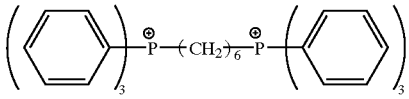

$2Cl^{\ominus}$

I-16

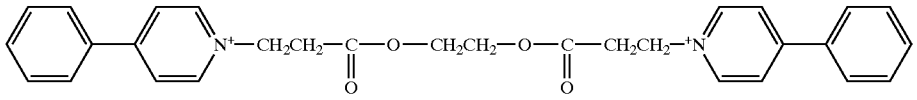

$2Cl^{\ominus}$

I-17

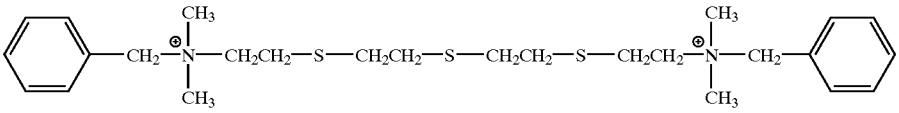

$2Br^{\ominus}$

I-18

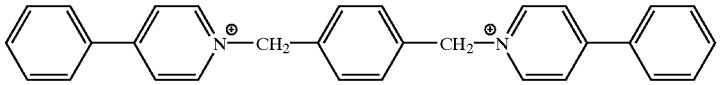

$2Cl^{\ominus}$

In a first aspect of the invention, the silver halide emulsion of the present invention are occupied by tabular silver halide grains of silver iodobromide or silver chloroiodobromide having (111) faces as parallel main planes, having an aspect ratio of 2 or more, having 10 or more dislocation lines per grain and having a silver chloride content of less than 10 mol % in an amount of 50% or more of the total projected area of all the silver halide grains. This emulsion will be described below.

This emulsion has (111) main plane surfaces opposite to each other and side faces connecting the main planes. The tabular grain emulsion is constituted of silver iodobromide or silver chloroiodobromide. Silver chloride may be contained in the emulsion. The silver chloride content is preferably 8 mol % or less, and more preferably 3 mol % or less, or 0 mol %. With respect to the silver iodide content, because the variation coefficient of distribution of grain size of tabular grain emulsion is preferably 25% or less, it is preferred that the silver iodide content be 20 mol % or less. Lowering the silver iodide content facilitates reducing the variation coefficient of distribution of grain size of tabular grain emulsion. In particular, it is preferred that the variation coefficient of distribution of grain size of tabular grain emulsion be 20% or less, and that the silver iodide content be 10 mol % or less.

Despite the silver iodide content, the variation coefficient of intergranular distribution of silver iodide content is preferably 20% or less, more preferably 10% or less.

It is preferred that each tabular grain has an intragranular structure with regard to silver iodide. The silver iodide distribution can have a double structure, a treble structure, a quadruple structure or a structure of higher order.

50% or more of the total projected area is occupied by grains having an aspect ratio of 2 or more. The projected area and aspect ratio of tabular grains can be measured from an electron micrograph obtained by the carbon replica method in which the tabular grains together with reference latex spheres are shadowed. The tabular grains, as viewed from the top side of the tabular grains, generally have the shape of a hexagon, a triangle or a circle. Herein, the aspect ratio refers to the quotient of the diameter of a circle with an area equal to the projected area divided by the grain thickness. With respect to the configuration of tabular grains, it is preferred that the ratio of hexagonal shape to all grain shapes be high. In the tabular grains of hexagonal shape, it is preferred that the ratio of neighboring-side lengths be 1:2 or less.

The higher the aspect ratio, the more conspicuous the realized effect. Accordingly, it is preferred that 50% or more of the total projected area of tabular grain emulsion be occupied by grains having an aspect ratio of 5 or more. The aspect ratio is more preferably 8 or more. When the aspect ratio is extremely high, the aforementioned variation coefficient of grain size distribution tends to be unfavorably large. Therefore, it is generally preferred that the aspect ratio do not exceed 50.

The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 3, 5, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the main planes.

The number of dislocation lines of the tabular grains according to the present invention is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof. There are instances when hundreds of dislocation lines are observed.

Dislocation lines can be introduced in, for example, the vicinity of the periphery of tabular grains. In this instance, the dislocation is nearly perpendicular to the periphery, and each dislocation line extends from a position corresponding to x % of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel main planes of tabular grains. In the case where dislocation lines are formed over the entire regions of the main planes, the dislocation lines may crystallographically be oriented approximately in the (211) direction when viewed in the direction perpendicular to the main planes, and the formation of the dislocation lines may be effected either in the (110) direction or randomly. Further, the length of each dislocation line may be random, and the dislocation lines may be observed as short lines on the main planes or as long lines extending to the side (periphery). The dislocation lines may be straight or often meander. In many instances, the dislocation lines cross each other.

The position of dislocation lines may be localized on the periphery, main planes or local points as mentioned above, or the formation of dislocation lines may be effected on a combination thereof. That is, dislocation lines may be concurrently present on both the periphery and the main planes. Dislocation lines are introduced into silver bromide, silver chlorobromide, silver chloroiodobromide or silver iodobromide tabular grains by adding a sparingly soluble silver halide emulsion. The sparingly soluble silver halide emulsion herein means that with regard to the silver halide composition, the emulsion is sparingly soluble compared with the tabular grains to which the sparingly soluble emulsion is added. The sparingly soluble emulsion is preferably a silver iodide fine grain emulsion.

The silver iodide content on the grain surface of a tabular grain emulsion of the present invention is preferably 10 mol % or less, and particularly preferably, 5 mol % or less. The silver iodide content on the grain surface of the present invention is measured by using XPS (X-ray Photoelectron Spectroscopy). The principle of XPS used in an analysis of the silver iodide content near the surface of a silver halide grain is described in Junnich Aihara et al., "Spectra of Electrons" (Kyoritsu Library 16: issued Showa 53 by Kyoritsu Shuppan). A standard measurement method of XPS is to use Mg-K$\alpha$ as excitation X-rays and measure the intensities of photoelectrons (usually I-3d5/2 and Ag-3d5/2) of iodine (I) and silver (Ag) released from silver halide grains in an appropriate sample form. The content of iodine can be calculated from a calibration curve of the photoelectron intensity ratio (intensity (I)/intensity (Ag)) of iodine (I) to silver (Ag) formed by using several different standard samples having known iodine contents. XPS measurement for a silver halide emulsion must be performed after gelatin adsorbed by the surface of a silver halide grain is decomposed and removed by, e.g., proteinase. A tabular grain emulsion in which the silver iodide content on the grain surface is 10 mol % or less is an emulsion whose silver iodide content is 10 mol % or less when the emulsion grains are analyzed by XPS. If obviously two or more types of emulsions are mixed, appropriate preprocessing such as centrifugal separation or filtration must be performed before one type of emulsion is analyzed.

The advantage of the present invention is noticeable when the grain surface of a tabular grain emulsion of the present invention contains 10 mol % or less of silver iodide. More preferably, the silver iodide content on the grain surface is 1 to 5 mol %. The structure of a tabular grain emulsion of the present invention is preferably a triple structure of silver bromide/silver iodobromide/silver bromide or a higher-order structure. The boundary of silver iodide content between structures can be either a clear boundary or a continuously gradually changing boundary. Commonly, when measured by using a powder X-ray diffraction method, the silver iodide content does not show any two distinct peaks; it shows an X-ray diffraction profile whose tail extends in the direction of high silver iodide content.

In the present invention, the silver iodide content in a layer inside the surface is preferably higher than that on the surface; the silver iodide content in a layer inside the surface is preferably 5 mol % or more, and more preferably, 7 mol % or more. Although the upper limit of a layer inside the surface is not particularly limited the upper limit thereof is preferably 20.

In a second aspect of the invention, the silver halide emulsion of the present invention are occupied by tabular silver halide grains of silver iodobromide or silver chloroiodobromide having (100) faces as parallel main planes, having an aspect ratio of 2 or more and having a silver chloride content of less than 10 mol % (hereinafter also referred to as "(100) tabular grains of the present invention") in an amount of 50% or more of the total projected area of all the silver halide grains. This emulsion will be described below.

With respect to the (100) tabular grains of the present invention, 50 to 100%, preferably 70 to 100%, and more preferably 90 to 100%, of the total projected area is occupied by tabular grains having (100) faces as main planes and having an aspect ratio of 2 or more. The grain thickness is preferably in the range of 0.01 to 0.10 $\mu$m, more preferably 0.02 to 0.08 $\mu$m, and most preferably 0.03 to 0.07 $\mu$m. The aspect ratio is preferably in the range of 2 to 100, more preferably 3 to 50, and most preferably 5 to 30. The variation coefficient of grain thickness (percentage of "standard deviation of distribution/average grain thickness", hereinafter referred to as "COV") is preferably 30% or less, more preferably 25% or less, and most preferably 20% or less. The smaller this COV, the higher the monodispersity of grain thickness.

In the measuring the equivalent circle diameter and thickness of tabular grains, a transmission electron micrograph (TEM) thereof is taken according to the replica method, and the equivalent circle diameter and thickness of each individual grain are measured. In this method, the thickness of tabular grains is calculated from the length of shadow of the replica. In the present invention, the COV is determined as a result of measuring at least 600 grains.

The silver halide composition of the (100) tabular grains of the present invention is silver iodobromide or silver chloroiodobromide having a silver chloride content of less than 10 mol %. Furthermore, other silver salts, such as silver rhodanate, silver sulfide, silver selenide, silver telluride, silver carbonate, silver phosphate and an organic acid salt of silver, may be contained in the form of other separate grains or as parts of silver halide grains.

The X-ray diffraction method is known as means for investigating the halogen composition of AgX crystals. The X-ray diffraction method is described in detail in, for example, Kiso Bunseki Kagaku Koza 24 (Fundamental Analytical Chemistry Course 24) "X-sen Kaisetu (X-ray Diffraction)". In the standard method, K$\beta$ radiation of Cu is used as a radiation source, and the diffraction angle of AgX (420) face is determined by the powder method.

When the diffraction angle $2\theta$ is determined, the lattice constant (a) can be determined by Bragg's equation as follows:

$$2d \sin \theta = \lambda$$

$$d = a/(h^2+k^2+l^2)^{1/2},$$

wherein $2\theta$ represents the diffraction angle of (hkl) face; $\lambda$ represents the wavelength of X rays; and d represents the spacing of (hkl) faces. Because, with respect to silver halide solid solutions, the relationship between the lattice constant (a) and the halogen composition is known (described in, for example, T. H. James "The Theory of the Photographic Process, 4th ed.", Macmillian, N.Y.), determination of the lattice constant leads to determination of the halogen composition.

The halogen composition structure of (100) tabular grains according to the present invention is not limited. Examples thereof include grains having a core/shell double structure wherein the halogen compositions of the core and the shell are different from each other and grains having a multiple structure composed of a core and two or more shells. The core is preferably constituted of silver bromide, to which, however, the core of the present invention is not limited. With respect to the composition of the shell, it is preferred that the silver iodide content be higher therein than in the core.

It is preferred that the (100) tabular grains of the present invention have an average silver iodide content of 2.3 mol % or more and an average silver iodide content, at the surface of grains, of 8 mol % or more. With respect to the (100) tabular grains of the present invention, preferably, the upper limit of average silver iodide content is 20 mol % and the upper limit of average surface silver iodide content is also 20 mol %. The intergranular variation coefficient of silver iodide content is preferably less than 20%.

The surface silver iodide content, can be measured by known surface elemental analysis means. Effective examples thereof include XPS (X-ray photoelectric spectroscopy), ISS (low-speed ion scattering spectroscopy), EPMA (electron beam probe microanalyzer method) and EDX. With respect to the principles of XPS, ISS, EPMA and EDX, reference can be made to Chapter 4 of Shogo Nakamura, "Hyomen no Butsuri (Physics of Surface)", KyoRitsu Shuppan Co., Ltd., 1982 and Junichi Aihara, "Denshi no Bunko (Spectroscopy of Electron)", KyoRitsu Shuppan Co., Ltd., 1978.

The simplest means for measuring the surface silver iodide content with high accuracy is XPS. EPMA is suitable for the measuring of the distribution of silver iodide content of each individual AgX grain. The surface silver iodide content distribution of each individual grain can be measured by the use of an analytical device comprising a transmission electron microscope coupled with EDX, known as an analytical electron microscope. In the present invention, the surface silver iodide content refers to that measured by XPS, and the silver iodide content distribution of each individual AgX grain refers to that measured by EPMA.

The (100) tabular grains of the present invention can be classified by shape into the following six types of grains. (1) Grains whose main plane shape is a right-angled parallelogram. (2) Grains whose main plane shape is a right-angled parallelogram having one or more, preferably 1 to 4 corners selected from four corners of which are non-equivalently deleted, namely, grains whose K1=(area of maximum deletion)/(area of minimum deletion) is 2 to $\infty$. (3) Grains whose main plane shape is a right-angled parallelogram having four corners of which are equivalently deleted (grains whose K1 is smaller than 2). (4) Grains whose 5 to 100%, preferably 20 to 100% of the side of faces in the deletions one (111) faces. (5) Grains having main planes each with four sides, of which at least two sides opposite to each other are outward protrudent curves. (6) Grains whose main plane shape is a right-angled parallelogram having one or more, preferably 1 to 4 corners selected from four corners of which are deleted in the shape of a right-angled parallelogram. These features of the grains can be identified by observation through an electron microscope.

With respect to the (100) tabular grains of the present invention, the ratio of (100) faces to surface crystal habits is 80% or more, preferably 90% or more. A statistical estimation of the ratio can be performed by the use of an electron micrograph of grains. When the (100) tabular face ratio of AgX grains of an emulsion is nearly 100%, the above estimate can be ascertained by the following method. The method is described in Journal of the Chemical Society of Japan, 1984 No.6, page 942, which comprises causing a given amount of (100) tabular grains to adsorb varied amounts of benzothiacyanine dye at 40° C. for 17 hr, determining the sum total (S) of surface areas of all grains and the sum total (S1) of areas of (100) faces per unit emulsion from light absorption at 625 nm, and calculating the (100) face ratio by applying these sum total values to the formula: (S1/S)×100 (%).

The (100) tabular grains of the present invention preferably contains substantially no dislocation. The absence of dislocation can be ascertained by grain observation through a transmission electron microscope (TEM). The expression "containing substantially no dislocation" used herein means that (1) a dislocation line which extends on a projected face from one corner or edge to another corner or edge thereof so as to divide the projected face into two parts is not contained; (2) two to four dislocation lines crossing each other so as to divide the projected face into two to four parts are not observed; and (3) dislocation lines (1) or (2) above which are vanished in part, less than 50% of the length of dislocation lines, are not observed. It is preferred that not only the above dislocations but also any other dislocations be not observed at all. With respect to the (100) tabular grains of the present invention, no dislocation is ascertained in 50% or more, preferably 70% or more, and more preferably 90% or more, of all the tabular grains.

With respect to the (100) tabular grains of the present invention, preferably, 50% or more of all the tabular grains have main planes of roughened configuration. The roughened configuration refers to a surface with terrace-shaped unevenness. The protrudent portions have a thickness of 20 nm or less from the surface. For example, the protrudent portion configuration can be the shape of a pyramid surrounded by (111) faces, or a trapezoid like a pyramid whose apex portion is flattened by (100) face, to which, however, the protrudent portion configuration of the present invention is in no way limited. A plurality of independent terraces may be contained therein. In that instance, the grain thickness is calculated from the average shadow length by the replica method.

The average equivalent sphere diameter of the (100) tabular grains of the present invention is preferably less than 0.35 $\mu$m. An estimate of grain size can be obtained by measuring the projected area and thickness according to the replica method.

An electron-trapping zone is preferably introduced in the (100) tabular grains of the present invention by doping with polyvalent metal ions during the grain formation. Examples of the polyvalent metal ions include $Fe^{2+}$, $Fe^{3+}$, $Ru^{2+}$, $Os^{2+}$, $Co^{3+}$, $Rh^{3+}$, $Ir^{3+}$, $Cr^{2+}$, $Cd^{2+}$, $Pb^{2+}$, $Pd^{2+}$ and $Pd^{4+}$. The electron-trapping zone refers to a portion wherein the polyvalent metal ion content is in the range of $1\times10^{-5}$ to $1\times10^{-3}$ mol/mol localized silver and which occupies 5 to 30% of the grain volume. It is preferred that the polyvalent metal ion content be in the range of $5\times10^{-5}$ to $5\times10^{-4}$ mol/mol localized silver. The terminology "mol/mol localized silver" employed in specifying the polyvalent metal ion content means the concentration of polyvalent metal ions relative to the silver quantity (mol) added simultaneously with polyvalent metal ions.

In the electron-trapping zone, it is requisite that the polyvalent metal ion content be uniform. The expression "being uniform" means that the introduction of polyvalent metal ions in grains is carried out at a fixed proportion per unit silver quantity and that polyvalent metal ions are introduced in a reaction vessel for grain formation simultaneously with the addition of silver nitrate for grain formation. A halide solution may also be added at the same time. A compound containing polyvalent metal ions according to the present invention may be added in the form of an aqueous solution, or fine grains doped with or adsorbing a compound convertible to polyvalent metal ions may be prepared and added.

The electron-trapping zone may be present at any internal part of grains. Two or more electron-trapping zones may be present in each grain.

In a third aspect of the invention, the silver halide emulsion of the present invention are occupied by tabular silver halide grains having (111) faces or (100) faces as parallel main planes, having an aspect ratio of 2 or more and containing silver chloride in an amount of at least 80 mol %, in an amount of 50% or more of all the silver halide grains. This emulsion will be described below.

Special measures must be implemented for producing (111) grains of high silver chloride content. Use may be made of the method of producing tabular grains of high silver chloride content with the use of ammonia as described in U.S. Pat. No. 4,399,215 to Wey. Also, use may be made of the method of producing tabular grains of high silver chloride content with the use of a thiocyanate as described in U.S. Pat. No. 5,061,617 to Maskasky. Further, use may be made of the following methods of incorporating additives (crystal habit-controlling agents) at the time of grain formation in order to form grains of high silver chloride content having (111) faces as external surfaces:

| Patent No. | crystal habit-controlling agent | Inventor |
|---|---|---|
| U.S. Pat. No. 4,400,463 | azaindene + thioether peptizer | Makasky |
| U.S. Pat. No. 4,783,398 | 2,4-dithiazolidinone | Mifune et al. |
| U.S. Pat. No. 4,713,323 | aminopyrazolopyrimidine | Maskasky |
| U.S. Pat. No. 4,983,508 | bispyridinium salt | Ishiguro et al. |
| U.S. Pat. No. 5,185,239 | triaminopyrimidine | Maskasky |
| U.S. Pat. No. 5,178,997 | 7-azaindole compound | Maskasky |
| U.S. Pat. No. 5,178,998 | xanthine | Maskasky |
| JP-A-64-70741 | dye | Nishikawa et al. |
| JP-A-3-212639 | aminothioether | Ishiguro |
| JP-A-4-283742 | thiourea derivative | Ishiguro |
| JP-A-4-335632 | triazolium salt | Ishiguro |
| JP-A-2-32 | bispyridinium salt | Ishiguro et al. |
| JP-A-8-227117 | monopyridinium salt | Ozeki et al. |

With respect to the formation of (111) tabular grains, although various methods of using crystal habit-controlling agents are known as listed in the above table, the compounds (compound examples 1 to 42) described in JP-A-2-32 are preferred, and the crystal habit-controlling agents 1 to 29 described in JP-A-8-227117 are especially preferred. However, the present invention is in no way limited to these.

The (111) tabular grains are obtained by forming two parallel twinned crystal faces. The formation of such twin faces is influenced by the temperature, dispersion medium (gelatin), halide concentration, etc., so that appropriate conditions must be set on these. In the presence of a crystal habit-controlling agent at the time of nucleation, the gelatin concentration is preferably in the range of 0.1 to 10%. The chloride concentration is 0.01 mol/liter or more, preferably 0.03 mol/liter (liter hereinafter referred to as "L") or more.

JP-A-8-184931 discloses that, for monodispersing grains, it is preferred not to use any crystal habit-controlling agent at the time of nucleation. When no crystal habit-controlling agent is used at the time of nucleation, the gelatin concentration is in the range of 0.03 to 10%, preferably 0.05 to 1.0%. The chloride concentration is in the range of 0.001 to 1 mol/L, preferably 0.003 to 0.1 mol/L. The nucleation temperature, although can arbitrarily be selected as long as it is in the range of 2 to 90° C., is preferably in the range of 5 to 80° C., more preferably 5 to 40° C.

Nuclei of tabular grains are formed at the initial stage of nucleation. However, a multiplicity of non-tabular grain nuclei are contained in the reaction vessel immediately after the nucleation. Therefore, such a technology that, after the nucleation, ripening is carried out to thereby cause only tabular grains to remain while other grains are eliminated is required. When the customary Ostwald ripening is performed, nuclei of tabular grains are also dissolved and eliminated, so that the number of nuclei of tabular grains is reduced with the result that the size of obtained tabular grains is increased. In order to prevent this, a crystal habit-controlling agent is added. In particular, the simultaneous use of gelatin phthalate enables increasing the effect of the crystal habit-controlling agent and thus enables preventing the dissolution of tabular grains. The pAg during the ripening is especially important, and is preferably in the range of 60 to 130 mV with silver/silver chloride electrodes.

The thus formed nuclei are subjected to physical ripening and are grown in the presence of a crystal habit-controlling agent by adding a silver salt and a halide thereto. In the system, the chloride concentration is 5 mol/L or less, preferably in the range of 0.05 to 1 mol/L. The temperature for grain growth, although can be selected from among 10 to 90° C., is preferably in the range of 30 to 80° C.

The total addition amount of crystal habit-controlling agent is preferably $6\times10^{-5}$ mol or more, more preferably in the range of $3\times10^{-4}$ to $6\times10^{-2}$ mol, per mol of silver halides of completed emulsion. The timing of addition of the crystal habit-controlling agent can be at any stage from the silver halide grain nucleation to physical ripening and during the grain growth. After the addition, the formation of (111) faces is started. Although the crystal habit-controlling agent may be placed in the reaction vessel in advance, in the formation of tabular grains of small size, it is preferred that the crystal habit-controlling agent be placed in the reaction vessel simultaneously with the grain growth so that the concentration thereof is increased.

When the amount of dispersion medium used at nucleation is short in growth, it is needed to compensate for the same by an addition. It is preferred that 10 to 100 g/L of gelatin be present for growth. The compensatory gelatin is preferably gelatin phthalate or gelatin trimellitate.

The pH at grain formation, although arbitrary, is preferably in the neutral to acid region.

Now, the (100) tabular grains will be described. The (100) tabular grains are tabular grains having (100) faces as main planes. The shape of these main planes is, for example, a right-angled parallelogram, or a tri- to pentagon corresponding to a right-angled parallelogram having one corner selected from the four corners of which has been deleted (deletion having the shape of a right-angled triangle composed of the corner apex and sides making the corner), or a tetra- to octagon corresponding to a right-angled parallelogram having two to four corners selected from the four corners of which have been deleted.

When a right-angled parallelogram having been compensated for the deletions is referred to as a compensated tetragon, the neighboring side ratio (length of long side/length of short side) of the right-angled parallelogram or compensated tetragon is in the range of 1 to 6, preferably 1 to 4, and more preferably 1 to 2.

The formation of tabular silver halide emulsion grains having (100) main planes is performed by adding an aqueous solution of silver salt and an aqueous solution of halide to a dispersion medium such as an aqueous solution of gelatin under agitation and mixing them together. For example, JP-A's-6-301129, 6-347929, 9-34045 and 9-96881 disclose such a method that, at the formation, making silver iodide or iodide ions, or silver bromide or bromide ions, exist to thereby produce strain in nuclei due to a difference in size of crystal lattice from silver chloride so that a crystal defect imparting anisotropic growability, such as spiral dislocation, is introduced. When the spiral dislocation is introduced, the formation of two-dimensional nuclei at the surface is not rate-determining under low supersaturation conditions with the result that the crystallization at the surface is advanced. Thus, the introduction of spiral dislocation leads to the formation of tabular grains. Herein, the low supersaturation conditions preferably refer to 35% or less, more preferably 2 to 20%, of the critical addition. Although the crystal defect has not been ascertained as being a spiral dislocation, it is contemplated that the possibility of spiral dislocation is high from the viewpoint of the direction of dislocation introduction and the impartation of anisotropic growability to grains. It is disclosed in JP-A's-8-122954 and 9-189977 that, for reducing the thickness of tabular grains, retention of the introduced dislocation is preferred.

Moreover, the method of forming the (100) tabular grains by adding a (100) face formation accelerator is disclosed in JP-A-6-347928, in which use is made of imidazoles and 3,5-diaminotriazoles, and JP-A-8-339044, in which use is made of polyvinyl alcohols. However, the present invention is in no way limited thereto.

Although the grains of high silver chloride content refer to those having a silver chloride content of 80 mol % or more, it is preferred that 95 mol % or more thereof consist of silver chloride. The grains of the present invention preferably have a so-termed core/shell structure consisting of a core portion and a shell portion surrounding the core portion. Preferably, 90 mol % or more of the core portion consists of silver chloride. The core portion may further consist of two or more portions whose halogen compositions are different from each other. The volume of the shell portion is preferably 50% or less, more preferably 20% or less, of the total grain volume. The silver halide composition of the shell portion is preferably silver iodochloride or silver iodobromochloride. The shell portion preferably contains 0.5 to 13 mol %, more preferably 1 to 13 mol %, of iodide. The silver iodide content of a whole grain is preferably 5 mol % or less, more preferably 1 mol % or less.

Also, it is preferred that the silver bromide content be higher in the shell portion than in the core portion. The silver bromide content of a whole grain is preferably 20 mol % or less, more preferably 5 mol % or less.

The average grain size (equivalent sphere diameter in terms of volume) of silver halide grains, although not particularly limited, is preferably in the range of 0.1 to 0.8 $\mu$m, more preferably 0.1 to 0.6 $\mu$m.

The tabular grains of silver halides preferably have an equivalent circle diameter of 0.2 to 1.0 $\mu$m. Herein, the diameter of silver halide grains refers to the diameter of a circle having the same area as the projected area of each individual grain in an electron micrograph. The thickness of silver halide grains is preferably 0.2 $\mu$m or less, more preferably 0.1 $\mu$m or less, and most preferably 0.06 $\mu$m or less. In the present invention, 50% or more, in terms of a ratio to total projected area of all the grains, are occupied by silver halide grains having an aspect ratio (ratio of grain diameter/thickness) of 2 or more, preferably ranging from 5 to 20.

Generally, the tabular grains are of a tabular shape having two parallel surfaces. Therefore, the "thickness" of the present invention is expressed by the spacing of two parallel surfaces constituting the tabular grains.

The grain size distribution of silver halide grains of the present invention, although may be polydisperse or monodisperse, is preferably monodisperse. In particular, the variation coefficient of equivalent circle diameter of tabular grains occupying 50% or more of the total projected area is preferably 20% or less, ideally 0%.

When the crystal habit-controlling agent is present on the grain surface after the grain formation, it exerts influence on the adsorption of sensitizing dye and the development. Therefore, it is preferred to remove the crystal habit-controlling agent after the grain formation. However, when the crystal habit-controlling agent is removed, it is difficult for the (111) tabular grains of high silver chloride content to maintain the (111) faces under ordinary conditions. Therefore, it is preferable to retain the grain configuration by substitution with a photographically useful compound such as a sensitizing dye. This method is described in, for example, JP-A's-9-80656 and 9-106026, and U.S. Pat. Nos. 5,221,602, 5,286,452, 5,298,387, 5,298,388 and 5,176,992.

The crystal habit-controlling agent is desorbed from grains by the above method. The desorbed crystal habit-controlling agent is preferably removed out of the emulsion by washing. The washing can be performed at such temperatures that the gelatin generally used as a protective colloid is not solidified. For the washing, use can be made of various known techniques such as the flocculation method and the ultrafiltration method. The washing temperature is preferably 40° C. or higher.

The desorption of the crystal habit-controlling agent from grains is accelerated at low pH values. Therefore, the pH of the washing step is preferably lowered as far as excess aggregation of grains does not occur.

In the silver halide grains, use can be made of ions or complex ions of a metal selected from among metals of Group VIII of the periodic table, namely, osmium, iridium, rhodium, platinum, ruthenium, palladium, cobalt, nickel and iron either individually or in combination. Further, use can be made of a plurality of metals selected from among the above metals.

Compounds capable of providing the above metal ions can be incorporated in the silver halide grains of the present invention by various methods, for example, the method of adding such compounds to an aqueous solution of gelatin as a dispersion medium, an aqueous solution of halide, an aqueous solution of silver salt or other aqueous solutions at the time of formation of silver halide grains, or the method of adding such metal ions to the silver halide emulsion in the form of silver halide fine grains loaded with metal ions in advance and thereafter dissolving the emulsion. The incorporation of metal ions in the grains can be effected before, during or immediately after the grain formation. The incorporation timing can be varied depending on the position of grains where metal ions are incorporated and the amount of the metal ions.

It is preferred that 50 mol % or more, preferably 80 mol % or more, and more preferably 100 mol %, of the employed metal ion-providing compound be localized in a surface layer of silver halide grains which corresponds to 50% or less of the grain volume extending from the silver halide grain surface. The volume of the surface layer is preferably 30% or less of the grain volume. The localization of metal ions in the surface layer is advantageous for realizing high sensitivity while suppressing the increase of internal sensitivity. The concentrating of the metal ion-providing compound in the surface layer of silver halide grains can be accomplished by, for example, first forming silver halide grains (core), to which no surface layer is formed and thereafter adding a solution of water-soluble silver salt and an aqueous solution of halide for forming a surface layer while, simultaneously with the addition, feeding the metal ion-providing compound.

Various polyvalent metal ion impurities, other than the Group VIII metals, can be introduced in the silver halide emulsion in the emulsion grain formation or physical ripening step. The addition amount of compounds as polyvalent metal ion impurities, although widely varied depending on the purpose, is preferably in the range of $10^{-9}$ to $10^{-2}$ mol per mol of silver halides.

In a fourth aspect of the invention, the silver halide emulsion comprises tabular silver halide grains each having parallel main planes of (111) faces, being hexagonal grain whose ratio of length of the longest side to the shortest side is 2 or less, being epitaxial grains that have at least one epitaxial junction at a corner portion of the hexagonal silver halide grain and/or a side face portion and/or main plane portion, and having silver halide composition of silver iodobromide or silver chloroiodobromide whose iodide content is less than 10 mol %. Such an emulsion will be described below.

These tabular grains have one twin face or two or more mutually parallel twin faces. The twin face refers to the (111) face on both sides of which the ions of all the lattice points are in the relationship of reflected images.

These tabular grains, as viewed from a position perpendicular to main planes thereof, have an approximately hexagonal shape. Herein, the approximately hexagonal shape comprehends triangular and hexagonal shapes and also circular shapes corresponding to rounded triangular and hexagonal shapes. The tabular grains have mutually parallel external surfaces. With respect to the circular shapes corresponding to rounded triangular and hexagonal shapes, when linear sides can be identified, whether or not they can be comprehended in the present invention can be judged on the basis of a hexagon produced by extending such linear sides.

This emulsion is occupied by hexagonal tabular grains each having a ratio of length of the longest side to the shortest side of 2 or less in an amount of 50% or more of the total projected area of all the grains contained in the emulsion. The lower limit of the ratio of length is of course 1. Preferably, the emulsion is occupied by hexagonal tabular grains each having the ratio of length of the longest side to the shortest side of 2 or less in an amount of 90% or more of the total projected area of all the grains contained in the emulsion. More preferably, the emulsion is occupied by hexagonal tabular grains each having the ratio of length of the longest side to the shortest side in a range of 1.5 to 1 in an amount of 90% or more of the total projected area of all the grains contained in the emulsion. When tabular grains other than the above mentioned hexagonal tabular grains having the ratio of length of the longest side to the shortest side in a range of 1 to 2, are mixed in an amount of more than 50% of the total projected area, it becomes difficult to manufacture the epitaxial tabular grains, and problems regarding preservability and dependency on processing condition cannot be solved.

In this emulsion, preferably, the variation coefficient of equivalent circle diameter of all the grains is 30% or less.

It is preferred that the emulsion of the present invention be monodisperse. The variation coefficient of equivalent circle diameter of the projected area of all the silver halide grains for use in the present invention is preferably 30% or less, more preferably 25% or less, and most preferably 20% or less. Herein, the variation coefficient of equivalent circle diameter refers to the quotient of the standard deviation of distribution of equivalent circle diameter of each individual silver halide grain divided by an average equivalent circle diameter. When the monodispersity is deteriorated, epitaxial deposition becomes nonuniform among grains with the result that the preparation of epitaxial tabular grains of the present invention becomes difficult.

The equivalent circle diameter of tabular grains is determined by, for example, taking a transmission electron micrograph according to the replica method and measuring the diameter of a circle having the same area as the projected area of each individual grain (equivalent circle diameter) in the transmission electron micrograph. The thickness of tabular grains cannot be simply calculated from the length of the shadow of the replica because of the epitaxial deposition. However, the calculation can be made by measuring the length of the shadow of the replica before the epitaxial deposition. Alternatively, even after the epitaxial deposition, the thickness of tabular grains can be easily determined by slicing a tabular grain coating sample to thereby obtain a section and taking an electron micrograph of the section.

With respect to the tabular grains, preferably, 50% or more of the total projected area is occupied by grains having an equivalent circle diameter of 0.6 μm or more and a thickness of 0.2 μm or less. Also, preferably, 70% or more of the total projected area is occupied by grains having an equivalent circle diameter of 10 μm or less and a thickness of 0.01 μm or more. More preferably, 70% or more of the total projected area is occupied by grains having an equivalent circle diameter of 1.0 μm or more and a thickness of 0.1 μm or less. Most preferably, 90% or more of the total projected area is occupied by grains having an equivalent circle diameter of 1.5 μm or more and a thickness of 0.1 μm or less. The larger the equivalent circle diameter and the smaller the thickness, the larger the surface area per grain to thereby cause the preparation of epitaxial tabular grains to be difficult. However, the preparation of such grains renders the effect of the present invention conspicuous.

These tabular grains are constituted of silver iodobromide or silver iodochlorobromide. Fundamentally, the host tabular grains are constituted of silver iodobromide or silver iodochlorobromide, and the epitaxial deposition portions are constituted of any one or combinations of silver chloride, silver chlorobromide, silver iodochlorobromide and silver iodobromide. The silver chloride content of the tabular grains for use in the present invention is less than 10 mol %, preferably in the range of 1 to 6 mol %. More preferably, the silver chloride content is in the range of 1 to 5 mol %. The silver iodide content of the tabular grains for use in the present invention is in the range of 0.5 to 10 mol %. Preferably, the silver iodide content is in the range of 1 to 6 mol %. when these ranges are departed from, the preparation of epitaxial tabular grains of the present invention would be difficult.

With respect to these tabular grains, in an amount of 50% or more of the total projected area, the silver chloride content of each individual grain is preferably in the range of 0.7 to 1.3 CL, more preferably 0.8 to 1.2 CL, provided that CL (mol %) represents the average silver chloride content. Because 50% or more of the total projected area of the emulsion of the present invention is occupied by epitaxial tabular grains, fundamentally, the intergranular distribution of silver chloride content is monodisperse. Furthermore, in an amount of 50% or more of the total projected area, the silver iodide content of each individual grain is preferably in the range of 0.7 to 1.3 I, more preferably 0.8 to 1.2 I, provided that I (mol %) represents the average silver iodide content. The intergranular distribution of silver iodide content is monodisperse, so that the preparation of epitaxial tabular grains can be realized. Generally, the EPMA (Electron Probe Micro Analyzer) method is effective in the measuring of the silver chloride or silver iodide content of each individual grain. In this method, a sample wherein emulsion grains are dispersed so as to avoid contacting thereof to each other is prepared. The sample is irradiated with electron beams to thereby emit X-rays. Analysis of the X-rays enables performing an elemental analysis of an extremely minute region irradiated with electron beams. The measuring is preferably performed while cooling the sample in order to prevent the damaging of the sample by electron beams.

The host grains of these epitaxial grains each have opposed (111) main planes. The face including the (111) main plane is herein defined as the main plane portion. The faces connecting the main planes are herein defined as the side face portion. As an example of the epitaxial grains, epitaxial tabular grains each having one epitaxial junction at each of the six apex portions of the hexagon thereby to have a total of six epitaxial junctions per grain, can be enumerated. More preferably, 50% or more of the total projected area is occupied by epitaxial tabular grains each having one epitaxial junction at each of the six apex portions of the hexagon thereby to have a total of six epitaxial junctions per grain. Herein the apex portion means that when viewed from the position perpendicular to the main plane, a portion within a circle having a radius of a length of ⅓ of the shorter side selected from the two neighboring sides that form the apex. When the epitaxial tabular grains are in a circle like shape whose corners are rounded off, if linear sides can be found, use can be made of the length of each side of a hexagon made by extending the linear sides. Further, the apex portion can be identified as a point whose curvature is maximum.

The epitaxial grains of the invention satisfy the requirement as long as 50% or more of the total projected area are occupied by grains each having at least one epitaxial junction per grain. The epitaxial grains of the invention may have an epitaxial junction at any of the apex portion, the main plane portion, the side face portion, and on a side other than the apex portion. The epitaxial grains of the invention may have 30 epitaxial junctions per grain.

The silver halide composition of the epitaxial portion is silver chloride or silver chlorobromide or silver chloroiodobromide or silver bromide or silver iodobromide. It is preferable that the silver chloride content of the epitaxial portion is higher than that of the host tabular grain by 1 mol % or more. It is more preferable that the silver chloride content of the epitaxial portion is higher than that of the host tabular grain by 10 mol % or more. Provided that the silver chloride content of the epitaxial portion is preferably 50 mol % or less. It is preferable that the silver bromide content of the epitaxial portion is 30 mol % or more, more preferably 50 mol % or more. It is preferable that the silver iodide content of the epitaxial portion is in the range of 1 mol % to 20 mol %. The silver amount of the epitaxial portion is preferably in the range of 0.5 mol % to 10 mol %, more preferably in the range of 1 mol % to 5 mol %, with respect to the silver amount of the host tabular grain.

With respect to the epitaxial tabular emulsion of the present invention which satisfies the above requirements, the pBr of the emulsion can be lowered. The terminology "pBr" used herein means the logarithm of inverse of concentration of bromide ions. Storage life can be strikingly enhanced by the realization of lowering of the pBr at 40° C. to 3.5 or less. Further, the same can be incorporated in the lightsensitive material for photographing constituted of silver iodobromide as a fundamental structural element, so that the problem of processing dependency can be solved. In the emulsion of the present invention, the pBr at 40° C. is more preferably 3.0 or less, especially preferably in the range of 2.5 to 1.5.

Particular process for preparing the above epitaxial tabular grains of the present invention will be described in detail below in two parts, the one for the preparation of host tabular grains and the other for the preparation of epitaxial portions.

First, the host tabular grains required for the preparation of the epitaxial tabular grains will be described. With respect to the intragranular distribution of silver iodide in the host tabular grains of the present invention, grains of double or more multiple structures are preferred. Herein, the expression "having structures with respect to the distribution of silver iodide" means that there is a difference in silver iodide content of 0.5 mol % or more, preferably 1 mol % or more, between structures.

Structures with respect to the distribution of silver iodide can fundamentally be determined by calculation from formulation values for the step of grain preparation. The change of silver iodide content at each interface of structures can be sharp or gentle. In the ascertation thereof, although an analytical measuring precision must be considered, the aforementioned EPMA method is effective. This method enables analyzing the intragranular silver iodide distribution as viewed from a position perpendicular to the main plane of tabular grains. Further, by using a specimen obtained by hardening the grain specimen and slicing the hardened specimen with the use of a microtome into extremely thin sections, the method also enables analyzing the intragranular silver iodide distribution across the tabular grain section.

In the host tabular grains, it is preferred that the outermost-shell silver iodide content be higher than inner-shell silver iodide contents. The ratio of the outermost shell is preferably in the range of 1 to 40 mol % based on the total silver quantity. The average silver iodide content thereof is in the range of 1 to 30 mol %. Herein, the ratio of the outermost shell refers to the ratio of the amount of silver used in the preparation of the outermost shell to the amount of silver used for obtaining final grains. The average silver iodide content refers to the molar ratio % of the amount of silver iodide used in the preparation of the outermost shell to the amount of silver used in the preparation of the outermost shell. The distribution thereof may be uniform or nonuniform. More preferably, the ratio of outermost shell is in the range of 5 to 20 mol % based on the total silver quantity, and the average silver iodide content thereof is in the range of 5 to 20 mol %.

The preparation of host tabular grains fundamentally consists of a combination of three steps, namely, nucleation, ripening and growth.

In the step of nucleation of grains for use in the present invention, it is extremely advantageous to employ a gelatin of low methionine content as described in U.S. Pat. Nos. 4,713,320 and 4,942,120; to carry out nucleation at high pBr as described in U.S. Pat. No. 4,914,014; and to carry out nucleation within a short period of time as described in JP-A-2-222940. In the present invention, most preferably, an aqueous solution of silver nitrate, an aqueous solution of halide and an oxidation-processed gelatin of low molecular weight are added within one minute at 20 to 40° C. under agitation in the presence of oxidation-processed gelatin of low molecular weight. At that time, the pBr and pH values of the system are preferably 2 or higher and 7 or below, respectively. The concentration of the aqueous solution of silver nitrate is preferably 0.6 mol/L or less. The employment of this nucleation method facilitates the formation of the epitaxial tabular grains of the present invention.

In the step of ripening the tabular grain emulsion of the present invention, it is practical to effect ripening in the presence of low-concentration base as described in U.S. Pat. No. 5,254,453, and to carry out ripening at high pH as described in U.S. Pat. No. 5,013,641. It is also practical to add, at the step of ripening or subsequent growth, polyalkylene oxide compounds as described in U.S. Pat. Nos. 5,147,771, 5,147,772, 5,147,773, 5,171,659, 5,210,013 and 5,252,453. In the present invention, the ripening step is preferably performed at 60 to 80° C. Immediately after the nucleation or during the ripening, the pBr is preferably lowered to 2 or below. Additional gelatin is preferably added from immediately after the nucleation to the end of ripening. Most preferred gelatin is one having 95% or more of its amino groups modified into succinate or trimellitate. The employment of such gelatins facilitates the formation of the epitaxial tabular grains of the present invention.

In the step of growth, it is preferably employed to simultaneously add an aqueous solution of silver nitrate, an aqueous solution of halide containing a bromide and a silver iodide fine grain emulsion as described in U.S. Pat. Nos. 4,672,027 and 4,693,964. The silver iodide fine grain emulsion is not limited if it consists substantially of silver iodide, and may contain silver bromide and/or silver chloride as long as mixed crystals can be formed. Preferably, the silver halide composition of the silver iodide fine grain emulsion consists of 100% silver iodide. With respect to the crystalline structure, the silver iodide can have not only β form and γ form but also, as described in U.S. Pat. No. 4,672,026, α form or a structure similar thereto. In the present invention, although the crystalline structure is not particularly limited, it is preferred to employ a mixture of β form and γ form, more preferably β form only. Although the silver iodide fine grain emulsion may be one prepared immediately before the addition as described in, for example, U.S. Pat. No. 5,004,679, or one having undergone the customary washing, it is preferred in the present invention to employ the silver iodide fine grain emulsion having undergone the customary washing. The silver iodide fine grain emulsion can be easily prepared by the methods as described in, for example, U.S. Pat. No. 4,672,026. The method of adding an aqueous solution of silver salt and an aqueous solution of iodide by double jet, wherein the grain formation is carried out at a fixed pI value, is preferred. The terminology "pI" used herein means the logarithm of inverse of $I^-$ ion concentration of the system. Although there is no particular limitation with respect to the temperature, pI, pH, type of protective colloid agent such as gelatin, concentration thereof, presence of silver halide solvent, type and concentration thereof, etc., it is advantageous in the present invention that the grain size be 0.1 μm or less, preferably 0.07 μm or less. Although the grain configuration cannot be fully specified because of the fine grains, it is preferred that the variation coefficient of the grain size distribution be 25% or less. When it is 20% or less, the effect of the present invention is especially striking.

The size and size distribution of the silver iodide fine grain emulsion are determined by placing silver iodide fine grains on a mesh for electron microscope observation and, not through the carbon replica method, directly making an observation according to the transmission technique. The reason is that, because the grain size is small, the observation by the carbon replica method causes a large measuring error. The grain size is defined as the diameter of a circle having the same projected area as that of observed grain. With respect to the grain size distribution as well, it is determined by the use of the above diameter of a circle having the same projected area. In the present invention, the most effective silver iodide fine grains have a grain size of 0.06 to 0.02 μm and exhibit a variation coefficient of grain size distribution of 18% or less.

After the above grain formation, the silver iodide fine grain emulsion is preferably subjected to, as described in, for example, U.S. Pat. No. 2,614,929, the customary washing and the regulation of pH, pI and concentration of protective colloid agent such as gelatin and regulation of concentration of contained silver iodide. The pH is preferably in the range of 5 to 7. The pI value is preferably set at one minimizing the solubility of silver iodide or one higher than the same. Common gelatin having an average molecular weight of about 100 thousand is preferably used as the protective colloid agent. Also, low-molecular-weight gelatins having an average molecular weight of 20 thousand or less are preferably used. There are occasions in which the use of a mixture of such gelatins having different molecular weights is advantageous. The gelatin amount per kg of emulsion is preferably in the range of 10 to 100 g, more preferably 20 to 80 g. The silver quantity in terms of silver atom per kg of emulsion is preferably in the range of 10 to 100 g, more preferably 20 to 80 g. Although the silver iodide fine grain emulsion is generally dissolved prior to the addition, it is requisite that the agitating efficiency of the system be satisfactorily high at the time of the addition. The agitation rotating speed is preferably set higher than usual. The addition of an antifoaming agent is effective in preventing the foaming during the agitation. Specifically, use is made of antifoaming agents set forth in, for example, Examples of U.S. Pat. No. 5,275,929.

The method most preferably employed in the growth step is one described in JP-A-2-188741. In the growth of tabular grains, an ultrafine grain emulsion of silver bromide, silver iodobromide or silver iodochlorobromide, prepared just before the addition, is continuously added so that the ultrafine grain emulsion is dissolved to thereby accomplish growth of tabular grains. An external mixer for preparing the ultrafine grain emulsion has high agitation capacity, and an aqueous solution of silver nitrate, an aqueous solution of halide and gelatin are fed into the external mixer. Gelatin can be mixed with an aqueous solution of silver nitrate and/or an aqueous solution of halide in advance or just before the addition. Also, an aqueous solution of gelatin can be added alone. Gelatins having a molecular weight smaller than the ordinary are preferred. It is especially preferred that the molecular weight thereof be in the range of 10,000 to 50,000. Gelatin having 90% or more of its amino groups modified into phthalate, succinate or trimellitate and/or oxidation-processed gelatin of reduced methionine content can especially preferably be used. The use of this growth method facilitates the formation of the epitaxial tabular grains of the present invention.

It is especially preferred that 75% or less of all the side faces connecting the opposite (111) main planes of host tabular grains consist of (111) faces.

The expression "75% or less of all the side faces consist of (111) faces" used herein means that crystallographic faces other than the (111) faces are present at a ratio higher than 25% based on all the side faces. The other faces, although generally understandable as consisting of (100) faces, are not limited thereto and can comprise (110) faces and faces of higher indices. The effect of the present invention is remarkable when 70% or less of all the side faces consist of (111) faces.

Whether 70% or less of all the side faces consist of (111) faces or not can easily be judged from an electron micrograph obtained by the carbon replica method in which the tabular grain is shadowed. When at least 75% of all the side faces consist of (111) faces, with respect to a hexagonal tabular grain, six side faces directly connected to the (111) main planes are generally alternately connected to the (111) main planes with acute angles and obtuse angles. On the other hand, when 70% or less of all the side faces consist of (111) faces, with respect to a hexagonal tabular grain, six side faces directly connected to the (111) main planes are all connected to the (111) main planes with obtuse angles. Whether the side faces are connected to the main planes with acute angles or with obtuse angles can be judged by effecting the shadowing at an angle of 500 or less. Preferably, the judgment between acute angles and obtuse angles is facilitated by effecting the shadowing at an angle of 300 to 10°.

The method of utilizing the adsorption of a sensitizing dye is effective in determining the ratio of (111) faces to (100) faces. The ratio of (111) faces to (100) faces can be quantitatively determined by the application of the method described in Journal of the Chemical Society of Japan, 1984, vol. 6, pp. 942-947. The ratio of (111) faces to all the side faces can be calculated from the above ratio of (111) faces to (100) faces and the aforementioned equivalent circle diameter and thickness of the tabular grain. In this instance, the tabular grain is assumed as a cylinder with the equivalent circle diameter and thickness. Under this assumption, the ratio of the side faces to the total surface area can be determined. The ratio of (100) faces to all the side faces is a value obtained by dividing the above ratio of (100) faces determined on the basis of the adsorption of sensitizing dye by the above side face ratio and multiplying the resultant quotient by 100. The ratio of (111) faces to all the side faces is determined by subtracting this value from 100. In the present invention, it is more preferred that the ratio of (111) faces to all the side faces be 65% or less.

The method for causing 75% or less of all the side faces of the host tabular grain emulsion to consist of (111) faces will now be described. Most generally, the ratio of (111) faces to the side faces of the host tabular grain emulsion can be can be regulated by pBr at the preparation of the tabular grain emulsion. Preferably, 30% or more of the silver quantity required for the formation of the outermost shell is added at a pBr set so that the ratio of (111) faces to the side faces is decreased, that is, the ratio of (100) faces to the side faces is increased. More preferably, 50% or more of the silver quantity required for the formation of the outermost shell is added at a pBr set so that the ratio of (111) faces to the side faces is decreased.

As an alternative method, after the addition of the whole silver quantity, pBr is so set that the ratio of (100) faces to the side faces is increased, followed by ripening to thereby attain an increase of the ratio.

With respect to such pBr as will increase the ratio of (100) faces to the side faces, the value thereof can be widely varied depending on the temperature and pH of system, type of protective colloid agent such as gelatin, concentration thereof, presence of silver halide solvent, type and concentration thereof, etc. Generally, it is preferred that the pBr be in the range of 2.0 to 5. More preferably, the pBr is in the range of 2.5 to 4.5. However, as mentioned above, this pBr value can be easily changed, for example, depending on the presence of a silver halide solvent, etc. Examples of silver halide solvents which can be used in the present invention include organic thioethers (a) described in U.S. Pat. Nos. 3,271,157, 3,531,286 and 3,574,628 and JP-A's-54-1019 and 54-158917, thiourea derivatives (b) described in JP-A's-53-82408, 55-77737 and 55-2982, silver halide solvents having a thiocarbonyl group interposed between an oxygen or sulfur atom and a nitrogen atom (c) described in JP-A-53-144319, imidazoles (d) described in JP-A-54-100717, sulfites (e), ammonia (f) and thiocyanates (g).

Especially preferred solvents are thiocyanates, ammonia and tetramethylthiourea. Although the amount of added solvent depends on the type thereof, in the case of, for example, a thiocyanate, the preferred amount is in the range of $1\times10^{-4}$ to $1\times10^{-2}$ mol per mol of silver halides.

With respect to the method of changing the face index for the side faces of the tabular grain emulsion, reference can be made to, for example, EP No. 515894A1. Further, use can be made of polyalkylene oxide compounds described in, foe example, U.S. Pat. No. 5,252,453. As an effective method, there can be mentioned the use of face index improvers described in, for example, U.S. Pat. Nos. 4,680,254, 4,680,255, 4,680,256 and 4,684,607. Conventional photographic spectral sensitizing dyes can also be used as similar face index improvers.

It is preferred that the host tabular grains have no dislocation lines. Dislocation lines can be vanished by the use of the above nucleation, ripening and growth steps in combination.

The epitaxial junction required for the preparation of epitaxial tabular grains will now be described. The epitaxial deposition may be carried out immediately after the formation of host tabular grains, or after customary desalting performed after the formation of host tabular grains. Preferably, the epitaxial deposition is carried out after the customary desalting. Preferably, the host tabular grain emulsion is washed for desalting, and dispersed in a newly provided protective colloid. It is advantageous to use gelatin as the protective colloid for dispersing the host tabular grain emulsion after desalting. High-molecular-weight gelatin obtained by crosslinking ordinary gelatin by chemical means is most preferably used. The use of this gelatin increases the stability of the epitaxial tabular grains. Also, use can be made of other hydrophilic colloids.

For example, use can be made of a variety of synthetic hydrophilic polymeric materials including proteins such as gelatin derivatives, graft polymers from gelatin/other polymers, albumin and casein; sugar derivatives, for example, cellulose derivatives such as hydroxyethylcellulose, carboxymethylcellulose and cellulose sulfate, sodium alginate and starch derivatives; and homo- or copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole. Suitable gelatins include, for example, not only lime treated gelatins but also acid treated gelatins and, further, enzyme treated gelatins as described in Bull. Soc. Sci. Photo. Japan, No. 16, p.30 (1966). Also, use can be made of gelatin hydrolyzates and enzymolyzates.

Although the washing temperature can be selected in conformity with the object, it is preferably selected within the range of 5 to 50° C. Although the pH at which the washing is conducted can also be selected in conformity with the object, it is preferably selected within the range of 2 to 10, more preferably within the range of 3 to 8. Although the pAg at which the washing is conducted can also be selected in conformity with the object, it is preferably selected within the range of 5 to 10. The method of washing can be selected from among the noodle washing technique, the dialysis with the use of a semipermeable membrane, the centrifugation, the coagulation precipitation method and the ion exchange method. The coagulation precipitation can be conducted according to a method selected from among the method in which a sulfate is used, the method in which an organic solvent is used, the method in which a water soluble polymer is used and the method in which a gelatin derivative is used.

At the time of dispersion after desalting, the pH, pAg, type and concentration of gelatin and viscosity are selected for the preparation of the epitaxial tabular grains of the present invention. In particular, the gelatin concentration is important, and is preferably 50 g or more per liter. More preferably, it is in the range of 70 to 120 g. At extremely low concentrations, the epitaxial deposition would occur on main planes of the tabular grains. At extremely high concentrations, a viscosity rise would occur to thereby render the epitaxial deposition intergranularly nonuniform.

A sensitizing dye is used as a site indicating agent (or site director) for the epitaxial junction. The position of epitaxial deposition can be controlled by selecting the amount and type of employed sensitizing dye. Dyes are each preferably added in an amount of 50 to 90% based on a saturated coating quantity. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes. Any of nuclei commonly used in cyanine dyes as basic heterocyclic nuclei can be employed in these dyes. That is, there can be employed, for example, a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzoindolenine nucleus, an indole nucleus, a benzoxazole nucleus, a naphthoxazole nucleus, a benzothiazole nucleus, a naphthothiazole nucleus, a benzoselenazole nucleus, a benzoimidazole nucleus and a quinoline nucleus. These nuclei may have substituents on carbon atoms thereof.

These sensitizing dyes may be used either individually or in combination. The sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, GB Nos. 1,344,281 and 1,507,803, JP-B's-43-4936 and 53-12375, and JP-A's-52-110618 and 52-109925.

The emulsion of the present invention may be loaded with a dye which itself exerts no spectral sensitizing effect or a substance which absorbs substantially none of visible light and exhibits supersensitization, simultaneously with or separately from the above sensitizing dye.

Increased silver iodide content in the surface composition of host tabular grains at the time of adsorption of sensitizing dye is preferred from the viewpoint of preparation of epitaxial tabular grains. Thus, addition of iodide ions is effected prior to the incorporation of sensitizing dye. In the present invention, it is most preferably employed to add the aforementioned AgI fine grain emulsion to thereby increase the silver iodide content of the surface of host tabular grains. This renders the intergranular distribution of silver iodide content uniform and renders the adsorption of sensitizing dye uniform. As a result, the preparation of epitaxial tabular grains can be realized. The addition amount of such iodide ions or silver iodide is preferably in the range of $1\times10^{-4}$ to $1\times10^{-2}$ mol, more preferably $1\times10^{-3}$ to $5\times10^{-3}$ mol, per mol of host tabular grains.

With respect to the method of forming epitaxial portions, a solution containing halide ions and a solution containing $AgNO_3$ may be added simultaneously or separately. Alternatively, the formation may be effected by carrying out the addition in appropriate combination with, for example, the addition of AgCl fine grains, AgBr fine grains or AgI fine grains all having a grain diameter smaller than that of host tabular grains, or the addition of mixed crystal grains thereof. In the addition of the $AgNO_3$ solution, the addition time is preferably in the range of 30 sec to 10 min, more preferably 1 to 5 min. For the formation of the epitaxial tabular grains of the present invention, the concentration of added silver nitrate solution is preferably 1.5 mol/L or less, more preferably 0.5 mol/L or less. At that time, the agitation of the system must be carried out efficiently, and, with respect to the viscosity of the system, the lower, the more preferable.

Regarding the formation of an epitaxial junction on base grains or host grains, a silver salt epitaxial can be formed on a selected portion, for example at an edge or a corner of the base grain, by the use of site director such as iodide ions, aminoazaindenes or spectral sensitizing dyes, which are adsorbed on the surface of the base grains as described in U.S. Pat. No. 4,435,501. Further, the invention disclosed in JP-A-8-69069 attained sensitivity increase by formation of silver salt epitaxial at a selected portion of the ultra thin tabular grain base, and by most suitably chemical sensitizing the thus formed epitaxial phase.

In the present invention, it is preferable for the base grains to increase sensitivity thereof by using these methods. As a site director, aminoazaindene or spectral sensitizing dyes may be used, or iodide ions or thiocyanate ions may be used. The site director can be selectively used depending on the purpose, and combination of the site directors may be applicable.

By changing the addition amount of the sensitizing dyes, iodide ions and thiocyanate ions, formation position of the silver salt epitaxial can be limited to the edge or corner of the base brains. The addition amount of the iodide ions is 0.0005 to 1.0 mol %, preferably 0.001 to 0.5 mol % of the silver amount of the base grains. Further, the amount of the thiocyante ions is 0.01 to 0.2 mol %, preferably 0.02 to 0.1 mol % of the silver amount of the base grains. After the addition of the site directors, a silver salt epitaxial is formed by adding a silver salt solution and a halide salt solution. During the addition, the temperature is preferably in the range of 40 to 70 ° C., more preferably in the range of 45 to 60° C. The pAg during the addition is preferably 7.5 or less, more preferably 6.5 or less. By using the site director, silver salt epitaxial may be formed at the corner portion or the edge portion of each base grain. The thus obtained emulsion may be subjected to chemical sensitization selectively to the epitaxial phase, thereby to increase the sensitivity of the emulsion as described in JP-8-69069. Alternatively, subsequent to the silver salt epitaxial formation, further growth of the emulsion may also be performed by a simultaneous addition of a silver salt solution and a halide salt solution. The halide salt solution used for the addition is preferably a bromide salt solution or a mixed solution of a bromide salt and an iodide salt. The temperature during the addition is preferably in the range of 40 to 80 ° C., more preferably 45 to 70° C. The pAg during the addition is preferably in the range of 5.5 to 9.5, more preferably in the range of 6.0 to 9.0.

In the present invention, an example of a preferable position for the epitaxial junction is the apex portion.

The silver quantity of epitaxial portions is preferably in the range of 0.5 to 10 mol %, more preferably 1 to 5 mol %, based on the silver quantity of host tabular grains. When the silver quantity is too small, the epitaxial tabular grains cannot be prepared. On the other hand, when the silver quantity is too large, the resultant epitaxial tabular grains are unstable.

At the formation of epitaxial portions, the pBr is preferably 3.5 or more, more preferably 4.0 or more. The temperature is preferably in the range of 35 to 45° C. At the formation of epitaxial portions, it is preferred that the emulsion be doped with a 6-cyano metal complex.

Among the 6-cyano metal complex, hose containing iron, ruthenium, osmium, cobalt, rhodium, iridium or chromium are preferable. The addition amount of the metal salt is preferably within the range of $10^{-9}$ to $10^{-2}$ per mol of silver halide, and more preferably within the range of $10^{-8}$ to $10^{-4}$. The metal complex may be added by dissolving it to water or a organic solvent. The organic solvent is preferably miscible with water. As examples of the organic solvent, alcohols, ethers, glycols, ketons, esters, and amides are included.

As the metal complexes, 6-cyanometal complexes represented by the following formula (I) is especially preferable. The 6-cyano metal complex has advantages of attaining high-sensitive lightsensitive material, and suppressing fogging from arising even when a raw photosensitive material is stored for a long period of time.

$$[M(CN)_6]^{n-} \quad \text{(I)}$$

wherein M represents iron, ruthenium, osmium, cobalt, rhodium, iridium or chromium, and n represent 3 or 4.

Specific examples of the 6-cyano metal complexes are set forth below:

$$[Fe(CN)_6]^{4-} \quad \text{(I-1)}$$

$$[Fe(CN)_6]^{3-} \quad \text{(I-2)}$$

$$[Ru(CN)_6]^{4-} \quad \text{(I-3)}$$

$$[Os(CN)_6]^{4-} \quad \text{(I-4)}$$

$$[Co(CN)_6]^{3-} \quad \text{(I-5)}$$

$$[Rh(CN)_6]^{3-} \quad \text{(I-6)}$$

$$[Ir(CN)_6]^{3-} \quad \text{(I-7)}$$

$$[Cr(CN)_6]^{4-} \quad \text{(I-8)}$$

For the counter cations of the 6-cyano complex, those easily miscible with water, and suitable for precipitation procedure of a silver halide emulsion are preferably used. Examples of the counter ions includes alkali metal ions (e.g. sodium ion, potassium ion, rubidium ion, cesium ion and lithium ion), ammonium ion and alkylammonium ion.

The general aspects of the emulsions or the present invention will be described below.

Reduction sensitization preferable performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted.

As examples of the reduction sensitizer stannous chloride, ascorbic acid and its derivatives, hydroquinone and its derivatives, catechol and is derivatives, hydroxylamine and its derivatives, amines and polyamines, hydrazine and its derivatives, para-phenylenediamin and its derivatives, formamidinesulfinic acid(thiourea dioxide), a silane compound, and a borane compound, can be mentioned. In reduction sensitization of the present invention, it is possible to selectively use these reduction sensitizers or to use two or more types of compounds together. Regarding the methods for performing the reduction sensitization, those disclosed in U.S. Pat. Nos. 2,518,698, 3,201,254, 3,411,917, 3,779,777, 3,930,867, may be used. Regarding the methods for using the reduction sensitizer, those disclosed in JP-B's-57-33572 and 58-1410, JP-A-57-179835, may be used. Preferable compounds as the reduction sensitizer are catechol and its derivatives, hydroxylamine and its derivatives, and formamidinesulfinic acid(thiourea dioxide). Although the addition amount of reduction sensitizers must be so selected as to meet the emulsion manufacturing conditions, a proper amount is $10^{-7}$ to $10^{-1}$ mol per mol of a silver halide.

The reduction sensitizer is added during grain formation by dissolving thereof to water, or organic solvents such as alcohols, glycols, ketones, esters, and amides.

In performing reduction sensitization, a compound represented by general formula (3) or general formula (4) is preferably used:

(3)

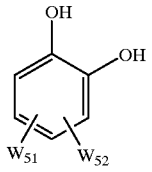

(4)

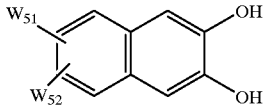

In formulas (3) and (4), each of $W_{51}$ and $W_{52}$ represents a sulfo group or a hydrogen atom. Provided that at least one of $W_{51}$ and $W_{52}$ represents a sulfo group. A sulfo group is generally an alkali metal salt such as sodium or potassium, or a water-soluble salt such as ammonium salt. Practical examples of preferable compounds are 3,5-disulfocatecholdisodium salt, 4-sulfocatecholammonium salt, 2,3-dihydroxy-7-sulfonaphthalenesodium salt, and 2,3-dihydroxy-6,7-disulfonaphthalenepotassium salt. A preferable addition amount can change in accordance with the temperature, pBr, and pH of a system to which this compound is added, the type and concentration of a protective colloid agent such as gelatin, and the presence/absence, type, and concentration of a silver halide solvent. However, the addition amount is generally 0.005 to 0.5 mol, and more preferably, 0.003 to 0.02 mol, per mol silver halide.

The compound represented by general formula (3) or general formula (4) is preferably present during grain growth by dissolving it to a solvent such as water or alcohols.

Examples of the silver halide solvents which can be employed in the present invention include (a) organic thioethers described in U.S. Pat. Nos. 3,271,157, 3,531,289, and 3,574,628, JP-A's-54-1019 and 54-158917, (b) thiourea derivatives described in, for example, JP-A's-53-82408, 55-77737 and 55-2982, (c) silver halide solvents having a thiocarbonyl group interposed between an oxygen or sulfur atom and a nitrogen atom, described in JP-A-53-144319, (d) imidazoles described in JP-A-54-100717, (e) sulfites and (f) thiocyanates.

Thiocyanates, ammonia and tetramethylthiourea can be mentioned as especially preferred silver halide solvents. The amount of added solvent, although varied depending on the type thereof, is, if thiocyanate is use, preferably in the range of $1\times10^{-4}$ to $1\times10^{-2}$ mol per mol of silver halide.

The photographic emulsion of the invention is spectrally sensitized to preferably red-sensitive. Red-sensitive herein means that the spectral sensitization is performed so that the spectral sensitivity of the emulsion becomes maximum at 600 nm or more and less than 700 nm.

As useful spectral sensitizers, e.g., those described in JP-A-2-68539, page 4, lower right column, line 4 to page 8, lower right column, and JP-A-2-58041, page 12, lower left column line 8 to lower right column line 19, can be mentioned. Further, those described in German Patent No. 929,080, U.S. Pat. Nos. 2,493,748, 2,503,776, 2,519,001, 2,912,329, 3,656,959, 3,672,897, and 4,025,349, British Patent No. 1,242,588, and JP-B-44-14030, can be mentioned.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, GB No. 1,344,281, and 1,507,803, JP-B's-43-4936, and 53-12375, and JP-A's-52-110618, 52-109925, and 52-110618.

In the present invention, it is especially preferable to perform each of the red-sensitive spectral sensitization by adding two or more cyanine dyes. Benzothia-benzothia-carbocyanine, benaothia-benzoxa-carbocyanine, benzothia-naphthothia-carbocyanin can be mentioned as preferable cyanine dyes. In this case, all of the two or more cyanine dyes do not necessarily red-sensitive, but spectral sensitization sensitivity becomes maximum in the respective color sensitivity as a result of the addition of 2 or more cyanine dyes will do.

The emulsion of the invention may contain a dye having no spectral sensitizing function by itself, or a substance that does not substantially absorb visible light and exhibit supersensitization. The time at which the sensitizing dye and the compound represented by formula (1) of the present invention may be at any stage during emulsion preparation. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

The addition amount of the sensitizing dye is preferably $1\times10^{-5}$ or more per mol of silver halide. The upper limit of the addition amount of the sensitizing dye is preferably $1\times10^{-2}$ mol per mol of silver halide.

In the formation of silver halide grains of the present invention, at least one of chalcogen sensitization including sulfur sensitization and selenium sensitization, and noble metal sensitization including gold sensitization and palladium sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization speck can be selected in accordance with the intended use. However, it is preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred.

In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. No. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

In the present invention, thiocyanate is preferably added prior to the addition of the above mentioned spectral sensitizing dye and the chemical sensitizer. More preferably, thiocyanate is added after grain formation, much more preferably, after the desalting step. Since thiocyanate is added at the time of chemical sensitization, the addition of the thiocyanate is performed twice or more times. As the thiocyanate, potassium thiocyanate, sodium thiocyanate, ammonium thiocyanate and so on are used.

Usually, thiocyanate is added as an aqueous solution or by dissolving it to water-soluble solvent. The addition amount thereof is in the range of $1\times10^{-5}$ mol to $1\times10^{-2}$ mol, preferably, in the range of $5\times10^{-5}$ mol to $5\times10^{-3}$ mol, per mol of silver halide.

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

It is preferable to wash with water an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of the emulsion of the present invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as water, methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se and Te, cyanate, thiocyanate, selenocyanate, carbonate, phosphate, or acetate may be present.

An oxidizer capable of oxidizing silver is preferably used during the process of producing the emulsion for use in the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; and azaindenes such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

With respect to the layer arrangement and related techniques, silver halide emulsions, dye forming couplers, DIR couplers and other functional couplers, various additives and development processing which can be used in the photographic lightsensitive material of the present invention and the emulsions suitable for use in the emulsion and the lightsensitive material using the emulsion, reference can be made to EP 0565096A1 (published on Oct. 13, 1993) and patents cited therein. Individual particulars and the locations where they are described will be listed below, the disclosure of which is incorporated herein by refernce.

1. Layer arrangement: page 61 lines 23 to 35, page 61 line 41 to page 62 line 14,
2. Interlayers: page 61 lines 36 to 40,
3. Interlayer effect imparting layers: page 62 lines 15 to 18, 4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical sensitization of emulsion: page 63 lines 6 to 9,
13. Emulsion mixing: page 63 lines 10 to 13,
14. Fogged emulsions: page 63 lines 14 to 31,
15. Nonlightsensitive emulsions: page 63 lines 32 to 43,
16. Silver coating amounts: page 63 lines 49 to 50,
17. Additives: Described in RD Nos. 17643 (December, 1978), 18716 (November, 1979) and 307105 (November, 1989). The locations where they are described will be listed below, the disclosures of which are incorporated herein by rference.

| | Types of additives | RD17643 | RD18716 | RD307105 |
|---|---|---|---|---|
| 1. | Chemical sensitizers | page 23 | page 648 right column | page 866 |
| 2. | Sensivity increasing agents | | page 648 right column | |
| 3. | Spectral sensitiziers, super-sensitizers | pages 23–24 | page 648, right column to page 649, right column | pages 866–868 |
| 4. | Brighteners | page 24 | page 648, right column | page 868 |
| 5. | Antifoggants, stabilizers | pages 24–25 | page 649 right column | pages 868–870 |
| 6. | Light absorbents, filter dyes, ultraviolet absorbents | pages 25–26 | page 649, right column to page 650, left column | page 873 |
| 7. | Stain preventing agent | page 25 right column | page 650, left to right column | page 872 |
| 8. | Dye image stabilizers | page 25 | page 650, left column | page 872 |
| 9. | Film hardeners | page 26 | page 651, left column | page 874–875 |
| 10. | Binders | page 26 | page 651, left column | pages 873–874 |
| 11. | Plasticizers, lubricants | page 27 | page 650, right column | page 876 |
| 12. | Coating aids, surfactants | pages 26–27 | page 650, right column | pages 875–876 |
| 13. | Antistatic agents | page 27 | page 650, right column | pages 876–877 |
| 14. | Matting agents | | | pages 878–879. |

18. Formaldehyde scavengers: page 64 lines 54 to 57,
19. Mercapto antifoggants: page 65 lines 1 to 2,
20. Fogging agent, etc. release agents: page 65 lines 3 to 7,
21. Dyes: page 65, lines 7 to 10,
22. Color coupler summary: page 65 lines 11 to 13,
23. Yellow, magenta and cyan couplers: page 65 lines 14 to 25,
24. Polymer couplers: page 65 lines 26 to 28,
25. Diffusive dye forming couplers: page 65 lines 29 to 31,
26. Colored couplers: page 65 lines 32 to 38,
27. Functional coupler summary: page 65 lines 39 to 44,
28. Bleaching accelerator release couplers: page 65 lines 45 to 48,
29. Development accelerator release couplers: page 65 lines 49 to 53,
30. Other DIR couplers: page 65 line 54 to page 66 to line 4,
31. Method of dispersing couplers: page 66 lines 5 to 28,
32. Antiseptic and mildewproofing agents: page 66 lines 29 to 33,
33. Types of sensitive materials: page 66 lines 34 to 36,
34. Thickness of lightsensitive layer and swellinh speed: page 66 line 40 to page 67 line 1,
35. Back layers: page 67 lines 3 to 8,
36. Development processing summary: page 67 lines 9 to 11,
37. Developers and developing agents: page 67 lines 12 to 30,
38. Developer additives: page 67 lines 31 to 44,
39. Reversal processing: page 67 lines 45 to 56,
40. Processing solution open ratio: page 67 line 57 to page 68 line 12,
41. Development time: page 68 lines 13 to 15,
42. Bleach-fix, bleaching and fixing: page 68 line 16 to page 69 line 31,
43. Automatic processor: page 69 lines 32 to 40,
44. washing, rinse and stabilization: page 69 line 41 to page 70 line 18,
45. Processing solution replenishment and recycling: page 70 lines 19 to 23,
46. Developing agent built-in sensitive material: page 70 lines 24 to 33,
47. Development processing temperature: page 70 lines 34 to 38, and
48. Application to film with lens: page 70 lines 39 to 41.

The silver halide color photographic material that the silver halide photographic material of the present invention is preferably applied, are usually provided with a red-sensitive layer, a green-sensitive-layer, and a blue-sensitive layer on a support in this order from the one closest to the support. However, the arrangement order may be reversed depending on the purpose of the photographic material. A non lightsensitive layer can be formed between the silver halide lightsensitive layers and as the uppermost layer and the lowermost layer. These intermediate layers may contain, e.g., couplers to be described later, DIR compounds and color-mixing inhibitors. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045, the disclosures of which are incorporated herein by reference. Also, as described in JP-A's-57-112751, 62-200350, 62-206541 and 62-206543, the disclosures of which are incorporated herein by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is incorporated herein by reference, layers can be arranged from the farthest side from a support in the order of blue-sensitive layer/GH/RH/GL/RL. Furthermore, as described in JP-A's-56-25738 and 62-63936, the disclosures of which are incorporated herein by reference, layers can be arranged from the farthest side from a support in the order of blue-sensitive layer/GL/RL/GH/RH.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

In order to improve the color reproducibility, a donor layer (CL) of an interlayer effect having a spectral sensitivity distribution different from the main lightsensitive layers BL, GL and RL as described in U.S. Pat. Nos. 4,663,271, 4,705,744 and 4,707,436 and JP-A's-62-160448 and 63-89850 is preferably arranged adjacent to or close to the main lightsensitive layers.

In the lightsensitive material for use in the present invention, it is preferred to use nonlightsensitive fine grain silver halide. The expression "nonlightsensitive fine grain silver halide" refers to silver halide fine grains which are not sensitive to light at the time of imagewise exposure for obtaining a dye image and which are substantially not developed at the time of development processing thereof. Those not fogged in advance are preferred. The fine grain silver halide has a silver bromide content of 0 to 100 mol %, and, if necessary, may contain silver chloride and/or silver iodide. Preferably, silver iodide is contained in an amount of 0.5 to 10 mol %. The average grain size (average of equivalent circular diameter of projected area) of fine grain silver halide is preferably in the range of 0.01 to 0.5 $\mu$m, more preferably 0.02 to 0.2 $\mu$m.

The fine grain silver halide can be prepared by the same process as used in the preparation of common lightsensitive silver halide. It is not needed to optically sensitize the surface of silver halide grains. Further, a spectral sensitization thereof is also not needed. However, prior to the addition thereof to a coating liquid, it is preferred to add any of known stabilizers such as triazole, azaindene, benzothiazolium and mercapto compounds or zinc compounds. Colloidal silver can be contained in layers loaded with the fine grain silver halide.

The silver coating amount of the lightsensitive material for use in the present invention is preferably 10.0 g/m$^2$ or less, most preferably 6.0 g/m$^2$ or less.

Various dye forming couplers can be used in the lightsensitive material of the present invention, and the following couplers are particularly preferable.

Yellow couplers: couplers represented by formulas (I) and (II) in EP No. 502,424A; couplers represented by formulas (1) and (2) in EP No. 513,496A (particularly Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (particularly D-35 on page 18); couplers represented by formula (Y) on page 4 in EP No. 447,969A1 (particularly Y-1 (page 17) and Y-54 (page 41)); and couplers represented by formulas (II) to (IV) in column 7, lines 36 to 58, in U.S. Pat. No. B4,476,219 (particularly II-17, II-19 (column 17), and II-24 (column 19)), the disclosures of the above documents disclosing the yellow couplers are incorporated herein by reference Magenta couplers: JP-A-3-39737 (L-57 (page 11, lower right column), L-68 (page 12, lower right column), and L-77 (page 13, lower right column); [A-4]-63 (page 134), and [A-4]-73 and -75 (page 139) in EP No. 456,257; M-4 and -6 (page 26), and M-7 (page 27) in EP No. 486,965; M-45 (page 19) in EP No. 571,959A; (M-1) (page 6) in JP-A-5-204106; and M-22 in paragraph 0237 of JP-A-4-362631, the disclosures of the above documents disclosing the magenta couplers are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by general formulas (Ia) and (Ib) in claim 1 of JP-A-6-67385, the disclosures of the above documents disclosing the cyan couplers are incorporated herein by reference.

Polymer couplers: P-1 and P-5 (page 11) in JP-A-2-44345, the disclosure of which is incorporated herein by reference.

Couplers for forming a colored dye with a proper diffusibility are preferably those described in U.S. Pat. No. 4,366,237, GB No. 2,125,570, EP No. 96,873B, and DE No. 3,234,533, the disclosures of which are incorporated herein by reference.

As couplers for correcting the unnecessary absorption of a colored dye, preferred use is made of, besides the magenta colored yellow couplers of the present invention, yellow colored cyan couplers represented by formulas (CI), (CII), (CIII), and (CIV) described on page 5 in EP No. 456,257A1 (particularly YC-86 on page 84); yellow colored magenta couplers ExM-7 (page 202), Ex-1 (page 249), and EX-7 (page 251) described in EP No. 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO No. 92/11575 (particularly compound examples on pages 36 to 45), the disclosures of all the documents disclosing the couplers for correcting the unnecessary absorption of a colored dye are incorporated herein by reference.

Examples of compounds (including a coupler) which react with a developing agent in an oxidized form to thereby release a photographically useful compound residue are as follows. Development inhibitor release compounds: compounds represented by formulas (I), (II), (III), and (IV) on page 11 of EP No. 378,236A1 (particularly T-101 (page 30), T-104 (page 31), T-113 (page 36), T-131 (page 45), T-144 (page 51), and T-158 (page 58)); a compound represented by formula (I) on page 7 of EP No. 436,938A2 (particularly D-49 (page 51)); a compound represented by formula (1) in EP No. 568,037A (particularly (23) (page 11)); and compounds represented by formulas (I), (II), and (III) on pages 5 and 6 of EP No. 440,195A2 (particularly I-(1) on page 29). Bleaching accelerator release compounds: compounds represented by formulas (I) and (I') on page 5 of EP No. 310,125A2 (particularly (60) and (61) on page 61); and compounds represented by formula (I) in claim 1 of JP-A-6-59411 (particularly (7) (page 7)). Ligand release compounds: compounds represented by LIG-X described in claim 1 of U.S. Pat. No. 4,555,478 (particularly compounds in column 12, lines 21 to 41). Leuco dye release compounds: compounds 1 to 6 in columns 3 to 8 of U.S. Pat. No. 4,749,641. Fluorescent dye release compounds: compounds represented by COUP-DYE in claim 1 of U.S. Pat. No. 4,774,181 (particularly compounds 1 to 11 in columns 7 to 10). Development accelerator or fogging agent release compounds: compounds represented by formulas (1), (2), and (3) in column 3 of U.S. Pat. No. 4,656,123 (particularly (I-22) in column 25); and ExZK-2 on page 75, lines 36 to 38, in EP No. 450,637A2. Compounds which release a group which does not function as a dye unless it splits off: compounds represented by formula (I) in claim 1 of U.S. Pat. No. 4,857,447 (particularly Y-1 to Y-19 in columns 25 to 36).

Preferable examples of additives other than couplers are as follows.

Dispersion mediums of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272. Impregnating latexes of an oil-soluble organic compound: latexes described in U.S. Pat. No. 4,199,363. Scavengers of developing agent in an oxidized form: compounds represented by formula (I) in column 2, lines 54 to 62, in U.S. Pat. No. 4,978,606 (particularly I-(1), I-(2), I-(6), and I-(12) (columns 4 and 5)), and formulas in column 2, lines 5 to 10, in U.S. Pat. No. 4,923,787 (particularly compound 1 (column 3)). Stain inhibitors: formulas (I) to (III) on page 4, lines 30 to 33, particularly I-47, I-72, III-1, and III-27 (pages 24 to 48) in EP No. 298321A. Discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP No. 298,321A; II-1 to III-23, particularly III-10, in columns 25 to 38 of U.S. Pat. No. 5,122,444; I-1 to III-4, particularly II-2, on pages 8 to 12 in EP No. 471,347A; and A-1 to A-48, particularly A-39 and A-42, in columns 32 to 40 of U.S. Pat. No. 5,139,931. Materials which reduce the use amount of a color enhancer or a color amalgamation inhibitor: I-1 to II-15, particularly 1-46, on pages 5 to 24 in EP No. 411,324A. Formalin scavengers: SCV-1 to SCV-28, particularly SCV-8, on pages 24 to 29 in EP No. 477,932A. Film hardeners: H-1, H-4, H-6, H-8, and H-14 on page 17 in JP-A-1-214845; compounds (H-1 to H-54) represented by formulas (VII) to (XII) in columns 13 to 23 of U.S. Pat. No. 4,618,573;, compounds (H-1 to H-76), particularly H-14, represented by formula (6) on page 8, lower right column, in JP-A-2-214852; and compounds described in claim 1 of U.S. Pat. No. 3,325,287. Development inhibitor precursors: P-24, P-37, and P-39 (pages 6 and 7) in JP-A-62-168139; and compounds described in claim 1, particularly 28 and 29 in column 7, of U.S. Pat. No. 5,019,492. Antiseptic agents and mildewproofing agents; I-1 to III-43, particularly II-1, II-9, II-10, II-18, and III-25, in columns 3 to 15 of U.S. Pat. No. 4,923,790. Stabilizers and antifoggants: I-1 to (14), particularly I-1, I-60, (2), and (13), in columns 6 to 16 of U.S. Pat. No. 4,923,793; and compounds 1 to 65, particularly compound 36, in columns 25 to 32 of U.S. Pat. No. 4,952,483. Chemical sensitizers: triphenylphosphine, selenide, and compound 50 in JP-A-5-40324. Dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450; F-I-1 to F-II-43, particularly F-I-11 and F-II-8, on pages 33 to 55 in EP No. 445,627A; III-1 to III-36, particularly III-1 and III-3, on pages 17 to 28 in EP No. 457,153A; microcrystalline dispersions of Dye-1 to Dye-124 on pages 8 to 26 in WO No. 88/04794; compounds 1 to 22, particularly compound 1, on pages 6 to 11 in EP No. 319,999A; compounds D-1 to D-87 (pages 3 to 28) represented by formulas (1) to (3) in EP No. 519,306A; compounds 1 to 22 (columns 3 to 10) represented by formula (I) in U.S. Pat. No. 4,268,622; and compounds (1) to (31) (columns 2 to 9) represented by formula (I) in U.S. Pat. No. 4,923,788. UV absorbents: compounds (18b) to (18r) and 101 to 427 (pages 6 to 9) represented by formula (1) in JP-A-46-3335; compounds (3) to (66) (pages 10 to 44) represented by formula (I) and compounds HBT-1 to HBT-10 (page 14) represented by formula (III) in EP No. 520,938A; and compounds (1) to (31) (columns 2 to 9) represented by formula (1) in EP No. 521,823A.

The present invention can be applied to various color lightsensitive materials such as color negative films for general purposes or cinemas, color reversal films for slides and TV, color paper, color positive films and color reversal paper. Moreover, the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

In the lightsensitive material of the present invention, the total of film thicknesses of all hydrophilic colloid layers on the side having emulsion layers is preferably 28 $\mu$m or less, more preferably 23 $\mu$m or less, still more preferably 18 $\mu$m or less, and most preferably 16 $\mu$m or less. Film swelling speed $T_{1/2}$ is preferably 30 sec or less, more preferably 20 sec or less. The film swelling speed $T_{1/2}$ is defined as the time that, when the saturation film thickness means 90% of the maximum swollen film thickness realized by the processing in a color developing solution at 30° C. for 3 min 15 sec, spent for the film thickness to reach ½ of the saturation film thickness. The film thickness means one measured under moisture conditioning at 25° C. and at a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardening agent to gelatin as a binder or by changing aging conditions after coating. The swelling ratio preferably ranges from 150 to 400%. The swelling ratio can be calculated from the maximum swollen film thickness measured under the above conditions in accordance with the formula:

$$[\text{maximum swollen film thickness} - \text{film thickness}]/\text{film thickness}.$$

In the lightsensitive material of the present invention, hydrophilic colloid layers (called "back layers") having a total dried film thickness of 2 to 20 $\mu$m are preferably formed on the side opposite to the side having emulsion layers. The back layers preferably contain the above light absorbent, filter dye, ultraviolet absorbent, antistatic agent, film hardener, binder, plasticizer, lubricant, coating aid and surfactant. The swelling ratio of the back layers is preferably 150% to 500%.

The lightsensitive material of the present invention can be developed by conventional methods described in the above mentioned RD. No. 17643, pages 28 and 29; RD. No. 18716, page 651, left to right columns; and RD No. 307105, pages 880 and 881, but the lightsensitive material of the present invention it characterized in that is can be processed rapidly.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and much more preferably 0.02 to 0.05 mol per liter (L) of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as preservatives of the color developing solution. When enhanced preserving properties are required, it is preferred to use hydroxylamine derivatives having substituents for example, alkyl, hydroxyalkyl, sulfoalkyl and carboxyalkyl groups, examples of which include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl)hydroxylamine is most preferred. Although these may be used in combination with the hydroxylamine, it is preferred that one or at least two members thereof be used in place of the hydroxylamine.

These preservatives are preferably used in an amount of 0.02 to 0.2 mol, more preferably 0.03 to 0.15 mol, and most preferably 0.04 to 0.1 mol per liter of the color developing solution. The replenisher of the color developing solution preferably contains the preservative in an amount corresponding to 1.1 to 3 times the concentration of the mother liquor (processing tank solution) as in the color developing agent.

Sulfurous salts are used as tarring preventives for the color developing agent in an oxidized form in the color developing solution. Each sulfurous salt is preferably used in the color developing solution in an amount of 0.01 to 0.05 mol, more preferably 0.02 to 0.04 mol per liter, and is preferably used in the replenisher in an amount corresponding to 1.1 to 3 times the above concentration.

The pH value of the color developing solution preferably ranges from 9.8 to 11.0, more preferably from 10.0 to 10.5. That of the replenisher is preferably set at 0.1 to 1.0 higher than the above value. Common buffers such as carbonate, phosphonate, sulfosalicylate and borate are used for stabilizing the above pH value.

Although the amount of the replenisher of the color developing solution preferably ranges from 80 to 1300 mL per $m^2$ of the lightsensitive material, it is desired that the amount be smaller from the viewpoint of reducing environmental pollution load. Specifically, the amount of the replenisher more preferably ranges from 80 to 600 mL, most preferably from 80 to 400 mL.

Although the bromide ion concentration of the color developing solution generally ranges from 0.01 to 0.06 mol per liter, it is preferred that the above concentration be set at 0.015 to 0.03 mol per liter for inhibiting fog while maintaining sensitivity to thereby improve discrimination and for bettering graininess. When the bromide ion concentration is set so as to fall within the above range, the replenisher preferably contains bromide ion in a concentration as calculated by the following formula. However, when C is negative, it is preferred that no bromide ion be contained in the replenisher.

$$C=A-W/V$$

wherein

C: bromide ion concentration of the color developing replenisher (mol/L),

A: target bromide ion concentration of the color developing solution (mol/L),

W: amount of bromide ion leached from the lightsensitive material into the color developing solution when a color development of 1 $m^2$ of the lightsensitive material has been carried out (mol), and V: amount of color developing replenisher supplied per $m^2$ of the lightsensitive material (L).

Development accelerators such as pyrazolidones represented by 1-phenyl-3-pyrazolidone and 1-phenyl-2-methyl-2-hydroxymethyl-3-pyrazolidone and thioether compounds represented by 3,6-dithia-1,8-octanediol are preferably used for means for enhancing sensitivity when the amount of the replenisher has been reduced or when a high bromide ion concentration has been set.

Compounds and processing conditions described on page 4, left lower column, line 16 to page 7, left lower column, line 6 of JP-A-4-125558 can be applied to the processing solution having bleaching capability for use in the present invention. Preferable bleaching agents are those having a redox potential of 150 mV or more, and the specific examples and preferable ones are those described in JP-A'-5-72694 and 5-173312, especially preferably 1,3-diaminopropane tetra-acetic acid, and ferric complex salt of the compound of the specific example 1 set forth on page 7 of JP-A-5-173312.

In addition, bleaching solution containing a ferric salt such as ferric nitrate and persulfate, and 2-pyridinecarboxilic acid or 2,6-piridinedicarboxylic acid described in the publication of EP No. 602600, can also used preferably. When using the bleaching agent, it is preferable to intervene a stop step and a washing step between a color development step and a bleaching step. In the stop solution, organic acids such as acetic acid, succinic acid, maleic acid and adipic acid are preferably used. In addition, the bleaching solution preferably contains organic acids such as acetic acid, succinic acid, maleic acid, glutaric acid and adipic acid is in the range of 0.1 to 2 mol/L for pH adjustment and bleach fogging.

For improving the biodegradability of the bleaching agent, it is preferred that ferric complex salts of compounds listed in JP-A's-4-251845, and 4-268552, EP Nos. 588,289, and 591,934 and JP-A-6-208213 be used as the bleaching agent. The concentration of the above bleaching agent preferably ranges from 0.05 to 0.3 mol per liter of the solution having bleaching capability, and it is especially preferred that a design be made at 0.1 to 0.15 mol per liter for reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally in a concentration calculated by the following formula. This enables holding the concentration of the mother liquor constant.

$$C_R=C_T\times(V_1+V_2)/V_1+C_P$$

$C_R$: concentration of each component in the replenisher, $C_T$: concentration of the component in the mother liquor (processing tank solution), $C_P$: component concentration consumed during processing, $V_1$: amount of replenisher having bleaching capability supplied per $m^2$ of lightsensitive material (mL), and $V_2$: amount carried from previous bath by 1 $m^2$ of lightsensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and much more preferably 100 to 300 mL, of a bleaching replenisher per $m^2$ of the lightsensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of p-toluenesulfinic salts and sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the bleach ability, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and especially preferably 200 to 600 mL, per $m^2$ of the lightsensitive material.

Silver is preferably recovered by installing any of various silver recovering devices in an in-line or off-line mode in the bleach-fix or fixation step. In-line installation enables processing with the silver concentration of the solution lowered, so that the amount of replenisher can be reduced. It is also suitable to conduct an off-line silver recovery and recycle residual solution for use as a replenisher.

The bleach-fix and fixation steps can each be constructed by a plurality of processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to water washing and stabilization steps. In particular, with respect to stabilizing solutions, the use of azolylmethylamines described in EP Nos. 504,609 and 519,190 and N-methylolazoles described in JP-A-4-362943 in place of formaldehyde and the dimerization of magenta coupler into a surfactant solution not containing an image stabilizer such as formaldehyde are preferred from the viewpoint of protecting working environment.

To reduce adhesion of dust to a magnetic recording layer formed on a lightsensitive material, a stabilizer described in JP-A-6-289559 can be preferably used.

The replenishment rate of washing water and a stabilizer is preferably 80 to 1,000 mL, more preferably, 100 to 500 mL, and most preferably, 150 to 300 mL per $m^2$ of a lightsensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A's-3-46652, 3-53246, 3-55542, 3-121448, and 3-126030. A reverse permeable membrane used in this processing is preferably a low-pressure reverse permeable membrane.

In the processing of the present invention, it is particularly preferable to perform processing solution evaporation correction disclosed in Journal of Technical Disclosure No. 94-4992. In particular, a method of performing correction on the basis of (formula-1) on page 2 by using temperature and humidity information of an environment in which a processor is installed is preferable. Water for use in this evaporation correction is preferably taken from the washing water replenishment tank. If this is the case, deionized water is preferably used as the washing replenishing water.

Processing agents described in aforementioned Journal of Technical Disclosure No. 94-4992, page 3, right column, line 15 to page 4, left column, line 32 are preferably used in the present invention. As a processor for these processing agents, a film processor described on page 3, right column, lines 22 to 28 is preferable.

Practical examples of processing agents, automatic processors, and evaporation correction methods suited to practicing the present invention are described in the same Journal of Technical Disclosure No. 94-4992, page 5, right column, line 11 to page 7, right column, last line.

Processing agents used in the present invention can be supplied in any form: a liquid agent having the concentration of a solution to be used, concentrated liquid agent, granules, powder, tablets, paste, and emulsion. Examples of such processing agents are a liquid agent contained in a low-oxygen permeable vessel disclosed in JP-A-63-17453, vacuum-packed powders and granules disclosed in JP-A's-4-19655 and 4-230748, granules containing a water-soluble polymer disclosed in JP-A-4-221951, tablets disclosed in JP-A's-51-61837 and 6-102628, and a paste disclosed in PCT KOHYO Publication No. 57-500485. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen permeable material is preferable. More specifically, polyethyleneterephthalate or a composite material of polyethylene and nylon is preferable. A vessel made of any of these materials preferably has a thickness of 500 to 1,500 $\mu$m and an oxygen permeability of 20 mL/m$^2$·24 hrs·atm or less.

Color reversal film processing solutions used in the present invention will be described below. Processing for a color reversal film is described in detail in Aztech Ltd., Known Technology No. 6 (Apr. 1, 1991), page 1, line 5 to page 10, line 5 and page 15, line 8 to page 24, line 2, and any of the contents can be preferably applied. In this color reversal film processing, an image stabilizing agent is contained in a control bath or a final bath. Preferable examples of this image stabilizing agent are formalin, sodium formaldehyde-bisulfite, and N-methylolazole. Sodium formaldehyde-bisulfite or N-methylolazole is preferable in terms of work environment, and N-methyloltriazole is particularly preferable as N-methylolazole. The contents pertaining to a color developer, bleaching solution, fixing solution, and washing water described in the color negative film processing can be preferably applied to the color reversal film processing.

Preferable examples of color reversal film processing agents containing the above contents are an E-6 processing agent manufactured by Eastman Kodak Co. and a CR-56 processing agent manufactured by Fuji Photo Film Co., Ltd.

A color photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300Z. A color photosensitive film of the present invention is also suited as a film with lens such as Fuji Film FUJICOLOR UTSURUNDESU (Quick Snap) SUPER SLIM.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)
(5) Printing (prints of three types C, H, and P and an index print are continuously automatically printed on color paper [preferably Fuji Film SUPER FA8])
(6) Collation and shipment (the cartridge and the index print are collated by an ID number and shipped together with the prints)

As these systems, the Fuji Film MINILABO CHAMPION SUPER FA-298, FA-278, FA-258, FA-238 are preferable. Examples of a film processor are the FP922AL, FP562B, FP562BL, FP362B, and FP3622BL, and a recommended processing chemical is the FUJICOLOR JUST-IT CN-16L. Examples of a printer processor are the PP3008AR, PP3008A, PP1828AR, PP1828A, PP1258AR, PP1258A, PP728AR, and PP728A, and a recommended processing chemical is the FUJICOLOR JUST-IT CP-47L. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image scanner. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Oobtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

EXAMPLES

Example 1

Emulsion A-1: (111) silver iodobromide tabular emulsion

Gelatin 1-4 used for the dispersing medium in the emulsion preparation set forth below have the following characteristics:

Gelatin-1: Conventional alkali-processed ossein gelatin made from bovine bones. No —$NH_2$ group in the gelatin was chemically modified.

Gelatin-2: Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified —$NH_2$ groups in the gelatin was 95%.

Gelatin-3: Gelatin formed by adding trimellitic anhydride to an aqueous solution of gelatin-1 at 50° C. and pH 9.0 to cause chemical reaction, removing the residual trimellitic acid, and drying the resultant material. The ratio of the number of chemically modified —$NH_2$ groups in the gelatin was 95%.

Gelatin-4: Gelatin formed by decreasing the molecular weight of gelatin-1 by allowing enzyme to act on it such that the average molecular weight was 15,000, deactivating the enzyme, and drying the resultant material. No —$NH_2$ group in the gelatin was chemically modified.

All of gelatin-1 to gelatin-4 described above were deionized and so adjusted that the pH of an aqueous 5% solution at 35° C. was 6.0.

(Preparation of Emulsion A-1)

1,300 mL of an aqueous solution containing 1.0 g of KBr and 1.1 g of gelatin-4 described above was stirred at 35° C. (1st solution preparation). 38 mL of an aqueous solution Ag-1 (containing 4.9 g of $AgNO_3$ in 100 mL), 29 mL of an aqueous solution X-1 (containing 5.2 g of KBr in 100 mL), and 8.5 mL of an aqueous solution G-1 (containing 8.0 g of gelatin-4 described above in 100 mL) were added over 30 sec at fixed flow rates by the triple jet method (addition 1). After that, 6.5 g of KBr were added, and the temperature was raised to 75° C. After a ripening step was performed for 12 min, 300 mL of an aqueous solution G-2 (containing 6 g of gelatin-2 described above and 6 g of gelatin-4 described above in 100 mL) were added. In a case where reduction sensitization should be performed, 2.1 g of 4,5-dihydroxy-1,3-disodium disulfonate-monohydrate and 0.002 g of thiourea dioxide were sequentially added at an interval of 1 min.

Next, 157 mL of an aqueous solution Ag-2 (containing 22.1 g of $AgNO_3$ in 100 mL) and an aqueous solution X-2 (containing 15.5 g of KBr in 100 mL) were added over 14 min by the double jet method. The flow rate of the aqueous solution Ag-2 during the addition was accelerated such that the final flow rate was 3.4 times the initial flow rate. Also, the aqueous solution X-2 was so added that the pAg of the bulk emulsion solution in the reaction vessel was held at 8.30 (addition 2). Subsequently, 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 27 min by the double jet method. The flow rate of the aqueous solution Ag-3 during the addition was accelerated such that the final flow rate was 1.6 times the initial flow rate. Also, the aqueous solution X-3 was so added that the pAg of the bulk emulsion solution in the reaction vessel was held at 8.30 (addition 3). Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double jet method. The addition of the aqueous solution Ag-4 was performed at a fixed flow rate. The addition of the aqueous solution X-4 was so performed that the pAg of the bulk emulsion solution in the reaction vessel was held at 7.52 (addition 4).

After that, 0.0025 g of sodium benzenethiosulfonate and 125 mL of an aqueous solution G-3 (containing 12.0 g of gelatin-1 described above in 100 mL) were sequentially added at an interval of 1 min. 43.7 g of KBr were then added to adjust the pAg of the bulk emulsion solution in the reaction vessel to 9.00. 73.9 g of an AgI fine grain emulsion (containing 13.0 g of AgI fine grains having an average grain size of 0.047 $\mu$m in 100 g) were added. Two minutes after that, 249 mL of the aqueous solution Ag-4 and the aqueous solution X-4 were added by the double jet method. The addition of the aqueous solution Ag-4 was performed at a fixed flow rate over 9 min. The addition of the aqueous solution X-4 was performed only for the first 3.3 min such that the pAg of the bulk emulsion solution in the reaction vessel was held at 9.00. For the remaining 5.7 min the aqueous solution X-4 was not added so that the pAg of the bulk emulsion solution in the reaction vessel was finally 8.4 (addition 5). After that, desalting was performed by normal flocculation. Water, NaOH, and gelatin-1 described above were added under stirring, and the pH and the pAg were adjusted to 6.4 and 8.6, respectively, at 56° C.

The thus prepared emulsion had an equivalent sphere diameter of 0.99 $\mu$m, a grain volume weighted average aspect ratio of 12.5, and were occupied by silver halide grains having an aspect ratio of 12.5 or more in an amount of 50 or more of the total projected area, had an average AgI content of 3.94 mol %, were comprised of tabular silver halide grains whose parallel main planes were (111) plane, and had the AgI content measured by XPS of the silver halide grain surface of 2.6 mol %.

Subsequently, the compound of the general formula (1) or general formula (2) according to the present invention (whether or not addition was made was indicated in the Table 2 below), the following sensitizing dye ExS-1, potassium thiocyanate, chloroauric acid, sodium thiosulfate and N,N-dimethylselenourea were sequentially added to thereby attain the optimum chemical sensitization. Thereafter, a 4:1 mixture of the following water-soluble mercapto compounds MER-1 and MER-2 were added in a total amount of $3.6\times10^{-4}$ mol per mol of silver halides to thereby complete the chemical sensitization. With respect to the emulsion A-1, the optimum chemical sensitization was attained when the addition amount of ExS-1 was $6.41\times10^{-4}$ mol per mol of silver halides.

ExS-1

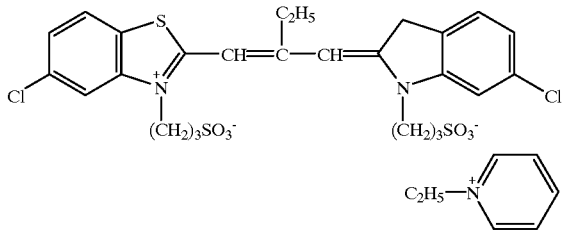

MER-1

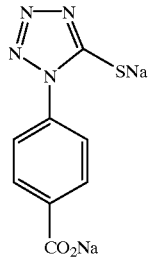

MER-2

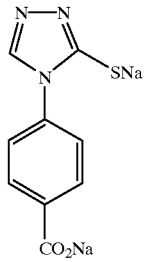

The above emulsion A-1 was observed by the use of a 400 kV transmission electron microscope at liquid nitrogen temperature. As a result, it was found that each individual grain thereof had 10 or more dislocation lines at fringe portions of tabular grains thereof.

Further, the above emulsion A-1 became a red-sensitive silver halide emulsion whose wavelength maximizing a spectral sensitivity was 652 nm as a result of the addition of sensitizing dye ExS-1 conducted at the chemical sensitization step in the preparation of the above emulsion so as to effect a spectral sensitization.

A support of cellulose triacetate film furnished with a substratum was coated under the following coating conditions listed in the following Table 1.

TABLE 1

(Emulsion coating conditions)

(1) Emulsion layer

Emulsion: each of the emulsions
(In terms of silver $1.63 \times 10^{-2}$ mol/m$^2$)
Coupler ($2.26 \times 10^{-3}$ mol/m$^2$)

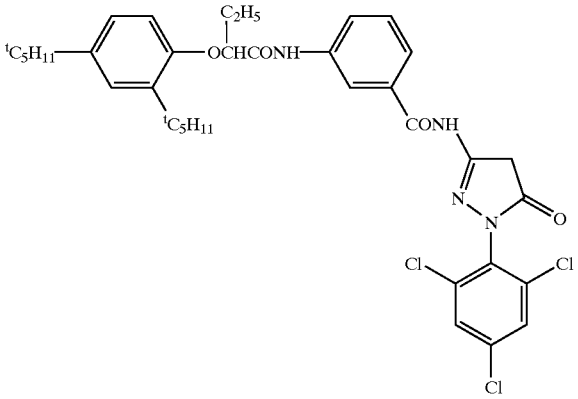

| | |
|---|---|
| Tricresyo phosphate | (1.32 g/m$^2$) |
| Gelatin | (3.24 g/m$^2$) |

(2) Protective layer

| | |
|---|---|
| Sodium salt of 2,4-dichloro-6-hydroxy-s-triazine | (0.08 g/m$^2$) |
| Gelatin | (1.80 g/m$^2$) |

Samples 101 to 115 were prepared using emulsions changed as specified in Table 2. Whether or not a reduction sensitizer was used in the grain formation step was indicated in the table. Reflection spectrum of each coating sample was obtained, and the absorption peaks of sensitizing dye were measured. The extent of short wave shift (nm) of absorption peaks caused by the addition of an organic compound exhibiting no absorption in the visible light region was listed in the table.

These samples were hardened at 40° C. in a relative humidity of 70% for 14 hr. Thereafter, exposure thereof was conducted through gelatin filter SC-50 (long-wave light transmission filter of 500 nm cutoff wavelength) produced by Fuji Photo Film Co., Ltd. and a continuous wedge for 1/100 sec. The resultant samples were developed under the following conditions, and subjected to density measurement through a green filter so as to evaluate the photographic performance thereof.

The development was carried out by means of automatic processor FP-362B manufactured by Fuji Photo Film Co., Ltd., as follows.

The processing steps and the processing solution compositions are presented below.

(Processing Steps)

| Step | Time | Temperature | Replenishment rate* | Tank volume |
|---|---|---|---|---|
| Color development | 3 min 5 sec | 38.0° C. | 15 mL | 10.3 L |
| Bleaching | 50 sec | 38° C. | 5 mL | 3.6 L |
| Fixing (1) | 50 sec | 38° C. | — | 3.6 L |
| Fixing (2) | 50 sec | 38° C. | 7.5 mL | 3.6 L |
| Stabilization (1) | 30 sec | 38° C. | — | 1.9 L |
| Stabilization (2) | 20 sec | 38° C. | — | 1.9 L |
| Stabilization (3) | 20 sec | 38° C. | 30 mL | 1.9 L |
| Drying | 1 min 30 sec | 60° C. | | |

*The replenishment rate was per 1.1 m of a 35-mm wide sensitized material (equivalent to one roll of 24 Ex.)

The stabilizer was counterflowed in the order of (3)→(2)→(1), and the fixer was also connected from (2) to (1) by counterflow piping. Also, the tank solution of stabilizer (2) was supplied to fixer (2) in an amount of 15 mL as a replenishment rate. Additionally, as the developer a color developer (A) replenisher and a color developer (B) replenisher having the following compositions were replenished in amounts of 12 mL and 3 mL, respectively, i.e., a total of 15 mL, as a replenishment rate. Note that the amounts of the developer, bleaching solution, and fixer carried over to the bleaching step, fixing step, and washing step, respectively, were 2.0 mL per 1.1 m of a 35-mm wide sensitized material. Note also that each crossover time was 6 sec, and this time was included in the processing time of each preceding step.

The compositions of the processing solutions are presented below.

| (Color developer (A)) | [Tank solution] | [Replenisher] |
|---|---|---|
| Diethylenetriamine pentaacetic acid | 2.0 g | 4.0 g |
| Sodium 4,5-dihydroxy benzene-1,3-disulfonate | 0.4 g | 0.5 g |
| Disodium-N,N-bis(2-sulfonateethyl) hydroxylamine | 10.0 g | 15.0 g |
| Sodium sulfite | 4.0 g | 9.0 g |
| Hydroxylamine sulfate | 2.0 g | — |
| Potassium bromide | 1.4 g | — |
| Diethyleneglycol | 10.0 g | 17.0 g |
| Ethyleneurea | 3.0 g | 5.5 g |
| 2-methyl-4-[N-ethyl-N-(β-hydroxyethyl)amino] aniline sulfate | 4.7 g | 11.4 g |
| Potassium carbonate | 39 g | 59 g |
| Water to make | 1.0 L | 1.0 L |
| pH (controlled by sulfuric acid and KOH) | 10.05 | 10.50 |

The above tank solution indicates the composition after (color developer (B)) below was mixed.

| (Color developer (B)) | [Tank solution] | [Replenisher] |
|---|---|---|
| Hydroxylamine sulfate | 2.0 g | 4.0 g |
| Water to make | 1.0 L | 1.0 L |

-continued

| (Color developer (B)) | [Tank solution] | [Replenisher] |
|---|---|---|
| pH (controlled by sulfuric acid and KOH) | 10.05 | 4.0 |

The above tank solution indicates the composition after (color developer (A)) described above was mixed.

| (Bleaching solution) | [Tank solution] | [Replenisher] |
|---|---|---|
| Ferric ammonium 1,3-diaminopropanetetra acetate monohydrate | 120 g | 180 g |
| Ammonium bromide | 50 g | 70 g |
| Succinic acid | 30 g | 50 g |
| Maleic acid | 40 g | 60 g |
| Imidazole | 20 g | 30 g |
| Water to make | 1.0 L | 1.0 L |
| pH (controlled by ammonia water and nitric acid) | 4.6 | 4.0 |

| (Fixer) | [Tank solution] | [Replenisher] |
|---|---|---|
| Ammonium thiosulfate (750 g/L) | 280 mL | 1,000 mL |
| Aqueous ammonium bisulfite solution (72%) | 20 g | 80 g |
| Imidazole | 5 g | 45 g |

-continued

| | | |
|---|---|---|
| 1-mercapto-2-(N,N-dimethylaminoethyl)-tetrazole | 1 g | 3 g |
| Ethylenediamine tetraacetic acid | 8 g | 12 g |
| Water to make | 1 L | 1 L |
| pH (controlled by ammonia water and nitric acid) | 7.0 | 7.0 |

| (Stabilizer) | [Common to tank solution and replenisher] |
|---|---|
| Sodium p-toluenesulfinate | 0.03 g |
| p-Nonylphenoxypolyglycidol (glycidol average polymerization degree 10) | 0.4 g |
| Disodium ethylenediaminetetraacetate | 0.05 g |
| 1,2,4-triazole | 1.3 g |
| 1,4-bis(1,2,4-triazole-1-isomethyl) piperazine | 0.75 g |
| 1,2-benzoisothiazoline-3-one | 0.10 g |
| Water to make | 1.0 L |
| pH | 8.5 |

Table 2 below shows the results of evaluations performed by the above method. The sensitivity is represented by a relative value of the reciprocal of an exposure amount necessary to reach a density of fog density plus 0.2 (sensitivity of the sample 101 was assumed to be 100).

TABLE 2

| Sample No. | Emulsion used for sample preparation: Emulsion No. | Reduction sensitization | Compounds added to emulsion: Compound No. | Addition amount per sensitizing dye (mol %) | Shortened wavelength of the absorption peak of sensitizing dye (nm) | Photographic performance: Sensitivity | Fog density | Remarks |
|---|---|---|---|---|---|---|---|---|
| 101 | A-1 | Performed | none | — | 0 | 100 | 0.29 | Comp. |
| 102 | A-1 | Performed | I-1 | 2 | 2 | 112 | 0.26 | Inv. |
| 103 | A-1 | Performed | I-1 | 5 | 3 | 119 | 0.25 | Inv. |
| 104 | A-1 | Performed | I-1 | 10 | 3 | 122 | 0.26 | Inv. |
| 105 | A-1 | Performed | I-1 | 25 | 4 | 119 | 0.28 | Inv. |
| 106 | A-1 | Performed | I-1 | 50 | 5 | 113 | 0.27 | Inv. |
| 107 | A-1 | Performed | 1-2 | 2 | 2 | 119 | 0.26 | Inv. |
| 108 | A-1 | Performed | 1-2 | 5 | 3 | 126 | 0.25 | Inv. |
| 109 | A-1 | Performed | 1-2 | 10 | 4 | 129 | 0.26 | Inv. |
| 110 | A-1 | Performed | 1-2 | 25 | 5 | 125 | 0.27 | Inv. |
| 111 | A-1 | Performed | 1-2 | 50 | 7 | 117 | 0.28 | Inv. |
| 112 | A-1 | Performed | 1-5 | 10 | 3 | 118 | 0.27 | Inv. |
| 113 | A-1 | Performed | 1-7 | 10 | 3 | 117 | 0.26 | Inv. |
| 114 | A-1 | Performed | 1-9 | 10 | 4 | 116 | 0.26 | Inv. |
| 115 | A-1 | Performed | I-11 | 10 | 4 | 115 | 0.27 | Inv. |

Sensitivity is expressed in relative value, assuming the sensitivity of Sample 101 to be 100.

The following is apparent from the results of Table 2. That is, a comparison between type sample 101 and the samples 102 to 115 of the present invention shows that the samples of the present invention whose sensitizing dye absorption peaks underwent a wavelength shift toward a shorter wavelength side by 2 nm or more exerted a striking sensitivity increase effect without any increase of fog density. It is also apparent that the addition amount of organic compound exhibiting no absorption in the visible light region preferably ranged from 2 to 25 mol % based on sensitizing dye.

Example 2

Emulsion B-1: (100) silver iodobromide tabular emulsion

An aqueous solution of polyvinyl alcohol (polyvinyl alcohol from polyvinyl acetate of 1700 polymerization degree at an average ratio of saponification to alcohol of 98%, hereinafter referred to as polymer (PV)) and gelatin (5 g of polymer (PV) and 8 g of deionized alkali-treated gelatin contained in 1200 mL of water) was placed in a reaction vessel. The pH value of the aqueous solution was adjusted to 11, and the temperature thereof was maintained at 55° C. Under agitation, 200 mL of Ag-1 solution (containing 0.58 mol/L of $AgNO_3$) and 200 mL of X-1 solution (containing 0.58 mol/L of KBr) were added to the aqueous solution over a period of 40 min. The addition was carried out by means of a precision liquid feed pump according to the double jet method. The temperature of the solution was immediately raised from 55° C. to 75° C.

In the case where reduction sensitization is performed, 2 g of disodium 4,5-dihydroxy-1,3-disulfonate monohydrate and 0.002 g of thiourea dioxide were added at this time. After the lapse of 5 min, the pH value of the mixture was adjusted to 6. Subsequently, 600 mL of each of Ag-2 solution (containing 1.177 mol/L of $AgNO_3$) and X-2 solution (containing 1.177 mol/L of KBr) were added by the double jet at a constant flow rate of 12 mL/min while maintaining the pBr of the mixture at 3.1. Thereafter, an aqueous solution of gelatin (30 g of gelatin contained in 200 mL of water) and spectral sensitizing dyes ExS-2, ExS-3 and ExS-4 were added, and 100 mL of each of Ag-3 solution (containing 2.94 mol/L of $AgNO_3$) and X-3 solution (containing 2.7 mol/L of KBr and 0.24 mol/L of KI) were added at 5 mL/min. Thus, a grain formation was completed. Thereafter, the temperature of the emulsion was lowered to 35° C., and the emulsion was washed by the precipitation washing method. An aqueous solution of gelatin was added to re-disperse the emulsion, the pH and pAg of which were adjusted to 6 and 8.3, respectively.

ExS-2

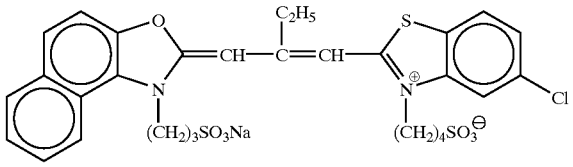

ExS-3

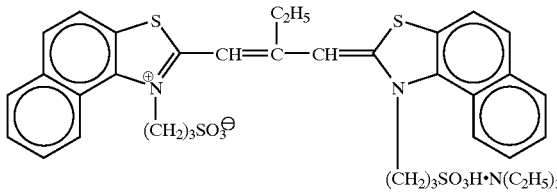

ExS-4

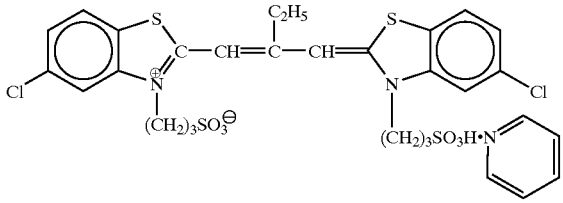

As a result of analyses of replica TEM images of emulsion grains, it was found that the thus prepared grains, at a ratio of 93% to the total projected area, were occupied by grains having (100) faces as main planes, having an equivalent sphere diameter of 0.4 μm or more, having a thickness of 0.08 μm or less, and having an aspect ratio of 9.5 or more.

Samples 201 to 215 were prepared under the same coating conditions as in Example 1, except that the applied emulsion was modified as specified in Table 3. The same development processing as in Example 1 was carried out, and the photographic performance was evaluated (providing that the sensitivity of sample 201 was 100).

TABLE 3

| Sample No. | Emulsion used for sample preparation: Emulsion No. | Reduction sensitization | Compounds added to emulsion: Compound No. | Addition amount per sensitizing dye (mol %) | Shortened wavelength of the absorption peak of sensitizing dye (nm) | Photographic performance: Sensitivity | Fog density | Remarks |
|---|---|---|---|---|---|---|---|---|
| 201 | B-1 | Performed | none | — | 0 | 100 | 0.29 | Comp. |
| 202 | B-1 | Performed | I-1 | 10 | 4 | 120 | 0.26 | Inv. |
| 203 | B-1 | Performed | I-2 | 10 | 4 | 125 | 0.25 | Inv. |
| 204 | B-1 | Performed | I-3 | 10 | 3 | 118 | 0.26 | Inv. |
| 205 | B-1 | Performed | I-4 | 10 | 3 | 116 | 0.28 | Inv. |
| 206 | B-1 | Performed | I-5 | 10 | 2 | 115 | 0.25 | Inv. |
| 207 | B-1 | Performed | I-6 | 10 | 3 | 113 | 0.26 | Inv. |
| 208 | B-1 | Performed | I-7 | 10 | 4 | 117 | 0.28 | Inv. |
| 209 | B-1 | Performed | I-8 | 10 | 4 | 114 | 0.27 | Inv. |
| 210 | B-1 | Performed | I-9 | 10 | 4 | 114 | 0.26 | Inv. |
| 211 | B-1 | Performed | I-10 | 10 | 3 | 113 | 0.25 | Inv. |
| 212 | B-1 | Performed | I-11 | 10 | 4 | 117 | 0.26 | Inv. |

TABLE 3-continued

| Sample No. | Emulsion used for sample preparation: Emulsion No. | Reduction sensitization | Compounds added to emulsion: Compound No. | Addition amount per sensitizing dye (mol %) | Shortened wavelength of the absorption peak of sensitizing dye (nm) | Photographic performance: Sensitivity | Fog density | Remarks |
|---|---|---|---|---|---|---|---|---|
| 213 | B-1 | Performed | I-13 | 10 | 3 | 114 | 0.25 | Inv. |
| 214 | B-1 | Performed | I-15 | 10 | 3 | 112 | 0.27 | Inv. |
| 215 | B-1 | Performed | I-17 | 10 | 4 | 110 | 0.26 | Inv. |

Sensitivity is expressed in relative value, assuming the sensitivity of Sample 201 to be 100.

The following is apparent from the results of Table 3. That is, a comparison among samples 201 to 215 shows that the samples of the present invention whose sensitizing dye absorption peaks underwent a wavelength shift forward a shorter side by 2 nm or more exerted a striking sensitivity increase effect without any increase of fog density.

Example 3

Emulsion C-1: (111) silver chloride tabular grains 2.0 g of sodium chloride and 2.8 g of inert gelatin were added to 1.2 L of water in a vessel, and maintained at 35° C. Under agitation, 60 mL of an aqueous solution of silver nitrate (9 g of silver nitrate) and 60 mL of an aqueous solution of sodium chloride (3.2 g of sodium chloride) were added thereto within 1 min by the double jet method. One minute after the completion of the addition, 0.8 mmol of N-benzyl-4-phenylpyridinium chloride was added. Further, one minute later, 3.0 g of sodium chloride was added. Thereafter, the temperature of the reaction vessel was raised to 60° C. over a period of 25 min. The mixture was ripened at 60° C. for 16 min. 560 g of a 10% aqueous solution of gelatin phthalate and $1\times10^{-5}$ mol of sodium thiosulfonate were added. In the care where a reduction sensitization is performed, 2 g of disodium 4,5-dihydroxy-1,3-disulfonate monohydrate and 0.002 g of thiourea dioxide were added to the mixture at this time. Thereafter, 317.5 mL of an aqueous solution of silver nitrate (127 g of silver nitrate), 317.5 mL of an aqueous solution of sodium chloride (containing 54.1 g of sodium chloride and $2\times10^{-8}$ mol of iridium hexachloride) and 160 mL of an aqueous solution of crystal habit-controlling agent 1 (M/50) were added at accelerated flow rates over a period of 20 min. Further, over a period of 5 min starting from 2 min later, an aqueous solution of silver nitrate (34 g of silver nitrate) and an aqueous solution of sodium chloride (11.6 g of sodium chloride and 1.27 mg of yellow prussiate of potash) were added. Still further, 33.5 mL of a 0.1 N thiocyanic acid solution, 0.32 mmol of sensitizing dye A, 0.48 mmol of sensitizing dye B and 0.05 mmol of sensitizing dye C were added.

Sensitizing dye A

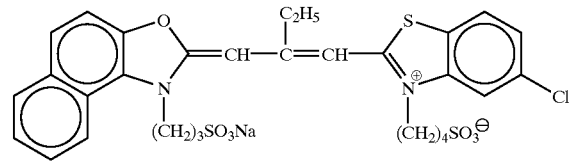

Sensitizing dye B

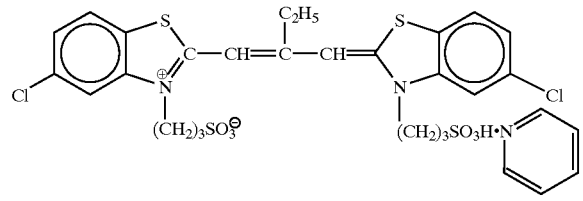

Sensitizing dye C

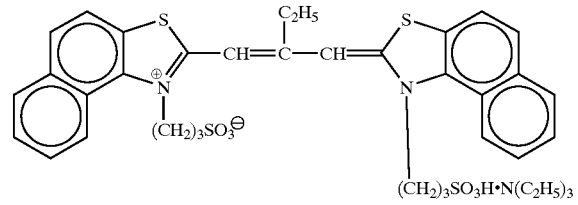

The temperature of the obtained emulsion was lowered to 40° C., and desalting was performed by the customary flocculation method, followed by washing. After the washing, 67 g of gelatin, 80 mL of phenol (5%) and 150 mL of distilled water were added. The pH and pAg values of the emulsion were adjusted to 6.2 and 7.5, respectively, by the use of sodium hydroxide and silver nitrate solutions.

Tabular grains having an equivalent circle diameter of 0.95 to 1.15 μm, a thickness of 0.12 to 0.16 μm and an equivalent sphere diameter of 0.56 to 0.66 μm occupied 50% or more of the total projected area of the thus obtained emulsion.

Samples 301 to 315 were prepared under the same coating conditions as in Example 1, except that the applied emulsion was modified as specified in Table 4. The same development processing as in Example 1 was carried out, and the photographic performance was evaluated (providing that the sensitivity of sample 301 was 100).

TABLE 4

| Sample No. | Emulsion used for sample preparation: Emulsion No. | Reduction sensitization | Compounds added to emulsion: Compound No. | Addition amount per sensitizing dye (mol %) | Shortened wavelength of the absorption peak of sensitizing dye (nm) | Photographic performance: Sensitivity | Fog density | Remarks |
|---|---|---|---|---|---|---|---|---|
| 301 | C-1 | not performed | none | — | 0 | 100 | 0.29 | Comp. |
| 302 | C-1 | not performed | I-1 | 10 | 4 | 120 | 0.26 | mv. |
| 303 | C-1 | not performed | I-2 | 10 | 4 | 122 | 0.25 | Inv. |
| 304 | C-1 | not performed | I-3 | 10 | 2 | 113 | 0.26 | Inv |
| 305 | C-1 | not performed | I-4 | 10 | 3 | 117 | 0.28 | Inv |
| 306 | C-1 | not performed | I-5 | 10 | 4 | 114 | 0.27 | Inv. |
| 307 | C-1 | not performed | I-6 | 10 | 4 | 114 | 0.26 | Inv. |
| 308 | C-1 | not performed | I-7 | 10 | 3 | 112 | 0.25 | Inv. |
| 309 | C-1 | not performed | I-8 | 10 | 3 | 114 | 0.26 | Inv. |
| 310 | C-1 | not performed | I-9 | 10 | 4 | 114 | 0.27 | Inv. |
| 311 | C-1 | not performed | I-10 | 10 | 4 | 114 | 0.28 | Inv. |
| 312 | C-1 | not performed | I-11 | 10 | 4 | 113 | 0.27 | Inv. |
| 313 | C-1 | not performed | I-12 | 10 | 4 | 114 | 0.26 | Inv. |
| 314 | C-1 | not performed | 1-14 | 10 | 4 | 112 | 0.26 | Inv. |
| 315 | C-1 | not performed | I-16 | 10 | 3 | 110 | 0.27 | Inv. |

Sensitivity is expressed in relative value, assuming the sensitivity of Sample 301 to be 100.

The following is apparent from the results of Table 4. That is, a comparison among samples 301 to 315 shows that the samples of the present invention whose sensitizing dye absorption peaks underwent a wavelength shift toward a shorter wavelength side by 2 nm or more exerted a striking sensitivity increase effect without any increase of fog density.

Example 4

Emulsion D-1: (100) silver chloride tabular grains containing 0.4 mol %, based on total silver quantity, of iodide in the shell portion.

1200 mL of water, 25 g of gelatin (deionized alkali-treated bone gelatin having a methionine content of about 40 μmol/g), 0.4 g of sodium chloride and 4.5 mL of a 1N nitric acid solution were placed in a reaction vessel (pH: 4.5), and maintained at 40° C. Under vigorous agitation, Ag-1 solution (0.2 g/mL of silver nitrate) and X-1 solution (0.069 g/mL of sodium chloride) were added and mixed at 48 mL/min over a period of 4 min. 15 sec later, 150 ml of an aqueous solution of polyvinyl alcohol (polyvinyl alcohol from polyvinyl acetate of 1700 average polymerization degree at an average ratio of saponification to alcohol of 98% or more (hereinafter referred to as PVA-1); 6.7 g thereof contained in 1 L of water) was added, and the pH value thereof was adjusted to 3.5. The temperature of the mixture was raised to 75° C. over a period of 15 min, and the pH value thereof was adjusted to 6.5 by the addition of 23 mL of a 1N sodium hydroxide solution. Further, 4.0 mL of 1-(5-methylureidophenyl)-5-mercaptotetrazole (0.05%) and 4.0 mL of N,N'-dimethylimidazolidine-2-thione (1% aqueous solution) were added.

In the case where a reduction sensitization is performed, disodium 4,5-dihydroxy-1,3-disulfonate monohydrate and thiourea dioxide were added to the mixture. 4 g of sodium chloride was added, thereby adjusting the silver potential (against room temperature saturated calomel electrode) to 100 mV. Thereafter, for growth, the Ag-1 solution and the X-1 solution were simultaneously added over a period of 15 min while linearly increasing the flow rate from 40 mL/min to 42 mL/min and while maintaining the silver potential at 100 mV. Further, 12.5 mL of a 1N nitric acid solution was added to thereby adjust the pH value to 4.0, and 28.8 g of sodium chloride was added to thereby adjust the silver potential to 60 mV. Thereafter, 0.38 mmol of sensitizing dye A, 0.56 mmol of sensitizing dye B and 0.06 mmol of sensitizing dye C were added. Ag-2 solution (0.1 g/mL of silver nitrate) and X-2 solution (aqueous solution containing, per L, 33.8 g of sodium chloride and 1.95 g of potassium iodide so that the addition amount of iodide was 0.4 mol % based on total silver quantity) were added at a flow rate of 40 mL/min for 10 min, and thereafter allowed to stand still at 75° C. for 10 min.

Thereafter, precipitation washing was performed at 40° C. to thereby effect desalting. 79 g of gelatin was added to re-disperse the emulsion, the pH and pAg of which were adjusted to 6.0 and 7.3, respectively. An aliquot of the emulsion was harvested, and electron micrograph images (TEM images) of grain replica were observed. As a result, it was found that tabular grains having (100) faces as main planes, having an equivalent sphere diameter of 0.4 to 0.5 μm, having a thickness of 0.10 to 0.12 μm, having an aspect ratio of 6.5 or more and a neighboring side ratio of 1.1 to 1.3 occupied 50% or more of the total projected area of grains.

Samples 401 to 415 were prepared under the same coating conditions as in Example 1, except that the applied emulsion was modified as specified in Table 5. The same development processing as in Example 1 was carried out, and the photographic performance was evaluated (providing that the sensitivity of sample 401 was 100).

TABLE 5

| Sample No. | Emulsion used for sample preparation: Emulsion No. | Reduction sensitization | Compounds added to emulsion: Compound No. | Addition amount per sensitizing dye (mol %) | Shortened wavelength of the absorption peak of sensitizing dye (nm) | Photographic performance: Sensitivity | Fog density | Remarks |
|---|---|---|---|---|---|---|---|---|
| 401 | D-1 | Performed | none | — | 0 | 100 | 0.29 | Comp. |
| 402 | D-2 | Performed | I-1 | 10 | 4 | 123 | 0.26 | Inv. |
| 403 | D-3 | Performed | I-2 | 10 | 5 | 124 | 0.25 | Inv. |
| 404 | D-4 | Performed | I-3 | 10 | 3 | 116 | 0.26 | Inv. |
| 405 | D-5 | Performed | I-4 | 10 | 3 | 115 | 0.28 | Inv. |
| 406 | D-6 | Performed | I-5 | 10 | 4 | 112 | 0.25 | Inv. |
| 407 | D-7 | Performed | I-6 | 10 | 3 | 114 | 0.26 | Inv. |
| 408 | D-8 | Performed | I-7 | 10 | 3 | 114 | 0.27 | Inv. |
| 409 | D-9 | Performed | I-8 | 10 | 4 | 114 | 0.26 | Inv. |
| 410 | D-10 | Performed | I-9 | 10 | 3 | 112 | 0.26 | Inv. |
| 411 | D-11 | Performed | I-10 | 10 | 4 | 114 | 0.28 | Inv. |
| 412 | D-12 | Performed | I-11 | 10 | 3 | 113 | 0.27 | Inv. |
| 413 | D-13 | Performed | I-12 | 10 | 4 | 114 | 0.26 | Inv. |
| 414 | D-14 | Performed | I-13 | 10 | 3 | 112 | 0.26 | Inv. |
| 415 | D-15 | Performed | I-14 | 10 | 3 | 111 | 0.27 | Inv. |

Sensitivity is expressed in relative value, assuming the sensitivity of Sample 401 to be 100.

The following is apparent from the results of Table 5. That is, samples 401 to 415 show that the samples of the present invention whose sensitizing dye absorption peaks underwent a wavelength shift toward a shorter side by 2 nm or more exerted a striking sensitivity increase effect without any increase of fog density.

Example 5

Emulsion E-1: epitaxial grains (Preparation of Seed Emulsion)

1164 mL of an aqueous solution containing 0.017 g of KBr and 0.4 g of oxidation-processed gelatin of 20,000 average molecular weight was maintained at 30° C. and agitated. An aqueous solution of $AgNO_3$ (1.6 g), an aqueous solution of KBr and an aqueous solution of oxidation-processed gelatin of 20,000 average molecular weight (2.1 g) were added by the triple jet method over a period of 30 sec. The concentration of the aqueous solution of $AgNO_3$ was 0.2 mol/L. At the addition, the silver potential was maintained at 15 mV against saturated calomel electrode. An aqueous solution of KBr was added to thereby cause the silver potential to become −60 mV, and the temperature of the mixture was raised to 75° C. 21 g of gelatin succinate of 100,000 average molecular weight was added. An aqueous solution of $AgNO_3$ (206.3 g) and an aqueous solution of KBr were added by the double jet method over a period of 61 min while accelerating the flow rates. At the addition, the silver potential was maintained at −40 mV against saturated calomel electrode. Desalting was performed, and gelatin succinate of 100,000 average molecular weight was added. At 40° C., the pH and pAg of the emulsion were adjusted to 5.8 and 8.8, respectively. Thus, a seed emulsion was obtained. This seed emulsion contained 1 mol of Ag and 80 g of gelatin per kg of emulsion, and was comprised of tabular grains having an average equivalent circle diameter of 1.60 μm, a variation coefficient of equivalent circle diameter of 22%, an average thickness of 0.043 μm and an average aspect ratio of 37.

(Preparation of Host Tabular Grain Emulsion)

1200 mL of an aqueous solution containing 134 g of the thus obtained seed emulsion, 1.9 g of KBr and 22 g of gelatin succinate of 100,000 average molecular weight was maintained at 75° C. and agitated. In the case where a reduction sensitization is performed, disodium 4,5-dihydroxy-1,3-disulfonate monohydrate and thiourea dioxide were added to the mixture at this time. An aqueous solution of $AgNO_3$ (137.5 g), an aqueous solution of KBr and an aqueous solution of oxidation-processed gelatin of 20,000 molecular weight were mixed together in a separate chamber equipped with magnetic coupling induction type agitator as described in JP-A-10-43570, and immediately thereafter added over a period of 25 min. During this period, the silver potential was maintained at −40 mV against saturated calomel electrode.

Thereafter, an aqueous solution of $AgNO_3$ (30.0 g), an aqueous solution of KBr and an AgI ultrafine grain emulsion prepared in advance were added by the triple jet method at constant flow rates over a period of 30 min. The addition amount of the AgI ultrafine grain emulsion was regulated so that the silver iodide content was 15 mol %. The employed AgI ultrafine grain emulsion had an equivalent circle diameter of 0.03 μm and a variation coefficient of equivalent circle diameter of 17%, wherein gelatin trimellitate was used as a dispersion gelatin. In the middle of the addition, iridium potassium hexachloride and sodium benzenethiosulfonate were added. During the addition, the silver potential was maintained at −20 mV against saturated calomel electrode. Thereafter, an aqueous solution of $AgNO_3$ (36.4 g), an aqueous solution of KBr and the above AgI ultrafine grain emulsion prepared in advance were added at constant flow rates over a period of 40 min. The addition amount of AgI ultrafine grain emulsion was regulated so that the silver iodide content was 15 mol %. During the addition, the silver potential was maintained at +80 mV against saturated calomel electrode. Conventional washing was carried out, and high-molecular-weight gelatin of 150,000 molecular weight was added. At 40° C., the pH and pBr of the emulsion were adjusted to 5.8 and 4.0, respectively. This emulsion was designated emulsion (e).

The emulsion (e) was comprised of tabular grains having an average equivalent circle diameter of 4.2 μm, a variation coefficient of equivalent circle diameter of 19%, an average thickness of 0.062 μm and an average aspect ratio of 68. 90% or more of the total projected area was occupied by tabular grains whose equivalent circle diameter and thickness were 3.0 μm or more and 0.07 μm or less, respectively. Further, 90% or more of the total projected area was occupied by hexagonal tabular grains whose ratio of length of the longest side to the shortest side was 1.4 or less. As a result of observation through a transmission electron microscope at low temperature, it was found that there was no dislocation line in grains occupying 90% or more of the total projected area. The (111) face ratio in the side faces was 68%.

(Epitaxial Deposition and Chemical Sensitization)

The following epitaxial deposition was effected on the above host tabular grain emulsion.

The host tabular grain emulsion was dissolved at 40° C., and an AgI ultrafine grain emulsion of 0.037 μm grain size was added in an amount of $3\times10^{-3}$ mol per mol of silver contained in the host tabular grains. A 6:3:1 in molar ratio mixture of sensitizing dyes I, II and III was added in an amount of 70% based on saturated coating amount. These sensitizing dyes were added in the form of a solid fine dispersion as prepared in the manner described in JP-A-11-52507. Specifically, 0.8 part by weight of sodium nitrate and 3.2 parts by weight of sodium sulfate were dissolved in 43 parts of ion-exchanged water. 13 parts by weight of the sensitizing dyes were added thereto and dispersed at 60° C. with the use of a dissolver blade, rotated at 2000 rpm, for 20 min. Thus, there was obtained a solid dispersion of sensitizing dyes. $3.1\times10^{-6}$ mol (per mol of silver contained in the host tabular grains, also applicable hereinafter) of potassium hexacyanoruthenate (II) and $1.5\times10^{-2}$ mol of an aqueous solution of KBr were sequentially added.

Sensitizing dye I

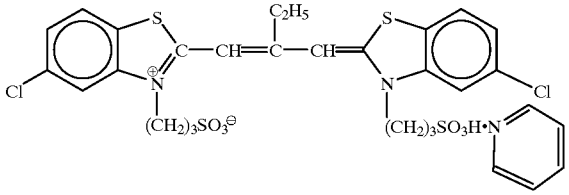

-continued

Sensitizing dye II

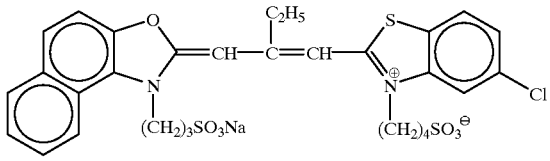

Sensitizing dye III

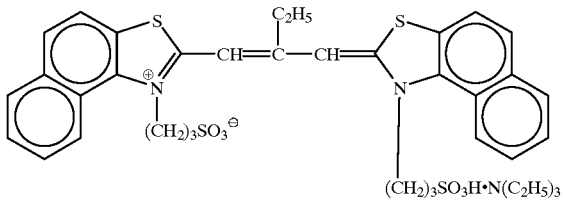

Thereafter, $3.0\times10^{-2}$ mol of a 0.1 mol/L aqueous solution of silver nitrate and $2.7\times10^{-2}$ mol of an aqueous solution of NaCl were added by the double jet method at constant flow rates over a period of 2 min. The silver potential at the completion of addition was +85 mV against saturated calomel electrode. $5\times10^{-5}$ mol of antifoggant I was added, and an aqueous solution of KBr was added to thereby adjust the silver potential to +20 mV against saturated calomel electrode. The temperature of the emulsion was raised to 50C, and potassium thiocyanate, chloroauric acid, sodium thiosulfate and N,N-dimethylselenourea were added to thereby attain the optimum chemical sensitization. $5\times10^{-4}$ mol of antifoggant I was added to thereby complete the chemical sensitization.

Anti-fogging agent I

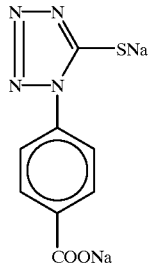

The average silver iodide content and average silver chloride content of the emulsions of Table 6 were 4.5 mol % and 1.2 mol %, respectively. The grains of the emulsion had epitaxial junctions at only each of the six apex portions of the hexagon.

Samples 501 to 515 were prepared under the same coating conditions as in Example 1, except that the applied emulsion was modified as specified in Table 6. The same development processing as in Example 1 was carried out, and the photographic performance was evaluated (Sensitivity of sample 501 was assumed to be 100).

TABLE 6

| Sample No. | Emulsion used for sample preparation: Emulsion No. | Reduction sensitization | Compounds added to emulsion: Compound No. | Addition amount per sensitizing dye (mol %) | Shortened wavelength of the absorption peak of sensitizing dye (nm) | Photographic performance: Sensitivity | Fog density | Remarks |
|---|---|---|---|---|---|---|---|---|
| 501 | E-1 | Performed | none | — | 0 | 100 | 0.29 | Comp. |
| 502 | E-2 | Performed | I-1 | 10 | 5 | 125 | 0.26 | Inv. |
| 503 | E-3 | Performed | I-2 | 10 | 5 | 123 | 0.25 | Inv. |
| 504 | E-4 | Performed | I-3 | 10 | 3 | 118 | 0.25 | Inv. |
| 505 | E-5 | Performed | I-4 | 10 | 3 | 117 | 0.26 | Inv. |
| 506 | E-6 | Performed | I-5 | 10 | 4 | 114 | 0.27 | Inv. |
| 507 | E-7 | Performed | I-6 | 10 | 4 | 115 | 0.26 | Inv. |
| 508 | E-8 | Performed | I-7 | 10 | 3 | 116 | 0.27 | Inv. |
| 509 | E-9 | Performed | I-8 | 10 | 3 | 114 | 0.26 | Inv. |
| 510 | E-10 | Performed | I-9 | 10 | 3 | 113 | 0.26 | Inv. |
| 511 | E-11 | Performed | I-10 | 10 | 4 | 112 | 0.27 | Inv. |
| 512 | E-12 | Performed | I-11 | 10 | 4 | 114 | 0.26 | Inv. |
| 513 | E-3 | Performed | I-12 | 10 | 3 | 112 | 0.26 | Inv. |
| 514 | E-14 | Performed | I-13 | 10 | 4 | 115 | 0.26 | Inv. |
| 515 | E-15 | Performed | I-14 | 10 | 3 | 113 | 0.27 | Inv. |

Sensitivity is expressed in relative value, assuming the sensitivity of Sample 501 to be 100.

The following is apparent from the results of Table 6. That is, samples 501 to 515 show that the samples of the present invention whose sensitizing dye absorption peaks underwent a wavelength shift toward a shorter side by 2 nm or more exerted a striking sensitivity increase effect without any increase of fog density.

Example 6

Emulsions D to R were prepared by the following preparation method.

(Preparation Method of Emulsion D)

42.2 L of an aqueous solution containing 31.7 g of low-molecular-weight gelatin having a molecular weight of 15,000, and phthalated at a phthalation ratio of 97% and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of gelatin-4 of Example 1 were added over 1 min by the double jet method. Immediately after the addition, 52.8 g of KBr were added, and 2,485 mL of an aqueous solution containing 398.2 g of $AgNO_3$ and 2,581 mL of an aqueous solution containing 291.1 g of KBr were added over 2 min by the double jet method. Immediately after the addition, 44.8 g of KBr were added. After that, the temperature was raised to 40° C. to ripen the material. After the ripening, 923 g of succinated gelatin-2 and 79.2 g of KBr were added, and 15,974 mL of an aqueous solution containing 5,103 g of $AgNO_3$ and an aqueous KBr solution were added over 10 min by the double jet method while the flow rate was accelerated such that the final flow rate was 1.4 times the initial flow rate. During the addition, the pAg of the bulk emulsion solution in the reaction vessel was held at 9.90.

After washing with water, gelatin-1 of Example 1 was added, the pH and the pAg were adjusted to 5.7 and 8.8, respectively, and the silver amount and the gelatin amount were adjusted to 131.8 g and 64.1 g, respectively, per kg of the emulsion, thereby preparing a seed emulsion.

1,211 mL of an aqueous solution containing 46 g of gelatin-2 of Example 1 and 1.7 g of KBr were vigorously stirred at 75° C. After 9.9 g of the seed emulsion were added, 0.3 g of modified silicone oil (L7602 manufactured by Nippon Uniker K. K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the pAg of the bulk emulsion solution in the reaction vessel was held at 8.15.

After 2 mg of sodium benzenethiosulfonate and 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 $\mu$m was simultaneously added at an accelerated flow rate so that the silver iodide content was 27 mol %. At the same time, the pAg of the bulk emulsion solution in the reaction vessel was held at 8.60. 121.3 mL of an aqueous solution containing 45.6 g of $AgNO_3$ and an aqueous KBr solution were added over 22 min by the double jet method. During the addition, the pAg of the bulk emulsion solution in the reaction vessel was held at 7.60. The temperature was raised to 82° C., KBr was added to adjust the pAg of the bulk emulsion solution in the reaction vessel to 8.80, and the abovementioned AgI fine grain emulsion was added in an amount of 6.33 g in terms of a KI weight. Immediately after the addition, 206.2 mL of an aqueous solution containing 66.4 g of $AgNO_3$ were added over 16 min.

For the first 5 min of the addition, the pAg of the bulk emulsion solution in the reaction vessel was held at 8.80. After washing with water, gelatin-1 of Example 1 was added, the pH and the pAg were adjusted to 5.8 and 8.7, respectively, at 40° C. After compound 1 was added, and the temperature was raised to 60° C. After sensitizing dyes ExS-5 and ExS-6 were added, potassium thiocyanate, chloroauric acid, sodium thiosulfate, and N,N-dimethylselenourea were added to optimally perform chemical sensitization. At the end of this chemical sensitization, compounds 2 and 3 set forth below were added. "Optimal chemical sensitization" means that the addition amount of each of the sensitizing dyes and the compounds was selected from the range of $10^{-1}$ to $10^{-8}$ mol per mol of a silver halide.

Compound 1

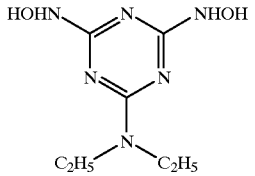

ExS-5

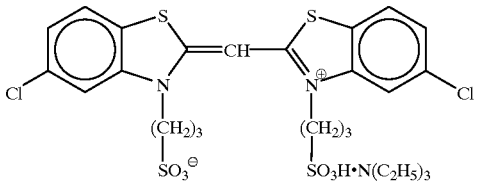

ExS-6

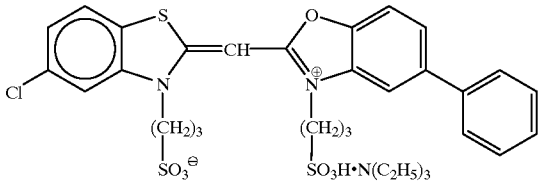

Compound 2

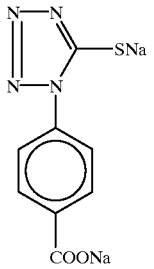

Compound 3

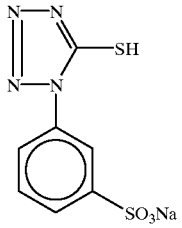

(Preparation Method of Emulsion E)

1,192 mL of an aqueous solution containing 0.96 g of gelatin-4 of Example 1 and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the ripening, 35 g of gelatin-3 of Example 1 were added, and the pH was adjusted to 7. 6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the pAg of the bulk emulsion solution in the reaction vessel was held at 8.15. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of the emulsion D was simultaneously added at an accelerated flow rate so that the silver iodide content was 15.8 mol %. At the same time, the pAg of the bulk emulsion solution in the reaction vessel was held at 7.85.

96.5 mL of an aqueous solution containing 24.1 g of $AgNO_3$ and an aqueous KBr solution were added over 3 min by the double jet method. During the addition, the pAg of the bulk emulsion solution in the reaction vessel was held at 7.85. After 26 mg of sodium ethylthiosulfonate were added, the temperature was raised to 55° C., an aqueous KBr solution was added to adjust the pAg of the bulk emulsion solution in the reaction vessel to 9.80. The aforementioned AgI fine grain emulsion was added in an amount of 8.5 g in terms of a KI weight. Immediately after the addition, 228 mL of an aqueous solution containing 57 g of $AgNO_3$ were added over 5 min. During the addition, an aqueous KBr solution was used to adjust the pAg of the bulk emulsion solution in the reaction vessel such that the pAg was 8.75 at the end of the addition. The resultant emulsion was washed with water and chemically sensitized in substantially the same manner as for the emulsion D.

(Preparation Method of Emulsion F)

1,192 mL of an aqueous solution containing 1.02 g of gelatin-2 of Example 1 and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the ripening, 41.2 g of gelatin-3 of Example 1 and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the pAg of the bulk emulsion solution in the reaction vessel was held at 8.65. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of the emulsion D was simultaneously added at an accelerated flow rate so that the silver iodide content was 2.3 mol %. At the same time, the pAg of the bulk emulsion solution in the reaction vessel was held at 8.50.

After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the pAg of the bulk emulsion solution in the reaction vessel was held at 8.05. An aqueous KBr solution was added to adjust the pAg of the bulk emulsion solution in the reaction vessel to 9.25. The aforementioned AgI fine grain emulsion was added in an amount of 6.4 g in terms of a KI weight. Immediately after the addition, 404 mL of an aqueous solution containing 57 g of $AgNO_3$ were added over 45 min. During the addition, an aqueous KBr solution was used to adjust the pAg of the bulk emulsion solution in the reaction vessel such that the pAg was 8.65 at the end of the addition. The resultant emulsion was washed with water and chemically sensitized in substantially the same manner as for the emulsion D.

(Preparation Method of Emulsion G)

In the preparation of the emulsion F, the $AgNO_3$ addition amount during nucleation was increased by 2.3 times. Also, in the final addition of 404 mL of an aqueous solution containing 57 g of $AgNO_3$, the pAg of the bulk emulsion solution in the reaction vessel was adjusted to 6.85 by using an aqueous KBr solution. The emulsion was prepared following substantially the same procedures as for the emulsion F except the foregoing.

(Preparation Method of Emulsion H)

In the preparation of Emulsion A-1 in Example 1, the compounds of the invention (addition or non-addition is set forth in Table 9 below) were added depending on necessity before performing chemical sensitization, and the sensitizers added for the first time in the chemical sensitization were changed to a combination of ExS-7, ExS-8 and ExS-9. The emulsion was prepared following substantially the same procedures as for the Emulsion C-3 except the foregoing, provided that the addition amounts of the sensitizers Exs-7, ExS-8 and ExS-9 were $5.50\times10^{-4}$ mol, $1.30\times10^{-4}$ mol and $4.65\times10^{-5}$ mol, respectively per mol of silver halide.

ExS-7

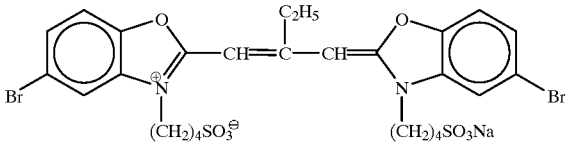

ExS-8

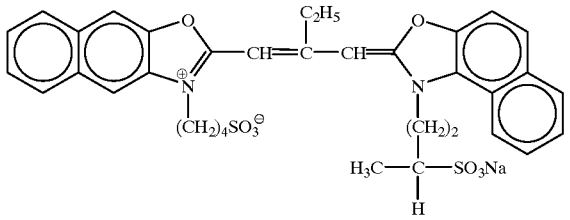

ExS-9

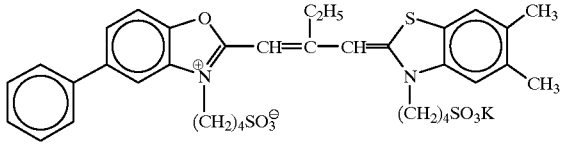

(Preparation Method of Emulsion I)

1,200 mL of an aqueous solution containing 0.75 g of gelatin-4 of Example 1 and 0.9 g of KBr were held at 39° C. and stirred with violence at pH 1.8. An aqueous solution containing 1.85 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. After the pH was adjusted to 5.9, 2.9 g of KBr were added. 288 mL of an aqueous solution containing 27.4 g of $AgNO_3$ and an aqueous KBr solution were added over 53 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, abovementioned AgI fine grain emulsion was simultaneously added such that the silver iodide content was 10.5 mol %. At the same time, the pAg of the bulk emulsion solution in the reaction vessel was held at 9.50.

132 mL of an aqueous solution containing 41.8 g of $AgNO_3$ and an aqueous KBr solution were added over 25 min by the double jet method. The addition of the aqueous KBr solution was so adjusted that the pAg of the bulk emulsion solution in the reaction vessel was 8.15 at the end of the addition. The pH was adjusted to 7.3, and 1 mg of thiourea dioxide was added. After KBr was added to adjust the pAg of the bulk emulsion solution in the reaction vessel to 9.50, the aforementioned AgI fine grain emulsion was added in an amount of 5.73 in terms of a KI weight. Immediately after the addition, 609 mL of an aqueous solution containing 66.4 g of $AgNO_3$ were added over 10 min. For the first 6 min of the addition, the pAg of the bulk emulsion solution in the reaction vessel was held at 9.50 by an aqueous KBr solution. After washing with water, gelatin-1 of Example 1 was added, and the pH and the pAg were adjusted to 6.5 and 8.2, respectively. The resultant emulsion was chemically sensitized in the same manner as for the emulsion H. Note that the use amounts of the sensitizing dyes ExS-7, ExS-8, and ExS-9 were $1.08\times10^{-3}$ mol, $2.56\times10^{-4}$ mol, and $9.16\times10^{-5}$ mol, respectively, per mol of a silver halide.

(Preparation Method of Emulsion J)

1,200 mL of an aqueous solution containing 0.70 g of gelatin-4 of Example 1, 0.9 g of KBr, 0.175 g of KI, and 0.2 g of the modified silicone oil used in the preparation of the emulsion D were held at 33° C. and vigorously stirred at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the ripening, 27.8 g of gelatin-3 of Example 1 were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grain emulsion having a grain size of 0.008 $\mu$m was simultaneously added such that the silver iodide content was 4.1 mol %. This AgI fine grain emulsion was prepared, immediately before the addition, by mixing an aqueous solution of gelatin-4 of Example 1, an aqueous $AgNO_3$ solution, and an aqueous KI solution in another chamber having a magnetic coupling inductive stirrer described in JP-A-10-43570. At the same time, the pAg of the bulk emulsion solution in the reaction vessel was held at 9.15. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion prepared by mixing immediately before addition was simultaneously added at an accelerated flow rate such that the silver iodide content was 7.9 mol %. At the same time, the pAg of the bulk emulsion solution in the reaction vessel was held at 9.30.

After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the pAg of the bulk emulsion solution in the reaction vessel as 7.90 at the end of the addition. After the temperature was raised to 78° C. and the pH was adjusted to 9.1, KBr was added to adjust the pAg of the bulk emulsion solution in the reaction vessel to 8.70. The AgI fine grain emulsion used in the preparation of the emulsion D was added in an amount of 5.73 g in terms of a KI weight. Immediately after the addition, 321 mL of an aqueous solution containing 66.4 g of $AgNO_3$ were added over 4 min. For the first 2 min of the addition, the pAg of the bulk emulsion solution in the reaction vessel was held at 8.70. The resultant emulsion was washed with water and chemically sensitized in substantially the same manner as for the emulsion H. Note that the use amounts of the sensitizing dyes ExS-7, ExS-8, and ExS-9 were $1.25\times10^{-3}$ mol, $2.85\times10^{-4}$ mol, and $3.29\times10^{-5}$ mol, respectively, per mol of a silver halide.

(Preparation Method of Emulsion K)

An aqueous solution containing 17.8 g of gelatin-1 of Example 1, 6.2 g of KBr, and 0.46 g of KI was vigorously stirred at 45° C. An aqueous solution containing 11.85 g of $AgNO_3$ and an aqueous solution containing 3.8 g of KBr were added over 45 sec by the double jet method. After the temperature was raised to 63° C., 24.1 g of gelatin-1 of Example 1 were added to ripen the material. After the ripening, an aqueous solution containing 133.4 g of $AgNO_3$ and an aqueous KBr solution were added over 20 min by the double jet method such that the final flow rate was 2.6 times the initial flow rate. During the addition, the pAg of the bulk emulsion solution in the reaction vessel was held at 7.60. Also, ten minutes after the start of the addition 0.1 mg of $K_2IrCl_6$ was added.

After 7 g of NaCl were added, an aqueous solution containing 45.6 g of $AgNO_3$ and an aqueous KBr solution were added over 12 min by the double jet method. During the addition, the pAg of the bulk emulsion solution in the reaction vessel was held at 6.90. Also, over 6 min from the start of the addition, 100 mL of an aqueous solution containing 29 mg of yellow prussiate were added. After 14.4 g of KBr were added, the AgI fine grain emulsion used in the preparation of the emulsion D was added in an amount of 6.3 g as a KI weight. Immediately after the addition, an aqueous solution containing 42.7 g of $AgNO_3$ and an aqueous KBr solution were added over 11 min by the double jet method. During the addition, the pAg of the bulk emulsion solution in the reaction vessel was held at 6.90. The resultant emulsion was washed with water and chemically sensitized substantially the same manner as for the emulsion H. Note that the use amounts of the sensitizing dyes ExS-7, ExS-8, and ExS-9 were $5.79\times10^{-4}$ mol, $1.32\times10^{-4}$ mol, $1.52\times10^{-5}$ mol, respectively, per mol of a silver halide.

(Preparation Method of Emulsion L)

An emulsion L was prepared following substantially the same procedures as for the emulsion K except that the nucleation temperature was changed to 35° C. Note that the use amounts of the sensitizing dyes ExS-7, ExS-8, and ExS-9 were $9.66\times10^{-4}$ mol, $2.20\times10^{-4}$ mol, and $2.54\times10^{-5}$ mol, respectively, per mol of a silver halide.

(Preparation Method of Emulsion M)

1,200 mL of an aqueous solution containing 0.75 g of gelatin-4 of Example 1 and 0.9 g of KBr were held at 39° C. and vigorously stirred at pH 1.8. An aqueous solution containing 0.34 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. The pH was adjusted to 5.9, and 2.9 g of KBr were added. After 3 mg of thiourea dioxide were added, and 288 mL of an aqueous solution containing 28.8 g of $AgNO_3$ and an aqueous KBr solution were added over 58 min by the double jet method. During the addition, an AgI fine grain emulsion having a grain size of 0.03 μm was simultaneously added such that the silver iodide content was 4.1 mol %. At the same time, the pAg of the bulk emulsion solution in the reaction vessel was held at 9.40.

After 2.5 g of KBr were added, an aqueous solution containing 87.7 g of $AgNO_3$ and an aqueous KBr solution were added over 69 min by the double jet method while the flow rate was accelerated so that the final flow rate was 1.2 times the initial flow rate. During the addition, the above-mentioned AgI fine grain emulsion was simultaneously added such that the silver iodide content was 10.5 mol %. At the same time, the pAg of the bulk emulsion solution in the reaction vessel was held at 9.50. 132 mL of an aqueous solution containing 41.8 g of $AgNO_3$ and an aqueous KBr solution were added over 27 min by the double jet method. The addition of the aqueous KBr solution was so adjusted that the pAg of the bulk emulsion solution in the reaction vessel was 8.15 at the end of the addition.

After 2 mg of sodium benzenethiosulfonate were added, KBr was added to adjust the pAg of the bulk emulsion solution in the reaction vessel to 9.50, and the aforementioned AgI fine grain emulsion was added in an amount of 5.73 in terms of a KI weight. Immediately after the addition, 609 mL of an aqueous solution containing 66.4 g of $AgNO_3$ were added over 11 min. For the first 6 min of the addition, the pAg of the bulk emulsion solution in the reaction vessel was held at 9.50 by an aqueous KBr solution. After washing with water, gelatin was added, the pH and the pAg were adjusted to 6.5 and 8.2, respectively, at 40° C. Then, the temperature was raised to 56° C. The sensitizing dyes ExS-4 and ExS-7 were added. After that, potassium thiocyanate, chloroauric acid, sodium thiosulfate, and N,N-dimethylselenourea were added to ripen and optimally chemically sensitize the emulsion. At the end of the chemical sensitization, compound 3 was added. Note that the use amounts of the sensitizing dyes ExS-7 and ExS-10 were $3.69\times10^{-4}$ mol and $8.19\times10^{-4}$ mol, respectively, per mol of a silver halide.

ExS-10

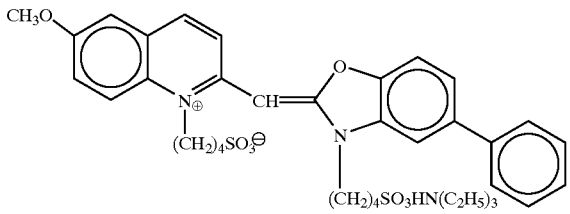

(Preparation Method of Emulsion N)

1,200 mL of an aqueous solution containing 0.38 g of gelatin-2 of Example 1 and 0.9 g of KBr were held at 60° C. and stirred with violence at pH 2. An aqueous solution containing 1.03 g of $AgNO_3$ and an aqueous solution containing 0.88 g of KBr and 0.09 g of KI were added over 30 sec by the double jet method. After ripening, 12.8 g of gelatin-3 of Example 1 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was held at 9.05. An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of the emulsion D was simultaneously added at an accelerated flow rate such that the silver iodide content was 6.5 mol %. At the same time, the pAg of the bulk emulsion solution in the reaction vessel was held at 9.05.

After 1.5 mg of thiourea dioxide were added, 132 mL of an aqueous solution containing 41.8 g and an aqueous KBr solution were added over 16 min by the double jet method. The addition of the aqueous KBr solution was so adjusted that the pAg of the bulk emulsion solution in the reaction vessel as 7.70 at the end of the addition. After 2 mg of sodium benzenethiosulfonate were added, KBr was added to adjust the pAg of the bulk emulsion solution in the reaction vessel to 9.80. The abovementioned AgI fine grain emulsion was added in an amount of 6.2 g in terms of a KI weight. Immediately after the addition, 300 mL of an aqueous solution containing 88.5 g of $AgNO_3$ were added over 10 min. An aqueous KBr solution was added to adjust pAg of the bulk emulsion solution in the reaction vessel such that the pAg was 7.40 at the end of the addition. After washing with water, gelatin-1 of Example 1 was added, the pH and the pAg were adjusted to 6.5 and 8.2, respectively at 40° C. and the temperature was raised to 58° C. After the compound of the invention was added depending on the necessity (addition and non-addition are set forth in Table 9 below), the sensitizing dyes ExS-11, ExS-12, and ExS-13 were added. After that, $K_2IrCl_6$, potassium thiocyanate, chloroauric acid, sodium thiosulfate, and N,N-dimethylselenourea were added to optimally perform chemical sensitization. At the end of the chemical sensitization, compound 3 and compound 4 were added.

ExS-11

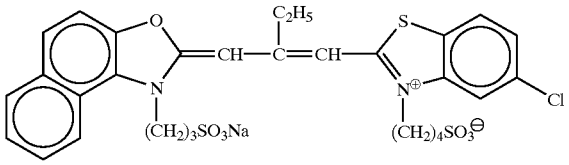

ExS-12

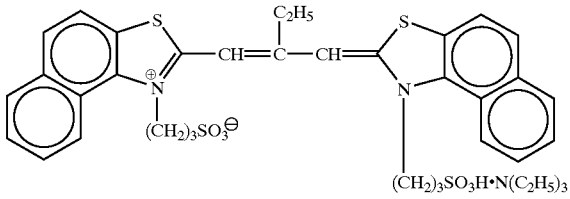

ExS-13

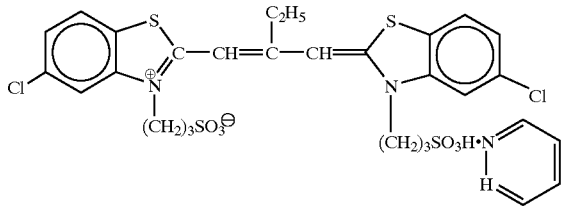

(Preparation Method of Emulsion O)

In the preparation of the emulsion N, the amounts of $AgNO_3$, KBr, and KI added during nucleation were changed to 1.96 g, 1.67 g, and 0.172 g, respectively. Also, the chemical sensitization temperature was changed from 58° C. to 61° C. An emulsion O was prepared following substantially the same procedures as for the emulsion N except the foregoing.

(Preparation Method of Emulsion P)

1,200 mL of an aqueous solution containing 4.9 g of gelatin-4 of Example 1 and 5.3 g of KBr were vigorously stirred at 40° C. 27 mL of an aqueous solution containing 8.75 g of $AgNO_3$ and 36 mL of an aqueous solution containing 6.45 g of KBr were added over 1 min by the double jet method. The temperature was raised to 75° C., and 21 mL of an aqueous solution containing 6.9 g of $AgNO_3$ were added over 2 min. After 26 g of $NH_4NO_3$ and 56 mL of 1 N NaOH were sequentially added, the material was ripened. After the ripening, the pH was adjusted to 4.8. 438 mL of an aqueous solution containing 141 g of $AgNO_3$ and 458 mL of an aqueous solution containing 102.6 g of KBr were added by the double jet method such that the final flow rate was 4 times the initial flow rate. The temperature was lowered to 55° C., 240 mL of an aqueous solution containing 7.1 g of $AgNO_3$ and an aqueous solution containing 6.46 g of KI were added over 5 min by the double jet method. After 7.1 g of KBr were added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added over 8 min by the double jet method. The resultant emulsion was washed with water and chemically sensitized in substantially the same manner as for the emulsion N.

(Preparation Methods of Emulsions Q and R)

Emulsions Q and R were prepared following substantially the same procedures as for the emulsions K and L, respectively, except that chemical sensitization was performed in substantially the same manner as for the emulsion O.

Characteristic values of the above silver halide emulsions are summarized in Table 7 below. The surface iodide content can be examined as follows by XPS. That is, a sample was cooled to −115° C. in a vacuum of $1.33\times10^{-6}$ Pa or less and irradiated with MgKα, as probe X-rays, at an X-ray source voltage of 8 kV and an X-ray current of 20 mA, thereby measuring Ag3d5/2, Br3d, and I3d5/2 electrons. The integral intensities of the measured peaks were corrected by a sensitivity factor, and the surface iodide content was calculated from these sensitivity ratios. Note that dislocation lines as described in JP-A-3-237450 were observed by a high-voltage electron microscope in silver halide grains of the emulsions D to R.

TABLE 7

| Emulsion No. | E.C.D. (μm) C.O.V. (%) | Thickness (μm) C.O.V. (%) | Aspect ratio C.O.V. (%) | Tabularity | Twin plane distance (μm) C.O.V. (%) | Ratio of tabular grains having (111) main planes to the total projected area (%) | (100) plane ratio in side faces (%) | AgI content (mol %) C.O.V. (%) | AgCl content (mol %) | Surface AgI content (mol %) |
|---|---|---|---|---|---|---|---|---|---|---|
| D | 1.98 | 0.198 | 10 | 51 | 0.014 | 92 | 23 | 15 | 0 | 4.3 |
| | 23 | 28 | 35 | | 32 | | | 17 | | |
| E | 1.30 | 0.108 | 12 | 111 | 0.013 | 93 | 22 | 11 | 0 | 3.6 |
| | 25 | 27 | 38 | | 30 | | | 16 | | |
| F | 1.00 | 0.083 | 12 | 145 | 0.012 | 93 | 18 | 4 | 1 | 1.8 |
| | 27 | 26 | 37 | | 30 | | | 8 | | |
| G | 0.75 | 0.075 | 10 | 133 | 0.010 | 91 | 33 | 4 | 2 | 1.9 |
| | 31 | 18 | 29 | | 27 | | | 8 | | |
| H | 2.01 | 0.161 | 12.5 | 78 | 0.011 | 99 | 23 | 3.9 | 0 | 2.6 |
| | 18 | 18 | 21 | | 23 | | | 5 | | |
| I | 1.54 | 0.077 | 20 | 260 | 0.013 | 99 | 23 | 7 | 0 | 2.5 |
| | 26 | 18 | 33 | | 26 | | | 7 | | |
| J | 1.08 | 0.072 | 15 | 208 | 0.008 | 97 | 23 | 6 | 0 | 2.0 |
| | 18 | 15 | 19 | | 22 | | | 5 | | |
| K | 0.44 | 0.220 | 2 | 9 | 0.013 | 90 | 38 | 3 | 2 | 1.0 |
| | 16 | 13 | 9 | | 18 | | | 6 | | |
| L | 0.33 | 0.165 | 2 | 12 | 0.013 | 88 | 42 | 3 | 2 | 1.0 |
| | 17 | 13 | 12 | | 18 | | | 6 | | |
| M | 2.25 | 0.107 | 21 | 197 | 0.013 | 99 | 20 | 7.2 | 0 | 2.4 |
| | 31 | 19 | 34 | | 33 | | | 7 | | |
| N | 2.38 | 0.138 | 17 | 125 | 0.013 | 98 | 23 | 5 | 1 | 1.6 |
| | 20 | 20 | 23 | | 19 | | | 6 | | |
| O | 1.83 | 0.122 | 15 | 123 | 0.012 | 98 | 23 | 5 | 1 | 1.8 |
| | 18 | 20 | 22 | | 19 | | | 6 | | |
| P | 0.84 | 0.120 | 7 | 58 | 0.013 | 99 | 25 | 3 | 0 | 2.7 |
| | 17 | 18 | 19 | | 16 | | | 7 | | |
| Q | 0.44 | 0.220 | 2 | 9 | 0.013 | 88 | 42 | 2 | 2 | 1.0 |
| | 17 | 13 | 12 | | 18 | | | 6 | | |
| R | 0.33 | 0.165 | 2 | 12 | 0.013 | 88 | 46 | 1 | 2 | 0.5 |
| | 17 | 13 | 12 | | 18 | | | 6 | | |
| S | 0.07 | 0.070 | 1 | — | — | — | — | 1 | 0 | — |
| | — | — | — | | — | | | — | | |
| T | 0.07 | 0.070 | 1 | — | — | — | — | 0.9 | 0 | — |
| | — | — | — | | — | | | — | | |

Note
1)E.C.D = equivalent circle diameter
2)C.O.V. = coefficient of variation

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH—C_6H_3(CH_3)NCO)_3$ as a hardener and acetone, methylethylketone, and cyclohexane as solvents, thereby forming a 1.2-$\mu$m thick magnetic recording layer. 10 mg/m$^2$ of silica grains (0.3 $\mu$m) were added as a matting agent, and 10 mg/m$^2$ of aluminum oxide (0.15 $\mu$m) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 $\mu$m) in acetone before being added. 15 mg/m$^2$ of silica grains (0.3 $\mu$m) were added as a matting agent, and 15 mg/m$^2$ of aluminum oxide (0.15 $\mu$m) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

The surface of the support on the side away from the back layers formed as above was coated with a plurality of layers having the following compositions to form a sample as a color negative sensitized material.

(Compositions of Sensitive Layers)

The main ingredients used in the individual layers are classified as follows, however, the use thereof are not limited to those specified below.

ExC: Cyan coupler
ExM: Magenta coupler
ExY: Yellow coupler
UV: Ultraviolet absorbent
HBS: High-boiling organic solvent
H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| | | |
|---|---|---|
| 1st layer (1st antihalation layer) | | |
| Black colloidal silver | silver | 0.155 |
| Silver iodobromide emulsion T | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (2nd antihalation layer) | | |
| Black colloidal silver | silver | 0.011 |
| Gelatin | | 0.407 |
| ExM-1 | | 0.050 |
| ExF-1 | | 2.0 × 10$^{-3}$ |
| HBS-1 | | 0.074 |
| Solid disperse dye ExF-2 | | 0.014 |
| Solid disperse dye ExF-3 | | 0.020 |
| 3rd layer (Interlayer) | | |
| Silver iodobromide emulsion S | | 0.020 |
| ExC-2 | | 0.022 |
| Polyethylacrylate latex | | 0.085 |
| Gelatin | | 0.294 |
| 4th layer (Low-speed red-sensitive emulsion layer) | | |
| Silver iodochlorobromide emulsion R | silver | 0.065 |
| Silver iodochlorobromide emulsion Q | silver | 0.258 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver iodobromide emulsion P | silver | 0.21 |
| Silver iodobromide emulsion O | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver iodochlorobromide emulsion N | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Interlayer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| 8th layer (layer for donating interimage effect to red-sensitive layer) | | |
| Silver iodobromide emulsion M | silver | 0.560 |
| Cpd-3 | | 0.020 |
| Cpd-4 | | 0.030 |
| ExM-2 | | 0.096 |

-continued

| | | |
|---|---|---|
| EXM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| 9th layer (Low-speed green-sensitive emulsion layer) | | |
| Silver iodobromide emulsion L | silver | 0.39 |
| Silver iodochlorobromide emulsion K | silver | 0.28 |
| Silver iodobromide emulsion J | silver | 0.35 |
| ExM-2 | | 0.36 |
| ExM-3 | | 0.045 |
| ExG-1 | | 0.005 |
| Cpd-3 | | 0.010 |
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Silver iodobromide emulsion I | silver | 0.45 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Silver iodobromide emulsion H | silver | 0.99 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Cpd-3 | | 0.004 |
| Cpd-4 | | 0.007 |
| HBS-1 | | 0.18 |
| Polyethylacrylate latex | | 0.099 |
| Gelatin | | 1.11 |
| 12th layer (Yellow filter layer) | | |
| Yellow colloidal silver | silver | 0.010 |
| Cpd-1 | | 0.16 |
| Oil-soluble dye ExF-5 | | 0.010 |
| Solid disperse dye ExF-6 | | 0.020 |
| HBS-1 | | 0.082 |
| Gelatin | | 1.057 |
| 13th layer (Low-speed blue-sensitive emulsion layer) | | |
| Silver iodobromide emulsion G | silver | 0.18 |
| Silver iodobromide emulsion E | silver | 0.20 |
| Silver iodochlorobromide emulsion F | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Silver iodobromide emulsion D | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |

-continued

| | | |
|---|---|---|
| Cpd-3 | | $1.0 \times 10^{-3}$ |
| HBS-1 | | 0.10 |
| Gelatin | | 0.91 |
| 15th layer (1st protective layer) | | |
| Silver iodobromide emulsion S | silver | 0.30 |
| UV-1 | | 0.21 |
| UV-2 | | 0.13 |
| UV-3 | | 0.20 |
| UV-4 | | 0.025 |
| F-18 | | 0.009 |
| HBS-1 | | 0.12 |
| HBS-4 | | $5.0 \times 10^{-2}$ |
| Gelatin | | 2.3 |
| 16th layer (2nd protective layer) | | |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively. Preparation of dispersions of organic solid disperse dyes ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700 mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K. K. After the dispersion, the dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-4 was obtained. The average grain sizes of the fine dye grains was 0.45. ExF-2 was dispersed by a microprecipitation dispersion method described in Example 1 of EP549, 489A. The average grain size was found to be 0.06 μm.

A solid dispersion ExF-6 was dispersed by the following method.

4.0 Kg of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

The compounds used in the formation of each layer are as follows.

ExC-1
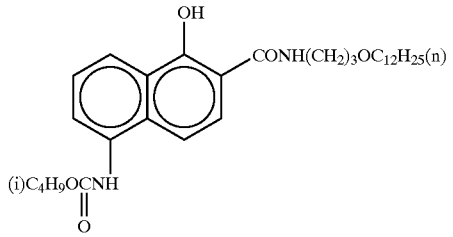
ExC-2
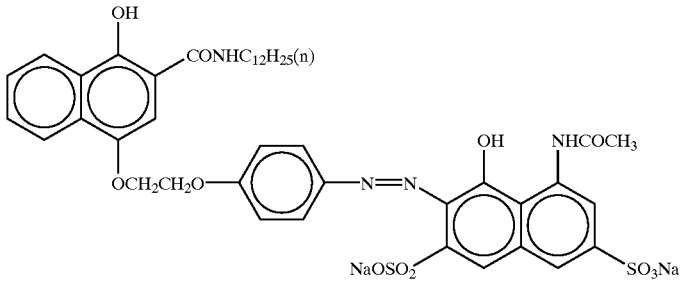
ExC-3
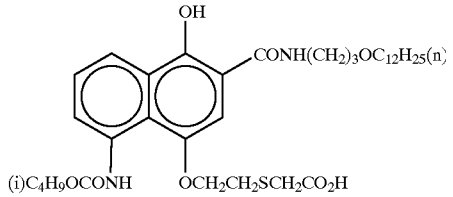
ExC-4
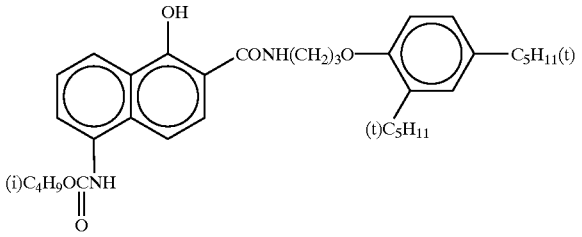
ExC-5
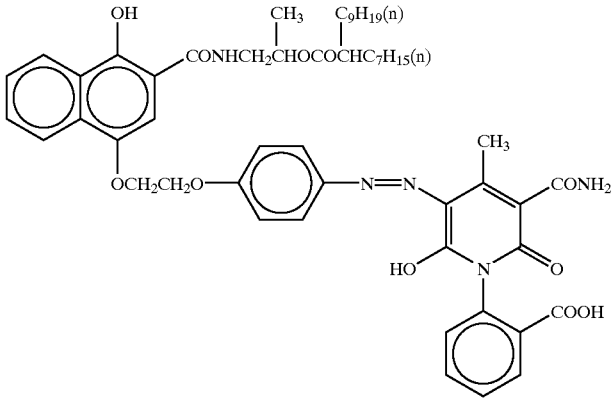

-continued
ExC-6
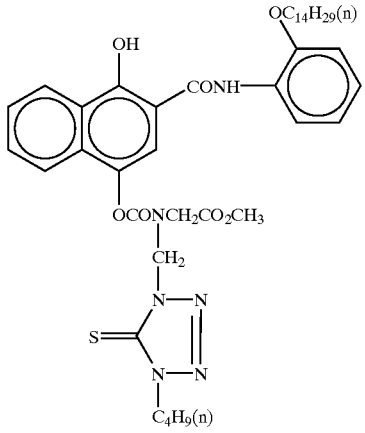
ExC-7
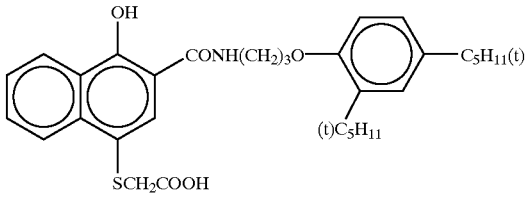
ExC-8
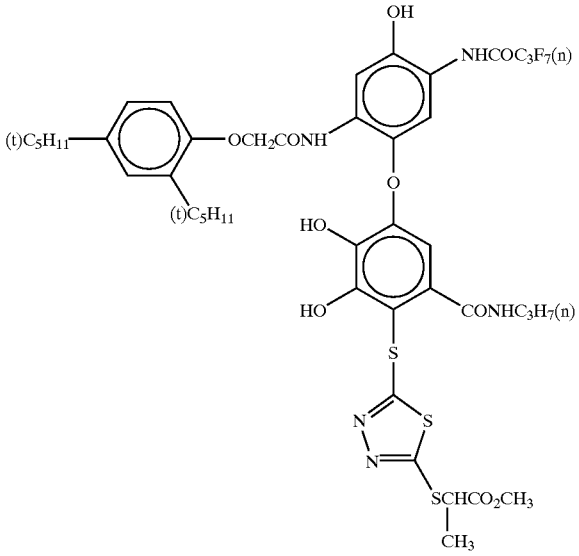
ExM-1
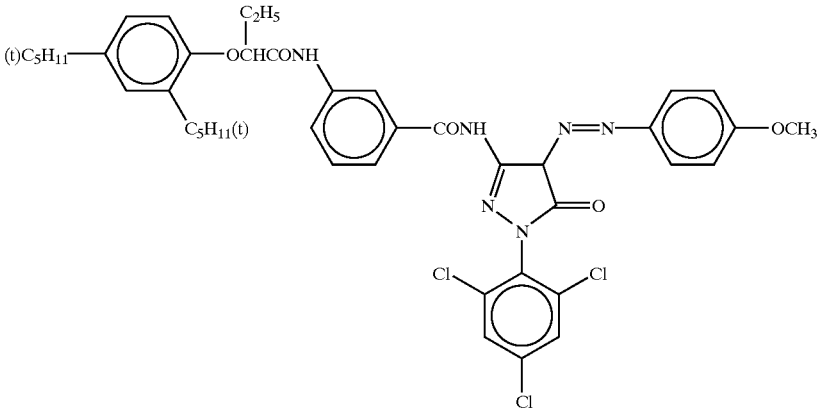

-continued
ExM-2
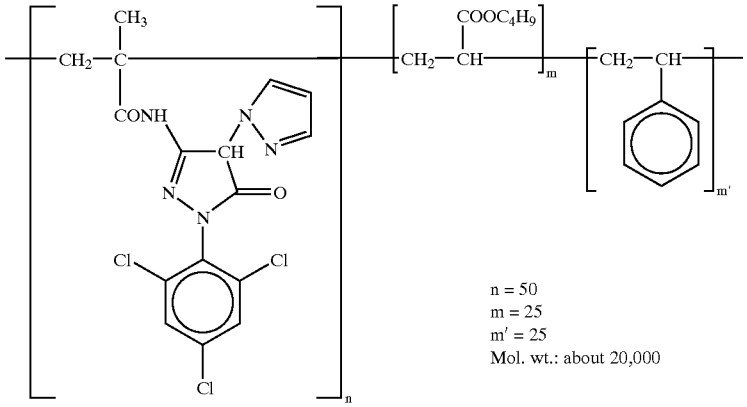
ExM-3
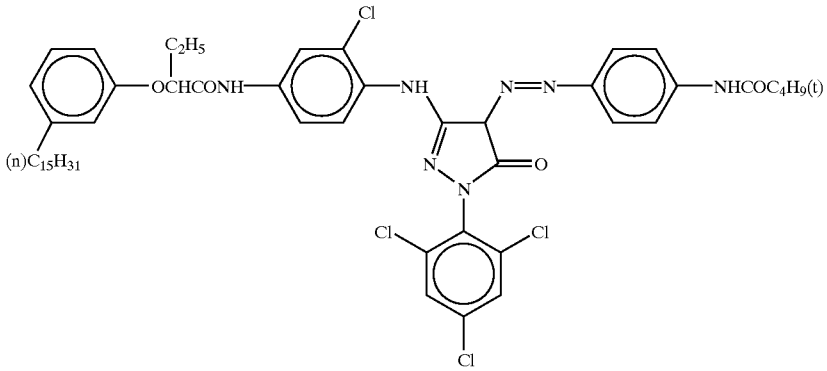
ExM-4
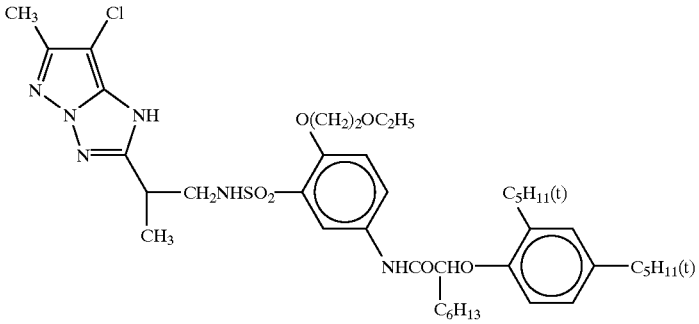
ExM-5
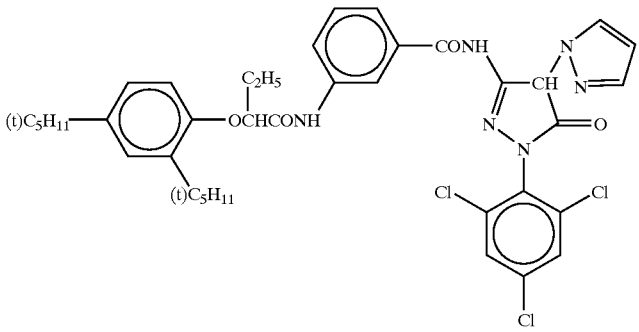

-continued
ExY-1
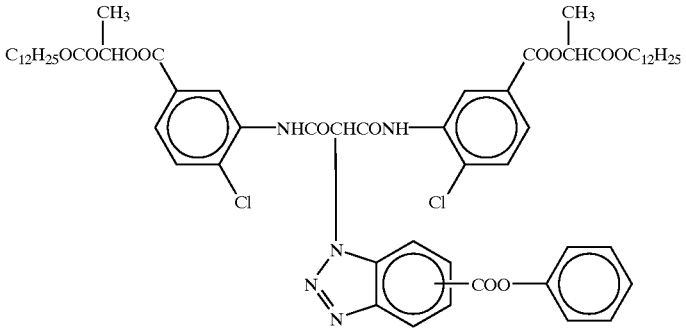
ExY-2
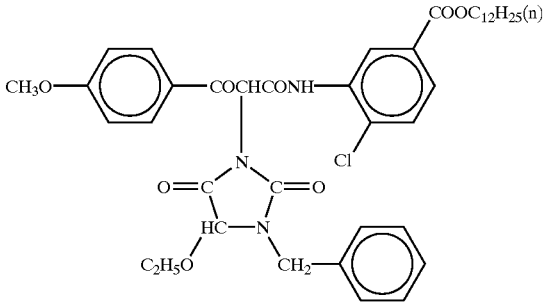
ExY-3
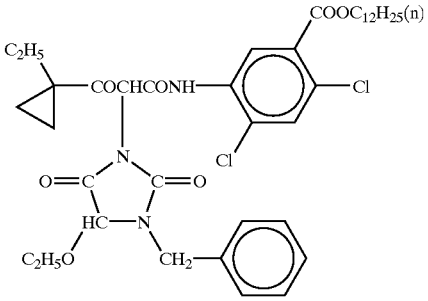
ExY-4
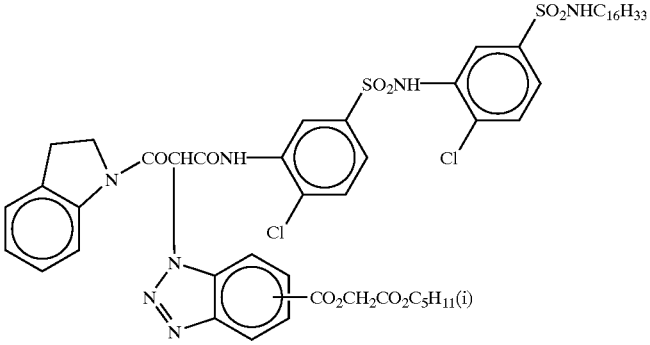

-continued
ExY-5
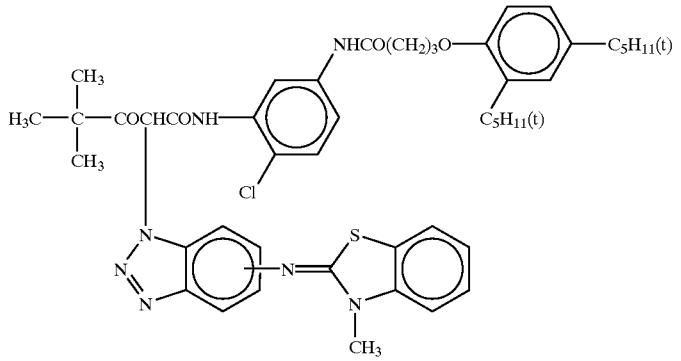
ExY-6
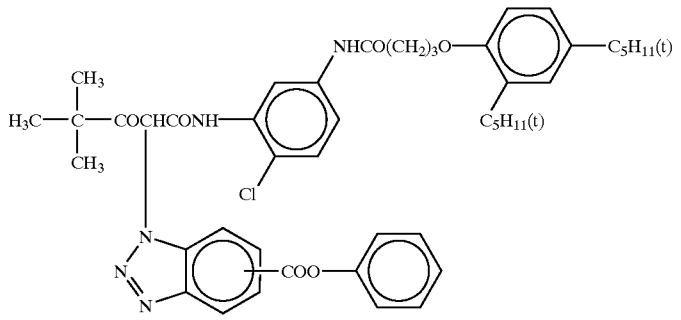
ExG-1
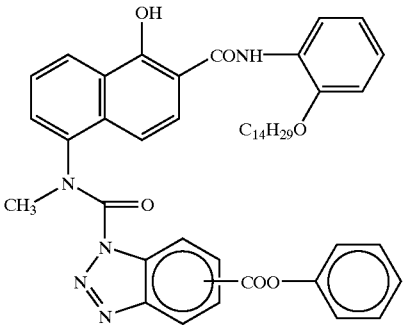
ExF-1
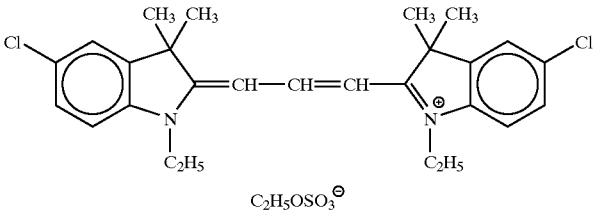
ExF-2
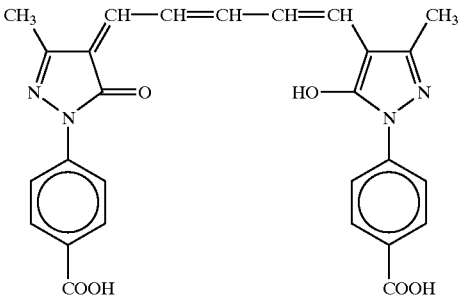

-continued
ExF-3
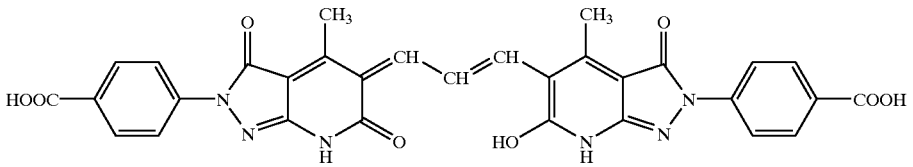
ExF-4
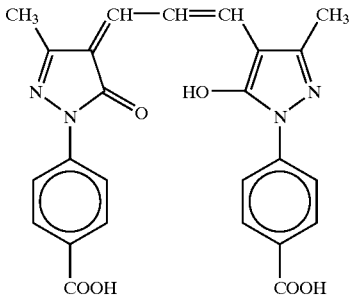
ExF-5
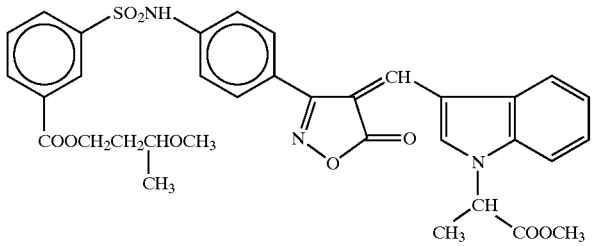
ExF-6
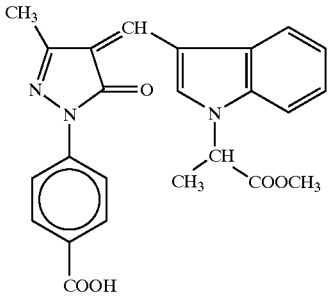
Cpd-1
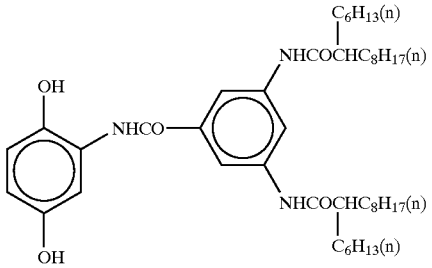
Cpd-2
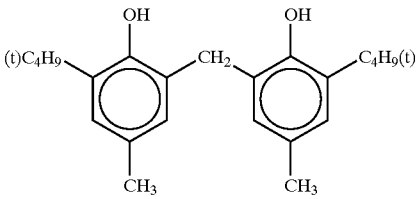

-continued
Cpd-3
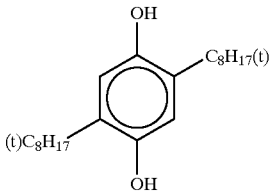
Cpd-4
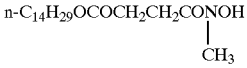
UV-1
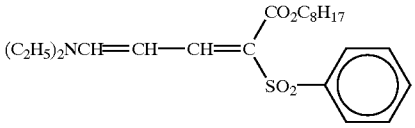
UV-2
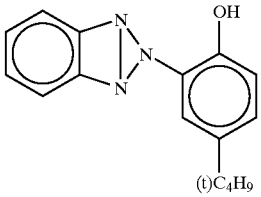
UV-3
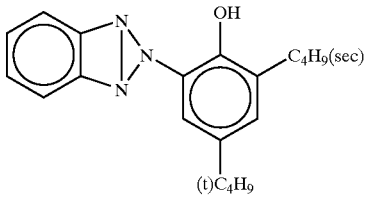
UV-4
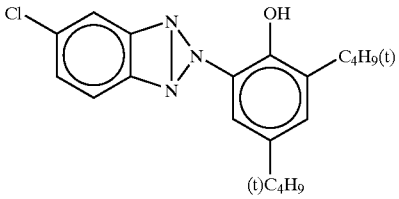
HBS-1 Tricresyl phosphate
HBS-2 Di-n-butyl phthalate
HBS-3
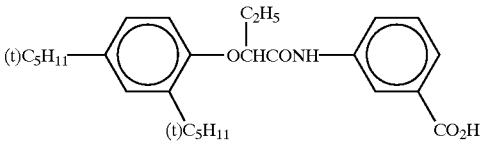
HBS-4 Tri (2-ethylhexyl) phosphate
H-1
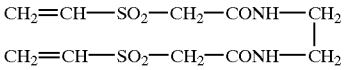
S-1
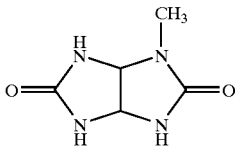
B-1
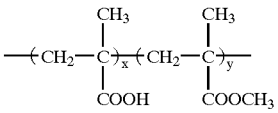
x/y = 10/90 (Wt. ratio)
Av. mol. wt.: about 35,000

-continued
B-2
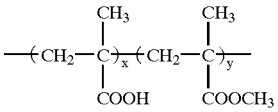
x/y = 40/60 (Wt. ratio)
Av. mol. wt.: about 20,000
B-3
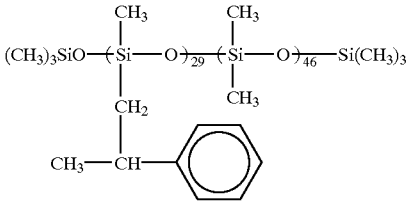
(Molar ratio)
Av. mol. wt.: about 8,000
B-4
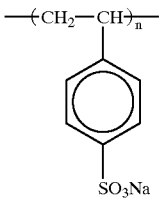
Av. mol. wt.: about 750,000
B-5
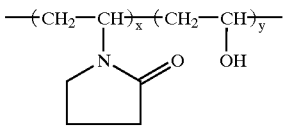
x/y = 70/30 (Wt. ratio)
Av. mol. wt.: about 17,000
B-6
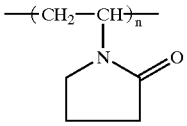
Av. mol. wt.: about 10,000
W-1
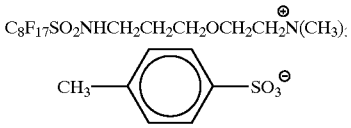
W-2
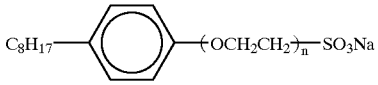
n = 2–4
W-3
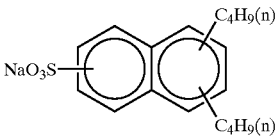
W-4
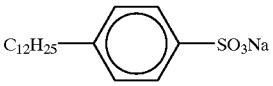
W-5
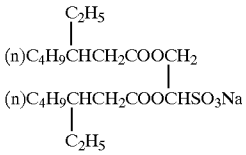

-continued
F-1
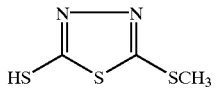
F-2
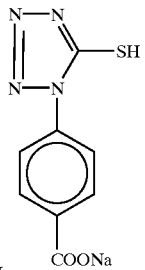
F-3
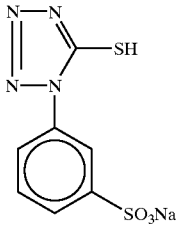
F-4
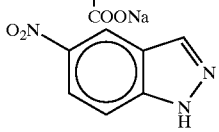
F-5
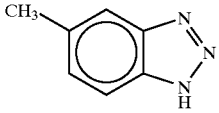
F-6
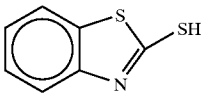
F-7
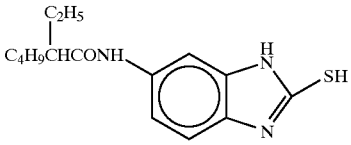
F-8
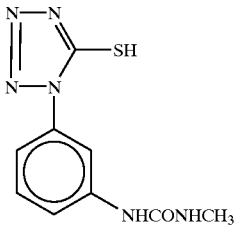
F-9
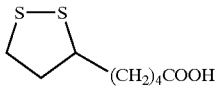
F-10
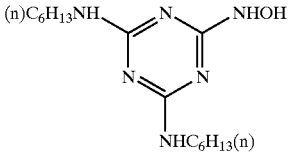
F-11
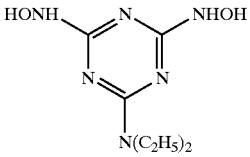
F-12
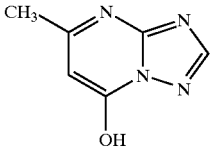
F-13
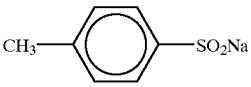
F-14
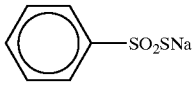
F-15
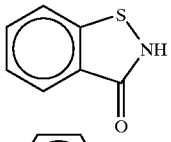
F-16
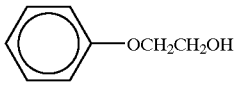
F-17
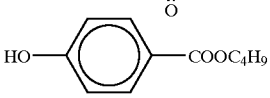
F-18
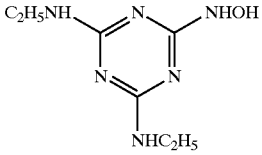

(Preparation of Each Sample)

Samples were prepared in accordance with the preparation of Emulsion N, except that the addition or non-addition of the compound of the invention, and the addition amount thereof were changed. The changes are set forth in Table 9 below. In addition, all of Emulsions N, O, P, Q and R were replaced by Emulsion B-1 of Example 2, Emulsion C-1 of Example 3, Emulsion D-1 of Example 4, and Emulsion E-1 of Example 5, to evaluate the use of the compound of the invention. The changes are set forth in Table 10 below.

These samples were subjected to film hardening for 14 hr at 40° C. and a relative humidity of 70%. After that, the samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing Steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one roll of 24 Ex)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each crossover time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | <Tank solution> (g) | <Replenisher> (g) |
|---|---|---|
| (Color developer) | | |
| Diethylenetriamine pentaacetic acid | 3.0 | 3.0 |

-continued

| | <Tank solution> (g) | <Replenisher> (g) |
|---|---|---|
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |
| (Fixer (1) Tank solution) | | |
| A 5:95 mixture (v/v) of the above bleaching tank solution and the below fixing tank solution pH 6.8 | | |
| (Fixer (2)) | | |
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-mononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |

-continued

| (Stabilizer) | common to tank solution and replenisher (g) |
|---|---|
| 1,4-bis(1,2,4-triazole-1-ylmethyl) piperazine | 0.75 |
| Water to make | 1.0 L |
| pH | 8.5 |

Emulsion N had 10 or more dislocation lines per grain, aspect ratio of 17, emulsion surface AgI content of 1.6 mol %, and was a reduction sensitized emulsion.

Evaluation of photographic performance was conducted for Samples 601 to 609 after the processing by measuring density with a red-filter. The results obtained are shown in Table 8 below. The sensitivity is represented by a relative value of the reciprocal of an exposure amount necessary to reach a density of fog density plus 0.2 (sensitivity of the sample 601 was assumed to be 100).

As is apparent from Table 8, the advantage of sensitivity enhancement was large when the maximum absorbing wavelength of the sensitizing dyes shifts toward a shorter side by at least 2 nm, and when the compound of the present invention was used.

Evaluation of photographic performance was conducted for Samples 701 and 702, Samples 801 and 802, Samples 901 and 902 and Samples 1001 and 1002 after the processing by measuring density with a red-filter. The results obtained are shown in Table 9 below. The sensitivity is represented by a relative value of the reciprocal of an exposure amount necessary to reach a density of fog density plus 0.2 (sensitivities of the samples 701, 801, 901, and 1001 were assumed to be 100, respectively).

TABLE 8

| | High-speed red-sensitive emulsion layer: Emulsion N | | | | | | |
|---|---|---|---|---|---|---|---|
| Sample | | Compound | Addition amount per spectral sensitizing | Shortened wavelength of the absorption peak of sensitizing | Photographic performance with red filter | | |
| No. | Emulsion | No. | dye (mol %) | dye (nm) | Sensitivity | Fog density | Remarks |
| 601 | Emulsion N | none | — | 0 | 100 | 0.35 | Comp. |
| 602 | Emulsion N | I-1 | 2 | 2 | 114 | 0.34 | Inv. |
| 603 | Emulsion N | I-1 | 5 | 3 | 116 | 0.33 | Inv. |
| 604 | Emulsion N | I-1 | 10 | 3 | 119 | 0.34 | Inv. |
| 605 | Emulsion N | I-1 | 25 | 4 | 115 | 0.34 | Inv. |
| 606 | Emulsion N | 1-2 | 2 | 2 | 119 | 0.33 | Inv. |
| 607 | Emulsion N | 1-2 | 5 | 3 | 123 | 0.34 | Inv. |
| 608 | Emulsion N | 1-2 | 10 | 4 | 125 | 0.34 | Inv. |
| 609 | Emulsion N | 1-2 | 25 | 5 | 119 | 0.35 | Inv. |

Sensitivity is expressed in relative value, assuming the sensitivity of Sample 601 to be 100.

TABLE 9

| | Red-Sensitive emulsion layer: Changes in emulsions N, O, P, Q and R | | | | | | |
|---|---|---|---|---|---|---|---|
| Emulsion | Emulsion | Compound | Addition amount per sensitizing | Shortened wavelength of the absorption peak of sensitizing | Photographic performance with red filter | | |
| No. | No. | No. | dye (mol %) | dye (nm) | Sensitivity | Fog density | Remarks |
| 701 | B-1 | none | — | 0 | 100 | 0.31 | Comp. |
| 702 | B-1 | I-2 | 5 | 4 | 117 | 0.31 | Inv. |
| Sensitivity is expressed in relative value, assuming the sensitivity of Sample 701 to be 100. | | | | | | | |
| 801 | C-1 | none | — | 0 | 100 | 0.28 | Comp. |
| 802 | C-1 | I-2 | 5 | 3 | 114 | 0.27 | Inv. |
| Sensitivity is expressed in relative value, assuming the sensitivity of Sample 801 to be 100. | | | | | | | |
| 901 | D-1 | none | — | 0 | 100 | 0.27 | Comp. |
| 902 | D-1 | I-2 | 5 | 4 | 116 | 0.27 | Inv. |

TABLE 9-continued

| Red-Sensitive emulsion layer: Changes in emulsions N, O, P, Q and R | | | | | | | |
|---|---|---|---|---|---|---|---|
| Emulsion No. | Emulsion No. | Compound No. | Addition amount per sensitizing dye (mol %) | Shortened wavelength of the absorption peak of sensitizing dye (nm) | Photographic performance with red filter Sensitivity | Fog density | Remarks |
| Sensitivity is expressed in relative value, assuming the sensitivity of Sample 901 to be 100. | | | | | | | |
| 1001 | E-1 | none | — | 0 | 100 | 0.36 | Comp. |
| 1002 | E-1 | I-2 | 5 | 5 | 126 | 0.35 | Inv. |
| Sensitivity is expressed in relative value, assuming the sensitivity of Sample 1001 to be 100. | | | | | | | |

As is apparent from Table 9, the advantage of sensitivity enhancement was large when the maximum absorbing wavelength of the sensitizing dyes shifts toward a shorter side by at least 2 nm, and when the compound of the present invention was used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A lightsensitive silver halide photographic emulsion comprising silver halide grains; a sensitizing dye having a given maximum absorption wavelength; and an organic compound exhibiting no absorption in a visible light region, wherein the addition amount of the organic compound is in the range of 1 to 50 mol % based on the sensitizing dye, and a maximum absorption wavelength of the photographic emulsion exhibited by the sensitizing dye in the presence of the organic compound is at least 2 nm shorter than the given maximum absorption wavelength exhibited by the sensitizing dye in the absence of the organic compound, wherein 50% or more of the total projected area of the silver halide grains are occupied by tabular silver halide grains each having (111) faces as parallel main planes; being hexagonal grain whose ratio of length of the longest side to the shortest side is 2 or less; having at least one epitaxial junction portion per grain at an apex portion and/or a side face portion and/or a main plain portion thereof; and having a silver halide composition of silver iodobromide or silver chloroiodobromide whose silver chloride content is less than 10 mol %.

2. The lightsensitive silver halide photographic emulsion according to claim 1, wherein the organic compound exhibiting no absorption in a visible light region is a compound represented by a general formula (1):

(1)

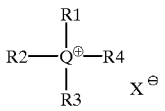

wherein Q represents a N or P atom; each of R1, R2, R3 and R4 represents an alkyl, an aryl or a heterocycle, provided that two of R1, R2, R3 and R4 may be bonded with each other to thereby form a saturated ring, or three of R1, R2, R3 and R4 may cooperate with each other to thereby form an unsaturated ring; and X represents an anion group, provided that X does not exist in the event of an intramolecular salt.

3. The lightsensitive silver halide photographic emulsion according to claim 2, wherein 50% or more of the total projected area of the silver halide grains are occupied by tabular silver halide grains each having (111) faces as parallel main planes; having an aspect ratio of 2 or more; having 10 or more dislocation lines per grain; and having a silver halide composition of silver iodobromide or silver chloroiodobromide whose silver chloride content is less than 10 mol %.

4. The lightsensitive silver halide photographic emulsion according to claim 1, wherein 50% or more of the total projected area of the silver halide grains are occupied by tabular silver halide grains each having (111) faces as parallel main planes; having an aspect ratio of 2 or more; having 10 or more dislocation lines per grain; and having a silver halide composition of silver iodobromide or silver chloroiodobromide whose silver chloride content is less than 10 mol %.

5. The lightsensitive silver halide photographic emulsion according to claim 1, wherein 50% or more of the total projected area of the silver halide grains are occupied by tabular silver halide grains each having (100) faces as parallel main planes; having an aspect ratio of 2 or more; and having a silver halide composition of silver iodobromide or silver chloroiodobromide whose silver chloride content is less than 10 mol %.

6. The lightsensitive silver halide photographic emulsion according to claim 1, wherein the sensitizing dye rendered the silver halide grains red-sensitive.

7. A silver halide photographic lightsensitive material comprising at least one lightsensitive silver halide emulsion layer on a support, wherein the lightsensitive silver halide emulsion layer comprises the lightsensitive silver halide photographic emulsion according to claim 1.

8. A lightsensitive silver halide photographic emulsion comprising silver halide grains and a sensitizing dye, wherein at least one compound represented by the following general formula (1) is contained in an amount of 1 to 50 mol % based on the sensitizing dye:

(1)

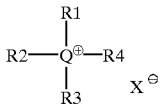

wherein Q represents a N or P atom; each of R1, R2, R3 and R4 represents an alkyl, an aryl or a heterocycle, provided that two of R1, R2, R3 and R4 may be bonded with each other to thereby form a saturated ring, or three of R1, R2, R3 and R4 may cooperate with each other to thereby form an unsaturated ring; and X represents an anion group, provided that X does not exist in the event of an intramolecular salt, wherein 50% or more of the total projected area of the silver halide grains are occupied by tabular silver halide grains each having (111) faces as parallel main planes; being hexagonal grain whose ratio of length of the longest side to the shortest side is 2 or less; having at least one epitaxial junction portion per grain at an apex portion and/or a side face portion and/or a main plain portion thereof; and having a silver halide composition of silver iodobromide or silver chloroiodobromide whose silver chloride content is less than 10 mol %.

9. The lightsensitive silver halide photographic emulsion according to claim 8, wherein 50% or more of the total projected area of the silver halide grains are occupied by tabular silver halide grains each having (100) faces as parallel main planes; having an aspect ratio of 2 or more; and having a silver halide composition of silver iodobromide or silver chloroiodobromide whose silver chloride content is less than 10 mol %.

10. The lightsensitive silver halide photographic emulsion according to claim 8, wherein the compound represented by the general formula (1) is a compound represented by the following general formula (2):

(2)

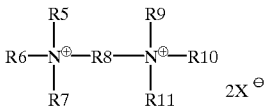

wherein each of R5, R6 and R7 represents an alkyl, an aryl or a heterocycle, provided that two of R5, R6 and R7 may cooperate with each other to thereby form a saturated ring, or R5, R6 and R7 may cooperate with each other to thereby form an unsaturated ring; R8 represents a group constituted by each or any combination of an alkylene group, an arylene group, —O—, —S— and —$CO_2$—, provided that each of —O—, —S— and —$CO_2$— is bonded so as to be adjacent to the alkylene group or the arylene group; each of R9, R10 and R11 have the same meaning as R5, R6 and R7; and X represents an anion group, provided that X does not exist in the event of an intramolecular salt.

11. The lightsensitive silver halide photographic emulsion according to claim 8, wherein the sensitizing dye rendered the silver halide grains red-sensitive.

12. A silver halide photographic lightsensitive material comprising at least one lightsensitive silver halide emulsion layer on a support, wherein the lightsensitive silver halide emulsion layer comprises the lightsensitive silver halide photographic emulsion according to claim 8.

13. A method of enhancing a sensitivity of a lightsensitive silver halide emulsion comprising a sensitizing dye having a given maximum absorption wavelength, wherein the method comprises:

adding an organic compound exhibiting no absorption in a visible light region and capable of causing the maximum absorption wavelength of the sensitizing dye to shift toward a shorter wavelength by at least 2 nm.

14. The method of enhancing a sensitivity of a lightsensitive silver halide emulsion according to claim 13, wherein the organic compound exhibiting no absorption in a visible light region is represented by the following general formula (1):

(1)

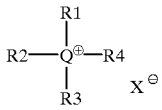

wherein Q represents a N or P atom; each of R1, R2, R3 and R4 represents an alkyl, an aryl or a heterocycle, provided that two of R1, R2, R3 and R4 may be bonded with each other to thereby form a saturated ring, or three of R1, R2, R3 and R4 may cooperate with each other to thereby form an unsaturated ring; and X represents an anion group, provided that X does not exist in the event of an intramolecular salt.

* * * * *